US007997703B2

(12) United States Patent
Naka et al.

(10) Patent No.: US 7,997,703 B2
(45) Date of Patent: Aug. 16, 2011

(54) LIQUID CONTAINER

(75) Inventors: Takahiro Naka, Nagano (JP); Takahiro Katakura, Nagano (JP); Atsushi Kobayashi, Nagano (JP); Satoshi Shinada, Nagano (JP); Toshio Kumagai, Nagano (JP); Taku Ishizawa, Nagano (JP); Takeo Seino, Nagano (JP); Hisashi Miyazawa, Nagano (JP); Takakazu Fukano, Nagano (JP); Hitotoshi Kimura, Nagano (JP); Yasunao Uehara, Nagano (JP); Masahide Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 579 days.

(21) Appl. No.: 12/172,814

(22) Filed: Jul. 14, 2008

(65) Prior Publication Data

US 2008/0273048 A1 Nov. 6, 2008

Related U.S. Application Data

(62) Division of application No. 10/811,470, filed on Mar. 26, 2004, now Pat. No. 7,404,628.

(30) Foreign Application Priority Data

| | | |
|---|---|---|
| Mar. 26, 2003 | (JP) | 2003-085097 |
| May 30, 2003 | (JP) | 2003-154991 |
| Jun. 5, 2003 | (JP) | 2003-160685 |
| Jun. 5, 2003 | (JP) | 2003-160815 |
| Jun. 5, 2003 | (JP) | 2003-160836 |
| Jul. 2, 2003 | (JP) | 2003-190527 |
| Jul. 17, 2003 | (JP) | 2003-198631 |
| Jul. 17, 2003 | (JP) | 2003-198638 |
| Aug. 20, 2003 | (JP) | 2003-296687 |

(51) Int. Cl.
*B41J 2/175* (2006.01)

(52) U.S. Cl. ..... 347/86

(58) Field of Classification Search ..... 347/85, 347/86

See application file for complete search history.

(56) References Cited

U.S. PATENT DOCUMENTS 4,558,326 A 12/1985 Kimura et al.

(Continued)

FOREIGN PATENT DOCUMENTS

DE 199 51 090 A1 4/2001

(Continued)

OTHER PUBLICATIONS

Search report for European patent appln. No. 04007410.6-2304 (Mar. 10, 2006).

(Continued)

*Primary Examiner* — Anh T. N. Vo

(74) *Attorney, Agent, or Firm* — Stroock & Stroock & Lavan LLP

(57) ABSTRACT

The invention provides a liquid container for storing liquid to be supplied to a liquid consuming apparatus. The liquid container is constructed such that pressurized fluid is sent to its inside so that the liquid in the inside is delivered to the outside. The liquid container includes a container body which stores the liquid in its inside. The container body includes a pressurized fluid introduction port for introducing the pressurized fluid to the inside and a liquid delivery port for delivering the liquid to the outside. A detection unit is provided in the container body and outputs an output signal which is changed in accordance with a change in pressure of the liquid in the inside of the container body.

7 Claims, 37 Drawing Sheets

U.S. PATENT DOCUMENTS

| | | | | |
|---|---|---|---|---|
| 4,604,633 | A | 8/1986 | Kimura et al. | |
| 4,673,955 | A | 6/1987 | Ameyama et al. | |
| 4,826,135 | A | 5/1989 | Mielke | |
| 5,646,666 | A | 7/1997 | Cowger et al. | |
| 5,856,840 | A * | 1/1999 | Barinaga et al. | 347/86 |
| 6,151,039 | A | 11/2000 | Hmelar et al. | |
| 6,243,115 | B1 | 6/2001 | Baker et al. | |
| 6,290,343 | B1 | 9/2001 | Lewis et al. | |
| 6,322,205 | B1 | 11/2001 | Childers et al. | |
| 6,435,638 | B1 | 8/2002 | Wilson et al. | |
| 6,454,375 | B2 | 9/2002 | Wilson et al. | |
| 6,471,343 | B1 | 10/2002 | Shimizu et al. | |
| 6,585,345 | B2 | 7/2003 | Kosugi | |
| 6,585,358 | B2 * | 7/2003 | Usui et al. | 347/85 |
| 6,644,794 | B1 | 11/2003 | Wilson et al. | |
| 6,773,099 | B2 | 8/2004 | Inoue et al. | |
| 6,834,945 | B2 | 12/2004 | Ishizawa et al. | |
| 6,874,874 | B2 * | 4/2005 | Sasaki | 347/86 |
| 6,874,876 | B2 | 4/2005 | Ishizawa et al. | |
| 6,988,793 | B2 | 1/2006 | Wilson et al. | |
| 7,090,341 | B1 * | 8/2006 | Miyazawa | 347/85 |
| 7,380,909 | B2 | 6/2008 | Ishizawa et al. | |
| 7,404,628 | B2 | 7/2008 | Naka et al. | |
| 7,566,120 | B2 | 7/2009 | Ishizawa et al. | |
| 2002/0130932 | A1 | 9/2002 | Harada et al. | |
| 2003/0071862 | A1 | 4/2003 | Tsukada et al. | |
| 2008/0273048 | A1 | 11/2008 | Naka et al. | |

FOREIGN PATENT DOCUMENTS

| | | | |
|---|---|---|---|
| EP | 1 013 448 | A2 | 6/2000 |
| EP | 1 088 668 | A1 | 4/2001 |
| EP | 1 097 814 | B1 | 5/2001 |
| EP | 1 120 258 | B1 | 8/2001 |
| EP | 1 199 177 | A1 | 4/2002 |
| EP | 1 223 037 | A1 | 7/2002 |
| EP | 1 389 531 | A1 | 2/2004 |
| JP | 55-120941 | U | 8/1980 |
| JP | 57-034967 | A | 2/1982 |
| JP | 57-103877 | A | 6/1982 |
| JP | 57-185158 | | 11/1982 |
| JP | 59-115857 | | 7/1984 |
| JP | 61-277460 | A | 12/1986 |
| JP | 62 121062 | | 6/1987 |
| JP | 63-247050 | A | 10/1988 |
| JP | 64-40532 | | 3/1989 |
| JP | 01-176566 | A | 7/1989 |
| JP | 03-506000 | T | 12/1991 |
| JP | 04-286653 | | 10/1992 |
| JP | 06-012882 | U | 2/1994 |
| JP | 06-143612 | | 5/1994 |
| JP | 06-045736 | U | 6/1994 |
| JP | 06-171106 | A | 6/1994 |
| JP | 07-304187 | A | 11/1995 |
| JP | 2001-063087 | A | 3/2001 |
| JP | 2002-019135 | A | 1/2002 |
| JP | 2002-113881 | | 4/2002 |
| JP | 2002-160385 | A | 6/2002 |
| JP | 2002-234192 | A | 8/2002 |
| JP | 2002-273898 | A | 9/2002 |
| JP | 2002-331684 | | 11/2002 |
| JP | 42 35942 | | 12/2008 |
| WO | 00/68018 | A1 | 11/2000 |
| WO | 01/87626 | A1 | 11/2001 |

OTHER PUBLICATIONS

European Search Report dated Jan. 5, 2006, in patent appln. No. 04007410.6-2304.

* cited by examiner

FIG. 34

| ON/OFF OF DETECTION UNIT | | |
|---|---|---|
| | THERE IS INK | THERE IS NO INK |
| OPERATION OF PRESSURIZING PUMP | OFF | ON |
| STOP OF PRESSURIZING PUMP | ON | ON |

"THERE IS INK" : THE AMOUNT OF INK IN AN INK RESERVOIR CHAMBER IS A PREDETERMINED VALUE OF MORE

"THERE IS NO INK" : THE REMAINING AMOUNT OF INK IN AN INK RESERVOIR CHAMBER IS LESS THAN A PREDETERMINED VALUE

LIQUID CONTAINER

CROSS-REFERENCE TO RELATED APPLICATION

This application is a division of copending U.S. patent application Ser. No. 10/811,470, filed on Mar. 26, 2004, the contents of which are incorporated by reference herein.

BACKGROUND OF THE INVENTION

The present invention relates to a liquid container for storing liquid to be supplied to a liquid consuming apparatus such as an ink-jet recording apparatus.

As a typical example of a conventional liquid consuming apparatus, there is a liquid ejecting apparatus which ejects a liquid droplet from an ejecting head, and as a typical example of the liquid ejecting apparatus, there is an ink-jet recording apparatus provided with an ink-jet recording head for image recording. Other liquid ejecting apparatuses include, for example, an apparatus provided with a color material ejecting head used for manufacture of a color filter of a liquid crystal display or the like, an apparatus provided with an electrode material (conductive paste) ejecting head used for electrode formation of an organic EL display, a surface emitting display (FED) or the like, an apparatus provided with a biological organic material ejecting head used for manufacture of a biochip, an apparatus provided with a sample ejecting head as a precision pipette, and the like.

The ink-jet recording apparatus as the typical example of the liquid ejecting apparatus has been recently used in many printings including color printings because noises at the time of printing are relatively low and small dots can be formed at high density.

As a supplying method of liquid to the liquid consuming apparatus typified by the ink-jet recording apparatus, there is a method in which liquid is supplied from a liquid container storing the liquid to the liquid consuming apparatus. In this method, in order that a user can easily exchange the liquid container at the point of time when the liquid in the liquid container is consumed, the liquid container is generally constructed as a cartridge which is constructed to be removably attached to the liquid consuming apparatus.

As a conventional example of such a cartridge type liquid container, there is a type in which compressed air is sent into the inside of the liquid container to pressurize the liquid in the liquid container, and the liquid in the liquid container is delivered to the outside of the cartridge by using this pressure and is supplied to the liquid consuming apparatus. As stated above, by pressurizing the liquid in the liquid container and supplying it to the liquid consuming apparatus, for example, even in the case where a liquid discharge part in the liquid consuming apparatus is higher than the position of the liquid container, or even in the case where flow path resistance from the liquid container to the liquid discharge part is high, the liquid can be stably supplied from the liquid container to the liquid discharge part.

(1) U.S. Pat. No. 6,290,343 discloses an ink cartridge of a type in which compressed air is sent into an inner flexible bag, and an ink-jet printer in which the ink cartridge is mounted. A pressure sensor is connected to a pressurizing pump for pressurizing the air. The pressurizing pump is controlled in accordance with the output of this pressure sensor so that the supply of ink is controlled.

As described above, in the ink cartridge and the ink-jet printer disclosed in U.S. Pat. No. 6,290,343, the supply of the ink is controlled on the basis of the operation of the pressurizing pump. Thus, for example, even in the case where the mounting of the ink cartridge to the ink-jet printer is poor, and the ink is not actually supplied to the inkjet printer although the pressurizing pump is operated, as long as the operation of the pressurizing pump is detected by the pressure sensor, it is mistaken that the ink is being supplied.

The present invention has been made in view of the foregoing circumstances, and has an object to provide a liquid container which is constructed such that pressurized fluid is sent into the inside of the liquid container so that liquid in the inside of the container is delivered to the outside, and in which it is possible to judge whether or not the liquid in the inside of the liquid container is actually being pressurized by the pressurized fluid.

(2) As a method of detecting an amount of ink remaining in an ink cartridge constructed to discharge ink using a pressurized fluid fed from outside, generally using air pressure, a method is disclosed in U.S. Pat. No. 6,151,039 in which electrodes are mounted on an ink bag formed of a flexible material for containing ink so as to face to each other for detecting the thickness of the ink bag. Another method is disclosed in U.S. Pat. No. 6,435,638 in which a through hole is provided in the midway of a channel for connecting an ink bag to an ink feeding port and a pressure sensor is fixed so as to seal the through hole for detecting delivery pressure by the pressure sensor.

In the ink cartridges provided with the function of detecting the amount of remaining ink, the former can continuously detect the variation in the amount of ink in relation to detecting the thickness of the ink bag, but has a problem of low detection accuracy at ink end.

On the other hand, the latter can detect the amount of ink remaining at high accuracy when the amount of ink is really small. However, the latter is difficult to detect the amount of ink before the remaining ink amount reaches a set amount, such as ink end, because it detects the pressure of ink in the ink channel. Further, the latter suffers from a problem that the amount of ink for printing is significantly small after ink end is detected and thus printing becomes impossible.

The invention has been made in view of the problems. The object is to provide a liquid container capable of accurately detecting the point in time when an amount of liquid contained therein is reduced equal to or below a set amount and capable of feeding liquid with some margin after the set amount is detected.

(3) In a conventional ink cartridge in which compressed air is introduced into the inside of a container and ink is delivered to the outside of the container by its pressure, an assembling operation for forming a sealing structure between a pressurizing chamber into which the compressed air is introduced and a reservoir chamber in which the ink is stored or a disassembling operation has been complicated.

Besides, in the conventional ink cartridge of the foregoing type, even if an attempt is made to recycle a part of the components after use, it is structurally difficult to remove only necessary components, and the recycling has been very difficult or impossible.

Further, in the conventional ink cartridge of the foregoing type, there has been a problem that the compressed air introduced into the inside of the ink cartridge permeates through a flexible film separating the ink from the compressed air and dissolves in the ink, and the print quality is lowered.

The invention has been made in view of the above circumstances, and has an object to facilitate the assembling and disassembling operation of a liquid container constructed such that pressurized fluid is sent into the inside of the liquid container so that liquid in the inside of the container is delivered to the outside.

Besides, in the liquid container of the foregoing type, the invention has an object to realize a structure which is easy to recycle.

Further, in the liquid container of the foregoing type, the invention has an object to prevent the pressurized fluid introduced into the inside of the container from dissolving in the liquid.

(4) In general, in a conventional ink cartridge provided with a detection unit of a remaining amount of ink, the ink cartridge and an ink-jet recording apparatus are connected with each other through an electric contact, an output signal of the detection unit is transmitted from the ink cartridge side to the ink-jet recording apparatus side through this electric contact, and the supply of electric power to the detection unit is also performed through the electric contact.

The detection unit of the remaining amount of ink in the conventional ink cartridge includes a type in which an actuator disposed to be adjacent to ink is vibrated and the existence of the ink is detected from its vibration state, and a type in which a light emitting element and a light receiving element are provided and the existence of the ink therebetween is detected. In any type, since electric power consumed to drive the detection unit is large, sufficient electric power can not be supplied by the supply of electric power according to a non-contact form, and as described above, the supply of electric power according to a contact form using the electric contact must be adopted.

However, in the conventional ink cartridge using the electric contact, there is a case where the electric contact causes poor contact due to the poor mounting of the ink cartridge to the ink-jet recording apparatus or the attachment of a foreign matter to the electric contact. When the poor contact occurs at the electric contact as stated above, the output of the detection unit of the remaining amount of ink is not transmitted to the ink-jet recording apparatus side, or the operation of the detection unit becomes impossible since the supply of electric power to the detection unit can not be performed, and there has been possibility that the detection of the remaining amount of ink becomes impossible, and poor printing is caused.

This invention has been made in view of the above circumstances, and has an object to provide a liquid container which can transmit information relating to a remaining amount of liquid to a liquid consuming apparatus without providing an electric contact between the liquid container and the liquid consuming apparatus.

(5) In the case where a detection unit for detecting the remaining amount of ink in the inside of a liquid container, and a unit for communicating an output signal of the detection unit without providing an electric contact (for example, a unit for performing communication by an electric wave) are provided, it is preferable that the detection unit is incorporated in the inside of the liquid container and the communication unit is also incorporated in the inside of the liquid container from the viewpoint of protection of the communication unit.

However, since a mounting space of the detection unit and the communication unit in the inside of the liquid container is limited, it is desired that while the space efficiency is considered, the detection unit and the communication unit are incorporated in the inside of the liquid container, and electrical connection of both is achieved without fail.

In addition to the case where the whole of the communication unit is disposed in the inside of the liquid container, this is also desired in the case where a part (for example, an antenna) of the communication unit is disposed at the outside of the liquid container, and the other part (for example, an electrical connection part to the detection unit, or a control part for controlling the communication) of the communication unit is disposed in the inside of the liquid container, or in the case where a communication unit is a contact type communication unit using an electric contact, a part (for example, the electric contact) of the communication unit is disposed at the outside of the liquid container, and the other part (for example, an electrical connection part to the detection unit or a control part for controlling the communication) is disposed in the inside of the liquid container.

This invention has been made in view of the above circumstances, and has an object to provide a liquid container in which when at least a part of the detection unit of the remaining amount of liquid and the communication unit is incorporated in the inside of the liquid container, electrical connection of both can be easily and certainly achieved.

(6) A liquid container in which liquid in the inside of a liquid container is pressurized by pressurized fluid is generally provided with a valve unit. That is, the liquid container as stated above is constructed such that the valve unit is provided at a liquid delivery port for delivering the liquid in the inside, and this valve unit keeps a valve closed state at a normal time, and when the liquid container is mounted in a liquid consuming apparatus, the valve is opened.

However, the valve unit in the liquid container has a problem that when the valve body is pressed from the outside in a state where the liquid container is not mounted in the liquid consuming apparatus, air flows into the inside of the liquid container, or the liquid in the inside of the liquid container leaks to the outside.

As a measure to prevent the inflow of the air, it is conceivable to provide a check valve which is opened only in the direction of delivering the liquid. However, there is a problem that this measure increases the number of parts, and the layout of part arrangement becomes difficult. Further, even if the check valve is provided as the air inflow preventing measure, the problem of the leakage of the liquid from the liquid container by pressing the valve body from the outside is not resolved.

This invention has been made in view of the above circumstances, and has an object to prevent, in a liquid container constructed such that pressurized fluid is introduced into the inside of the liquid container so that liquid in the inside of the container is delivered to the outside, the inflow of air to the inside of the liquid container and the leakage of the liquid from the liquid container.

SUMMARY OF THE INVENTION

The invention provides a liquid container for storing liquid to be supplied to a liquid consuming apparatus. The liquid container is constructed such that pressurized fluid is sent to its inside so that the liquid in the inside is delivered to the outside. The liquid container includes a container body which stores the liquid in its inside. The container body includes a pressurized fluid introduction port for introducing the pressurized fluid to the inside and a liquid delivery port for delivering the liquid to the outside. A detection unit is provided in the container body and outputs an output signal which is changed in accordance with a change in pressure of the liquid in the inside of the container body.

Besides, preferably, the liquid container further includes a liquid reservoir chamber (first reservoir chamber) which is formed in the inside of the contain body and stores the liquid and whose volume is decreased by receiving pressure of the pressurized fluid, and a sensor chamber (second reservoir chamber) which is formed in the inside of the container body and communicates with the liquid reservoir chamber. The pressure of the pressurized fluid applied to the liquid in the inside of the liquid reservoir chamber is transmitted through the liquid to the liquid in the inside of the sensor chamber. The output signal of the detection unit is changed in accordance with the pressure change of the liquid in the inside of the sensor chamber.

Besides, preferably, the sensor chamber is constructed such that the volume thereof is changed in accordance with the pressure change of the liquid in the inside thereof, and the output signal of the detection unit is changed in accordance with a volume change of the sensor chamber.

Besides, preferably, the sensor chamber is provided at a midway of a flow path for connecting the liquid reservoir chamber and the liquid delivery port.

Besides, preferably, the detection unit includes a contact type switch which is opened and closed in accordance with the volume change of the sensor chamber.

Besides, preferably, the contact type switch is put in one of on and off states in a case where the pressure of the liquid in the container body is a predetermined value or more, and is put in the other of the on and off states in a case where the pressure of the liquid in the container body is less than the predetermined value.

Besides, preferably, the contact type switch includes a movable side terminal displaced in accordance with the volume change of the sensor chamber and a fixed side terminal disposed to be opposite to the movable side terminal.

Besides, preferably, at least a part of a wall forming the sensor chamber is constituted by a flexible film. The detection unit includes a movable press member brought into contact with the flexible film of the sensor chamber, and an urging member for urging the press member toward a direction of decreasing the volume of the sensor chamber. Displacement of the movable side terminal is caused by displacement of the press member due to the volume change of the sensor chamber.

Besides, preferably, the press member is displaced by an increase of the volume of the sensor chamber against an urging force of the urging member so that the displacement of the movable side terminal is caused.

Besides, preferably, the displacement of the movable side terminal occurs when the press member, which is displaced by the increase of the volume of the sensor chamber against the urging force of the urging member, reaches a vicinity of a limiting point in a displaceable range of the press member.

Besides, preferably, the pressurized fluid is compressed air.

Besides, preferably, the output signal of the detection unit is an electric signal.

Besides, preferably, the liquid container further includes a transmission unit for transmitting the detection signal of the detection unit to the liquid consuming apparatus in a contact manner.

Besides, preferably, the liquid container further includes a transmission unit for transmitting the detection signal of the detection unit to the liquid consuming apparatus in a noncontact manner.

Besides, preferably, the liquid container includes a memory unit for storing information relating to the liquid in the container body, and the transmission unit transmits the information from the memory unit, together with the detection signal of the detection unit, to the liquid consuming apparatus.

Besides, preferably, the liquid consuming apparatus is an ink-jet recording apparatus, and the liquid container is an ink cartridge removably mounted in the ink-jet recording apparatus.

The invention further provides: a liquid container constructed such that a pressure is applied to liquid in a liquid containing chamber (first reservoir chamber) by a pressure of a pressurized fluid fed from a pressurized fluid introduction port to feed the liquid to a liquid consuming apparatus from a liquid delivery port; a liquid container constructed such that liquid in a liquid containing chamber (first reservoir chamber) is selectively pressurized from outside to feed the liquid in the liquid containing chamber to a liquid consuming apparatus from a liquid delivery port, and a liquid container constructed such that liquid in a liquid containing chamber (first reservoir chamber) is constantly pressurized by a built-in pressurizing unit to feed the liquid to a liquid consuming apparatus from a liquid delivery port. Each of the liquid containers includes a buffer chamber (second reservoir chamber) connected to a channel for connecting the liquid containing chamber to the liquid delivery port. The buffer chamber is expanded in its volume by an inflow of the liquid from the liquid containing chamber to the buffer chamber, and contracted when the inflow of the liquid from the liquid containing chamber to the buffer chamber is stopped. Each of the liquid containers further includes a detecting unit adapted to detect a volume variation of the buffer chamber. In a case where the pressurized fluid fed from the pressurized fluid introduction port is uses as pressure application means for applying the pressure to the liquid in the liquid containing chamber, the buffer chamber is disposed in an area blocked from the pressure of the pressurized fluid.

Preferably, the liquid containing chamber is configured such that a recessed part is formed in a hard case forming the liquid container and an opening of the recessed part is sealed by a film.

Preferably, the buffer chamber is configured such that a recessed part is formed in a hard case forming the liquid container and an opening of the recessed part is sealed by a film.

Preferably, the liquid containing chamber is formed of a flexible bag.

Preferably, the buffer chamber is formed of a flexible bag and is energized by an energizing unit so as to be contracted.

Preferably, each of a channel for connecting the liquid containing chamber to the buffer chamber and a channel for connecting the buffer chamber to the liquid delivery port is configured such that a groove or a through hole is formed in a hard case forming the liquid container.

The invention further provides a liquid container for storing therein liquid to be supplied to a liquid consuming apparatus. The liquid container includes: a container body having a liquid delivery port for delivering the liquid to the outside; a first reservoir chamber formed in the inside of the container body and for storing the liquid; a first pressurizing unit capable of pressurizing the liquid in the first reservoir chamber; a second reservoir chamber which is formed in the inside of the container body and communicates with the first reservoir chamber and the liquid delivery port and in which pressure in the first reservoir chamber is transmitted through the liquid to the liquid in its inside; a second pressurizing unit for pressurizing the liquid in the second reservoir chamber to delivery the liquid through the liquid delivery port; and a detection unit which is provided in the container body and whose output signal is changed in accordance with a change of pressure of the liquid in the second reservoir chamber. $P1>P2>P3$ is established where a pressure applied to the liquid in the first reservoir chamber by the first pressurizing unit is P1, a pressure applied to the liquid in the second reservoir chamber by the second pressurizing unit is P2, and a pressure loss in a liquid flow path from the liquid container to the liquid consuming apparatus is P3.

Besides, preferably, when a pressure of the liquid in the second reservoir chamber is P, the output signal of the detection unit is changed according to P>P2 or P<P2.

Besides, preferably, the liquid container further includes a memory unit for storing a liquid reservoir amount in the inside of the container body, and data relating to the liquid reservoir amount stored in the memory unit is rewritten into a predetermined amount at the point of time when the output signal of the detection unit is changed.

Besides, preferably, the first pressurizing unit is constructed to pressurize the first reservoir chamber by pressure of pressurized fluid introduced into the inside of the container body.

Besides, preferably, at least apart of the first pressurizing unit is constituted by a first flexible film. The first pressurizing unit includes a pressurizing chamber whose volume can be changed by receiving the pressure of the pressurized fluid. The first reservoir chamber is pressurized by a volume change of the pressurizing chamber.

Besides, preferably, the first flexible film includes an introduction port side film member which comes in contact with the pressurized fluid introduced into the inside of the container body and is deformed, and a reservoir chamber side film member which constitutes at least a part of a wall forming the first reservoir chamber and is pressed and deformed by deformation of the introduction port side film member.

Besides, preferably, when a pressure loss due to a reaction force at a time of deformation of the first flexible film is P4, and a pressure of the pressurized fluid introduced into the inside of the container body is P1', P1'−P4=P1>P2 is established.

Besides, preferably, the second reservoir chamber is constructed such that its volume is changed in accordance with a pressure change of the liquid in the inside of the second reservoir chamber, and the output signal of the detection unit is changed in accordance with the volume change of the second reservoir chamber.

Besides, preferably, the second pressurizing unit includes a second flexible film constituting at least a part of a wall forming the second reservoir chamber and a press member for pressing the second flexible film toward a direction of decreasing the volume of the second reservoir chamber.

Besides, preferably, when a pressure loss due to a reaction force at a time of deformation of the second flexible film is P5, and a pressure applied from the press member to the second flexible film is P2', P1>P2'+P5, and P2'−P5=P2>P are established.

Besides, preferably, the pressure P2 applied to the liquid in the second reservoir chamber by the second pressurizing unit is changed between P2-MAX and P2-MIN in accordance with the amount of the liquid stored in the inside of the second reservoir chamber, and P1>P2-MAX>P2-MIN>P3 is established.

Besides, preferably, the second pressurizing unit includes a compression spring for generating a force to pressurize the liquid in the second reservoir chamber.

Besides, preferably, when a water head difference of the liquid container relative to a liquid discharge part of the liquid consuming apparatus is P7, P1>P2>P3−P7 is established.

Besides, preferably, the first reservoir chamber and the second reservoir chamber are communicated with each other through a narrow communicating path.

Besides, preferably, the first reservoir chamber and the second reservoir chamber are integrally formed without a narrow flow path intervening between both the chambers.

Besides, preferably, the pressurized fluid is supplied from the liquid consuming apparatus.

Besides, preferably, the liquid consuming apparatus is an ink-jet recording apparatus, and the liquid container is an ink cartridge removably mounted in the ink-jet recording apparatus.

The invention further provides a liquid container for storing therein liquid to be supplied to a liquid consuming apparatus. The liquid container includes: a container body having a pressurized fluid introduction port for introducing pressurized fluid into the inside and a liquid delivery port for delivering the liquid to the outside; a first reservoir chamber which is formed in the inside the container body, stores the liquid, and includes a first flexible film constituting at least a part of a wall forming the first reservoir chamber; a first pressurizing unit for applying pressure of the pressurized fluid to the first flexible film to deform the first flexible film; a second reservoir chamber which is formed in the inside of the container body, communicates with the first reservoir chamber and the liquid delivery port, and includes a second flexible film constituting a part of a wall forming the second reservoir chamber and in which the second flexible film seals a substantially circular or regular polygonal opening formed by the rigid wall forming the second reservoir chamber, and the pressure of the pressurized fluid applied to the liquid in the first reservoir chamber is transmitted through the liquid to the liquid in the inside of the second reservoir chamber; a second pressurizing unit which pressurizes the liquid in the second reservoir chamber to deliver the liquid from the liquid delivery port in a state where the liquid in the first reservoir chamber is consumed and the pressure of the pressurized fluid is not transmitted to the liquid in the inside of the first reservoir chamber, and includes a press member for pressing the second flexible film toward a direction of decreasing a volume of the second reservoir chamber; and a detection unit which is provided in the container body and whose output signal is changed in accordance with a change of pressure of the liquid in the second reservoir chamber.

Besides, preferably, the opening sealed by the second flexible film is substantially square.

Besides, preferably, the second reservoir chamber is constructed such that the volume is changed in accordance with the pressure change of the liquid in the inside, and the output signal of the detection unit is changed in accordance with the volume change of the second reservoir chamber.

Besides, preferably, the first pressurizing unit includes a pressurizing chamber film which comes in contact with the pressurized fluid introduced from the pressurized fluid introduction port to the inside of the container body and is deformed. The first flexible film is pressed by deformation of the pressurizing chamber film and is deformed. The container body includes a first case member to which the first flexible film and the second flexible film are bonded to form the first reservoir chamber and the second reservoir chamber, and a second case member to which the pressurizing chamber film is bonded to form a pressurizing chamber into which the pressurized fluid is introduced. The press member is mounted to the second case member.

Besides, preferably, the press member is movably supported by a guide part integrally formed to the second case member.

Besides, preferably, the guide part includes a projection integrally formed in the second case member, a through hole in which the projection is freely inserted is formed in the press member, and a tip of the projection is subjected to heat caulking in a state where the projection is inserted in the through hole, so that the press member does not come off from the projection.

Besides, preferably, the second pressurizing unit includes a compression spring for urging the press member to press the second flexible film toward the direction of decreasing the volume of the second reservoir chamber.

Besides, preferably, the liquid consuming apparatus is an ink-jet recording apparatus, and the liquid container is an ink cartridge removably mounted in the ink-jet recording apparatus.

The invention further provides a liquid container for storing liquid to be supplied to a liquid consuming apparatus. The liquid container is constructed such that pressurized fluid is sent into its inside so that the liquid in the inside is delivered to the outside. The liquid container includes: a tank unit which includes a sealed liquid reservoir chamber for storing the liquid, and a liquid delivery port communicating with the liquid reservoir chamber and for delivering the liquid to the outside of the liquid container and in which a volume of the liquid reservoir chamber is changed in accordance with an amount of the liquid stored in the inside thereof; and a pressurizing unit which includes a sealed pressurizing chamber into which the pressurized fluid is introduced to change a volume, and a pressurized fluid introduction port communicating with the pressurizing chamber and for introducing the pressurized fluid to the inside of the pressurizing chamber, and is constructed to pressurize the liquid reservoir chamber of the tank unit by a volume change of the pressurizing chamber.

Besides, preferably, the pressurizing unit further includes a memory unit for storing information relating to the liquid stored in the tank unit.

Besides, preferably, the tank unit further includes a memory unit for storing information relating to the liquid stored in its inside.

Besides, preferably, the tank unit and the pressurizing unit are respectively formed as separate bodies and are fixed to each other.

Besides, preferably, the tank unit and the pressurizing unit are fixed to each other by heat caulking.

Besides, preferably, a projection formed at the tank unit is melted so that the tank unit and the pressurizing unit are fixed to each other by heat caulking.

Besides, preferably, the tank unit and the pressurizing unit have outer peripheral shapes substantially common to each other, and the tank unit and the pressurizing unit are stacked so that a substantially whole outer shape of the liquid container is determined.

Besides, preferably, the tank unit includes a reservoir chamber formation member in which a through hole forming the liquid reservoir chamber is formed, and a cover member stacked on the reservoir chamber formation member.

Besides, preferably, the liquid reservoir chamber includes a reservoir chamber side flexible film constituting at least a part of a wall forming the liquid reservoir chamber, and the pressurizing chamber includes a pressurizing chamber side flexible film constituting at least a part of a wall forming the pressurizing chamber and disposed to be opposite to the reservoir chamber side flexible film.

Besides, preferably, the pressurizing unit further includes a detection unit for detecting a remaining amount of the liquid stored in the tank unit.

Besides, preferably, the detection unit transmits an output signal changing in accordance with a change in pressure of the liquid in the tank unit.

Besides, preferably, the liquid container further includes a sealed additional reservoir chamber (second reservoir chamber) which is provided in the tank unit and communicates with the liquid reservoir chamber (first reservoir chamber) and the liquid delivery port. Pressure of the pressurized fluid applied to the liquid in the inside of the liquid reservoir chamber is transmitted through the liquid to the liquid in the inside of the additional reservoir chamber. The output signal of the detection unit is changed in accordance with a pressure change of the liquid in the inside of the additional reservoir chamber.

Besides, preferably, the additional reservoir chamber is constructed such that a volume is changed in accordance with the pressure change of the liquid in the inside, and the output signal of the detection unit is changed in accordance with a volume change of the additional reservoir chamber.

Besides, preferably, the tank unit includes an erroneous mounting prevention unit for preventing the liquid container from being erroneously mounted to a liquid consuming apparatus other than the suitable liquid consuming apparatus or to a position other than a suitable position of the suitable liquid consuming apparatus.

Besides, preferably, the liquid consuming apparatus is an ink-jet recording apparatus, and the liquid container is an ink cartridge removably mounted in the ink-jet recording apparatus.

The invention further provides a liquid container for storing therein liquid to be supplied to a liquid consuming apparatus. The liquid container includes a detection unit for digitally detecting whether an amount of liquid stored in the inside of the liquid container is a predetermined value or more or not, and a communication unit for communicating an output signal of the detection unit to the liquid consuming apparatus by an electric wave.

Besides, preferably, the detection unit includes a switch unit in which a conduction state and a non-conduction state are switched by whether the amount of the liquid stored in the inside of the liquid container is the predetermined value or more or not.

Besides, preferably, the switch unit includes a conductive elastic member at least a part of which is elastically deformed in accordance with a state change as to whether the amount of the liquid stored in the inside of the liquid container is the predetermined value or more or not.

Besides, preferably, the conductive elastic member includes a movable side terminal at least a part of which is displaced in accordance with the state change as to whether the amount of the liquid stored in the inside of the liquid container is the predetermined value or more or not, and a fixed side terminal which is disposed to be opposite to the movable side terminal and in which the contact state and the non-contact state relative to the movable side terminal are switched by the displacement of the movable side terminal.

Besides, preferably, the detection unit includes a press unit which is displaced when the amount of the liquid stored in the inside of the liquid container becomes less than the predetermined value, to thereby press and displace at least a part of the conductive elastic member.

Besides, preferably, the liquid container further includes a memory unit for storing information relating to the liquid stored in the inside of the liquid container, and the memory unit is formed integrally with the communication unit.

Besides, preferably, the predetermined value is set as an amount of liquid necessary for processing a unit amount or more of material to be processed by the liquid consuming apparatus.

Besides, preferably, the material to be processed is recording paper, and the unit amount of the material to be processed is a sheet of recording paper.

Besides, preferably, the liquid container is constructed such that pressurized fluid is sent into its inside so that the liquid in the inside is delivered to the outside. The liquid container includes: a container body having a pressurized fluid introduction port for introducing the pressurized fluid into the inside and a liquid delivery port for delivering the liquid to the outside; a liquid reservoir chamber (first reservoir chamber) which is formed in the inside of the container body, stores the liquid, and is constructed such that its volume is decreased by receiving pressure of the pressurized fluid; and a sensor chamber (second reservoir chamber) which is formed in the inside of the container body and communicates with the liquid reservoir chamber and in which the pressure of the pressurized fluid applied to the liquid in the inside of the liquid reservoir chamber is transmitted through the liquid to the liquid in the inside of the sensor chamber. The output signal of the detection unit is changed in accordance with a pressure change of the liquid in the inside of the sensor chamber.

Besides, preferably, the liquid consuming apparatus is an ink-jet recording apparatus, and the liquid container is an ink cartridge removably mounted in the ink-jet recording apparatus.

The invention further provides a liquid container for storing therein liquid to be supplied to a liquid consuming apparatus. The liquid container includes: a detection unit for detecting a remaining amount of liquid in the inside of the liquid container; and an IC module electrically connected to the detection unit. The IC module includes: plural terminals coming in contact with the detection unit to achieve electrical conduction; and an antenna member for communicating an output signal of the detection unit to the liquid consuming apparatus by an electric wave. The plural terminals are disposed side by side along a long side direction of the IC module.

Besides, preferably, the antenna member is formed of a coil-shaped pattern, and the plural terminals are disposed inside the antenna member formed of the coil-shaped pattern.

Besides, preferably, the antenna member is formed of a coil-shaped pattern, and the plural terminals are disposed outside the antenna member formed of the coil-shaped pattern.

Besides, preferably, the detection unit includes a conductive elastic member which is brought into pressure contact with the plural terminals while being elastically deformed.

Besides, preferably, the conductive elastic member includes: a movable side terminal at least a part of which is displaced in accordance with a state change as to whether an amount of the liquid stored in the inside of the liquid container is a predetermined value or more or not; and a fixed side terminal which is disposed to be opposite to the movable side terminal and in which a contact state and a non-contact state relative to the movable side terminal are switched by the displacement of the movable side terminal.

Besides, preferably, the detection unit includes a press unit which is displaced when the amount of the liquid stored in the inside of the liquid container becomes less than the predetermined value to thereby press and displace at least a part of the conductive elastic member.

Besides, preferably, the liquid container is constructed such that pressurized fluid is sent into the inside so that the liquid in the inside is delivered to the outside. The liquid container further includes: a container body having a pressurized fluid introduction port for introducing the pressurized fluid into the inside and a liquid delivery port for delivering the liquid to the outside; a liquid reservoir chamber (first reservoir chamber) which is formed in the inside of the container body, stores the liquid, and is constructed such that its volume is decreased by receiving pressure of the pressurized fluid; and a sensor chamber (second reservoir chamber) which is formed in the inside of the container body and communicates with the liquid reservoir chamber and in which the pressure of the pressurized fluid applied to the liquid in the inside of the liquid reservoir chamber is transmitted through the liquid to the liquid in the inside of the sensor chamber. The output signal of the detection unit is changed in accordance with a pressure change of the liquid in the inside of the sensor chamber.

Besides, preferably, the liquid consuming apparatus is an ink-jet recording apparatus, and the liquid container is an ink cartridge removably mounted in the ink-jet recording apparatus.

The invention further provides a liquid container for storing liquid to be supplied to a liquid consuming apparatus. The liquid container is constructed such that pressurized fluid is introduced into its inside so that the liquid in the inside is pressurized and is delivered to the outside. The liquid container includes: a container body having a pressurized fluid introduction port for introducing the pressurized fluid into the inside and a liquid delivery port for delivering the liquid to the outside; a first liquid reservoir chamber which is formed in the inside of the container body, stores the liquid, and is constructed such that its volume is decreased by receiving pressure of the pressurized fluid; a second liquid reservoir chamber which is formed in the inside of the container body and communicates with the first liquid reservoir chamber and in which the pressure of the pressurized fluid applied to the liquid in the inside of the first liquid reservoir chamber is transmitted through the liquid to the liquid in the inside of the second liquid reservoir chamber and its volume is changed in accordance with pressure of the liquid in the inside changed by transmission of the pressure of the pressurized fluid; and a narrow flow path which is formed at a midway of a liquid flow path communicating the first liquid reservoir chamber and the liquid delivery port, and is openably closed by a movable part displaced in accordance with the change of the volume of the second liquid reservoir chamber in a state where the liquid in the first liquid reservoir chamber is not pressurized by the pressurized fluid.

Besides, preferably, at least a part of a wall forming the second liquid reservoir chamber is constituted by a flexible film, the movable part includes at least a part of the flexible film, and the narrow flow path is closed by the flexible film displaced to decrease the volume of the second liquid reservoir chamber.

Besides, preferably, there is further included a press mechanism for pressing the flexible film toward a direction of decreasing the volume of the second liquid reservoir chamber, and magnitude of pressure applied to the flexible film by the press mechanism is set to such a value that the second liquid reservoir chamber can be expanded when the pressure of the pressurized fluid is transmitted through the liquid to the liquid in the inside of the second liquid reservoir chamber.

Besides, preferably, at least a part of the container body is constituted by a member having rigidity, and the second liquid reservoir chamber is formed by sealing an opening of a recess formed in the member having the rigidity with the flexible film.

Besides, preferably, the narrow flow path includes a small hole formed in a bottom of the recess.

Besides, preferably, the narrow flow path is formed in a flow path for connecting the second liquid reservoir chamber and the liquid delivery port.

Besides, preferably, the narrow flow path is formed in a flow path for connecting the first liquid reservoir chamber and the second liquid reservoir chamber.

Besides, preferably, the narrow flow path includes a small hole in which a ring-shaped projection is formed, on a side where it is closed by the movable part.

Besides, preferably, at least a portion of the ring-shaped projection with which the movable part comes in contact is made of an elastic material.

Besides, preferably, the liquid container further includes a detection unit which is provided in the container body and whose output signal is changed in accordance with the volume change of the second liquid reservoir chamber.

Besides, preferably, the detection unit includes a contact type switch opening/closing in accordance with the volume change of the second liquid reservoir chamber.

Besides, preferably, the liquid consuming apparatus is an ink-jet recording apparatus, and the liquid container is an ink cartridge removably mounted in the ink-jet recording apparatus.

The invention further provides a method of manufacturing a liquid container for storing liquid to be supplied to a liquid consuming apparatus. The method includes: a case member providing step of providing a case member formed with a liquid reservoir chamber into which the liquid is to be filled, wherein the case member includes a liquid injection port for injecting the liquid into an inside of the case member, a liquid injection passage communicating the liquid injection port with the liquid reservoir chamber, and a liquid delivery port communicating with the liquid reservoir chamber for delivering the liquid from the liquid container to the liquid consuming apparatus, wherein a partition wall for closing the liquid injection passage is provided in the liquid flow passage, wherein a part of the wall surface forming the liquid reservoir chamber and a part of a wall surface forming the liquid injection passage are constructed by a flexible film, and wherein the flexible film is provided over a top surface of the partition wall but is not attached to the top surface of the partition wall; a liquid injection step of injecting the liquid from the liquid injection port into the liquid injection passage so that the liquid flows into the inside of the liquid reservoir chamber through a clearance formed between the top surface of the partition wall and the flexible film; and a passage closing step of closing a flow passage of the liquid by attaching the flexible film onto the top surface of the partition wall after the injection of the liquid into the inside of the liquid reservoir chamber is complete.

Besides, preferably, a projecting part for defining the clearance between the flexible film and the top surface of the partition wall is formed on the top surface of the partition wall of the case, member provided in the case member providing step. In the flow passage closing step, the projecting part is melted so that the flexible film is welded to the top surface of the partition wall.

Besides, preferably, the method further includes a fluid discharge step after the case member providing step is complete and before the liquid injection step starts. In the fluid discharge step, the liquid injection port is closed, and fluid inside the liquid reservoir chamber and the liquid injection passage is discharged from the liquid delivery port.

Besides, preferably, the flexible film is attached to a top surface of the projecting part formed on the top surface of the partition wall of the case member provided in the case member providing step.

Besides, preferably, the method further includes, after the flow passage closing step is complete, a vacuum-discharge step of vacuum-discharging, via the liquid injection port, the liquid existing between the liquid injection port and the partition wall.

Besides, preferably, the method further includes an injection port closing step of closing the liquid injection port after the vacuum-discharge step is complete.

Besides, preferably, the liquid container is constructed such that pressurized fluid is sent into its inside so that liquid in the inside is pressurized and delivered to the outside from the liquid delivery port.

Beside, preferably, the method further includes a detection unit mounting step of mounting, to the inside of the liquid container, a detecting unit whose output signal is changed in accordance with a pressure change of the liquid stored in the inside of the liquid container.

Besides, preferably, the liquid reservoir chamber is constructed such that its volume is decreased by receiving pressure of the pressurized fluid. The liquid container further includes a sensor chamber which is formed in the inside of the liquid container, which communicates with the liquid reservoir chamber and in which pressure of the pressurized fluid, applied to the liquid in the inside of the liquid reservoir chamber is transmitted through the liquid to the liquid in the inside of the sensor chamber. The output signal of the detection unit is changed in accordance with the pressure change of the liquid in the inside of the sensor chamber.

Besides, preferably, the sensor chamber is constructed such that its volume is changed in accordance with the pressure change of the liquid in the inside of the sensor chamber. The output signal of the detection unit is changed in accordance with the volume change of the sensor chamber.

Besides, preferably, the liquid consuming apparatus is an ink-jet recording apparatus, and the liquid container is an ink cartridge removably mounted in the ink-jet recording apparatus.

The invention further provides a liquid container for storing liquid to be supplied to a liquid consuming apparatus. The liquid container includes: a case member formed with a liquid reservoir chamber into which the liquid is to be filled. The case member includes a liquid injection port for injecting the liquid into an inside of the case member, a liquid injection passage communicating the liquid injection port with the liquid reservoir chamber, and a liquid delivery port communicating with the liquid reservoir chamber for delivering the liquid from the liquid container to the liquid consuming apparatus. A partition wall for closing the liquid injection passage is provided in the liquid flow passage. A part of the wall surface forming the liquid reservoir chamber and a part of a wall surface forming the liquid injection passage are constructed by a flexible film. The flexible film is provided over a top surface of the partition wall. In a state in which the flexible film is not attached to the top surface of the partition wall, the liquid is injected from the liquid injection port into the liquid injection passage so that the liquid flows into the inside of the liquid reservoir chamber through a clearance formed between the top surface of the partition wall and the flexible film. A flow passage of the liquid is closed by attaching the flexible film onto the top surface of the partition wall after the injection of the liquid into the inside of the liquid reservoir chamber is complete.

Besides, preferably, a projecting part for defining the clearance between the flexible film and the top surface of the partition wall is formed on the top surface of the partition wall of the case member when the liquid is injected into the inside of the liquid reservoir chamber, After the injection of the liquid into the inside of the liquid reservoir chamber is complete, the projecting part is melted so that the flexible film is welded to the top surface of the partition wall.

Besides, preferably, after the injection of the liquid into the inside of the liquid reservoir chamber is complete, the liquid existing between the liquid injection port and the partition wall is vacuum-discharged via the liquid injection port.

Besides, preferably, the liquid injection port is closed by welding a sealing member thereto.

Besides, preferably, the liquid container is constructed such that pressurized fluid is sent into its inside so that liquid in the inside is pressurized and delivered to the outside from the liquid delivery port.

Beside, preferably, the liquid container further includes a detecting unit whose output signal is changed in accordance with a pressure change of the liquid stored in the inside of the liquid container.

Besides, preferably, the liquid reservoir chamber is constructed such that its volume is decreased by receiving pressure of the pressurized fluid. The liquid container further includes a sensor chamber which is formed in the inside of the liquid container, which communicates with the liquid reservoir chamber and in which pressure of the pressurized fluid, applied to the liquid in the inside of the liquid reservoir chamber is transmitted through the liquid to the liquid in the inside of the sensor chamber. The output signal of the detection unit is changed in accordance with the pressure change of the liquid in the inside of the sensor chamber.

Besides, preferably, the sensor chamber is constructed such that its volume is changed in accordance with the pressure change of the liquid in the inside of the sensor chamber. The output signal of the detection unit is changed in accordance with the volume change of the sensor chamber.

Besides, preferably, the liquid consuming apparatus is an ink-jet recording apparatus, and the liquid container is an ink cartridge removably mounted in the ink-jet recording apparatus.

The present disclosure relates to the subject matter contained in Japanese patent application Nos.:

2003-085097 (filed on Mar. 26, 2003);
2003-154991 (filed on May 30, 2003);
2003-160836 (filed on Jun. 5, 2003);
2003-160815 (filed on Jun. 5, 2003);
2003-160685 (filed on Jun. 5, 2003);
2003-198631 (filed on Jul. 17, 2003);
2003-198638 (filed on Jul. 17, 2003);
2003-296687 (filed on Aug. 20, 2003); and
2003-190527 (filed on Jul. 2, 2003), each of which is expressly incorporated herein by reference in its entirety.

BRIEF DESCRIPTION OF THE DRAWINGS

FIGS. 18A to 18D are views showing the outer appearance of an ink cartridge as a second embodiment of a liquid container according to the invention, in which FIG. 18A is a plan view, FIG. 18B is a side view, FIG. 18C is a front view and FIG. 18D is a back view.

FIG. 21 is an exploded perspective view of the ink cartridge shown in FIG. 18 and is a view in which FIG. 20 is turned upside down.

FIG. 27 is a perspective view showing the tank unit of the ink cartridge shown in FIG. 18 and a view in which FIG. 26 is turned upside down.

FIG. 31A to 31C are Sectional views schematically showing the ink cartridge for explaining the detection operation of a detection unit of the ink cartridge shown in FIG. 18, in which FIG. 31A shows a state where an ink reservoir chamber is sufficiently filled with ink and compressed air is not introduced into an ink pressurizing chamber, FIG. 31B shows a state where the compressed air is introduced into the ink pressurizing chamber of the ink cartridge in which the ink reservoir chamber is sufficiently filled with ink, and FIG. 31C shows a state where ink hardly exists in the ink reservoir chamber.

FIG. 34 is a view showing the transition of an output signal of a detection unit according to the existence of ink and the operation/stop of a pressurizing pump in the ink cartridge shown in FIG. 18.

FIG. 36A to 36C are sectional views schematically showing an ink cartridge according to a modified example of the embodiment shown in FIG. 18 or the like, in which FIG. 36A shows a state where an ink reservoir chamber is sufficiently filled with ink and compressed air is not introduced into an ink pressurizing chamber, FIG. 36B shows a state where the compressed air is introduced into the ink pressurizing chamber of the ink cartridge in which the ink reservoir chamber is sufficiently filled with ink, and FIG. 36C shows a state where ink hardly exists in the ink reservoir chamber.

FIG. 40 is an exploded perspective view of the ink cartridge according to the third embodiment, and a view in which FIG. 39 is turned upside down.

FIG. 43 is a perspective view showing the tank unit of the ink cartridge according to the third embodiment and a view in which FIG. 42 is turned upside down.

DESCRIPTION OF THE PREFERRED EMBODIMENT

Figure 1:
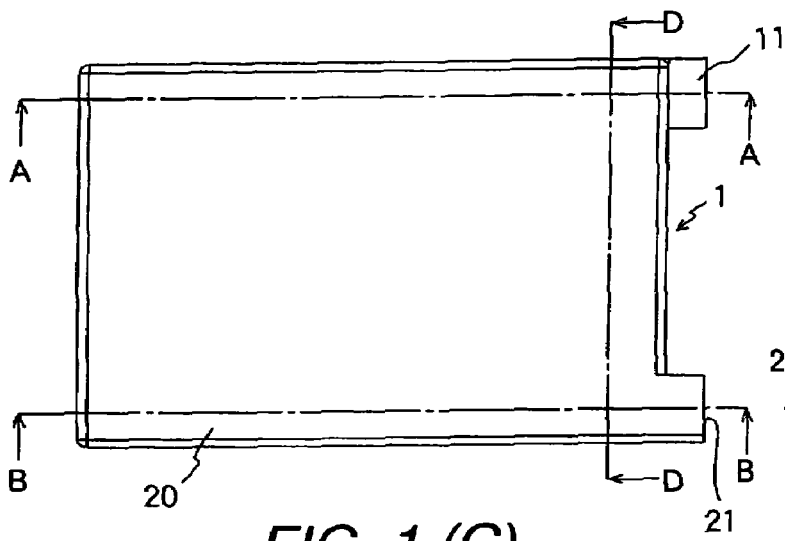
FIGS. 1A to 1C are a top view (1A), a front view (1B), and a side view (1C) illustrating the outlines of a liquid container for a liquid consuming apparatus according to the invention.
Figure 1:
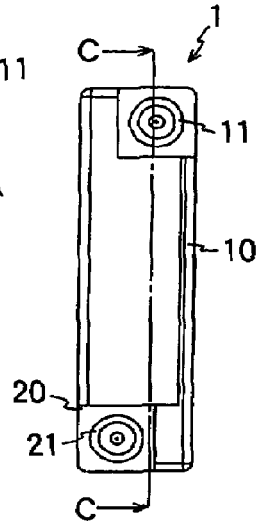
Figure 1:
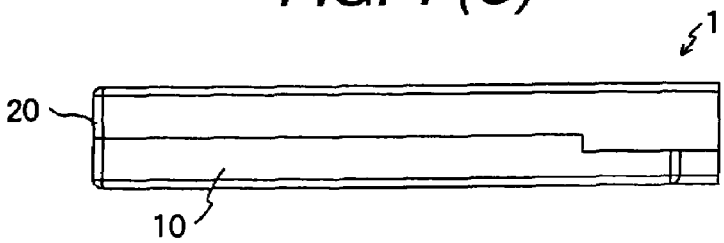

Hereafter, the detail of the invention will be described based on embodiments shown in the drawings.

First Embodiment

FIGS. 1A to 1C are schematic diagrams illustrating, as one embodiment of a liquid container of the invention, an ink cartridge for containing ink to be fed to a recording apparatus as a liquid consuming apparatus. In the embodiment, closed-bottom boxes (case members) 10 and 20 are combined to form a hard case constructing a cartridge 1 as a liquid container. The boxes 10 and 20 are half shells of the hard case, which are in almost symmetry to each other.

In the surface on the tip end side in the mounting direction (FIG. 1B), there are formed an ink delivery port 11 and an air introduction port 21. The ink delivery port 21 serving as a liquid delivery port, is connectable to an ink supplying needle communicating with a recording head of a liquid consuming apparatus, which is the recording device in the embodiment. An air introduction port 21 serving as a pressurized fluid introduction port is connectable to an air supplying needle communicating with a pressurized fluid source.

Figure 2:
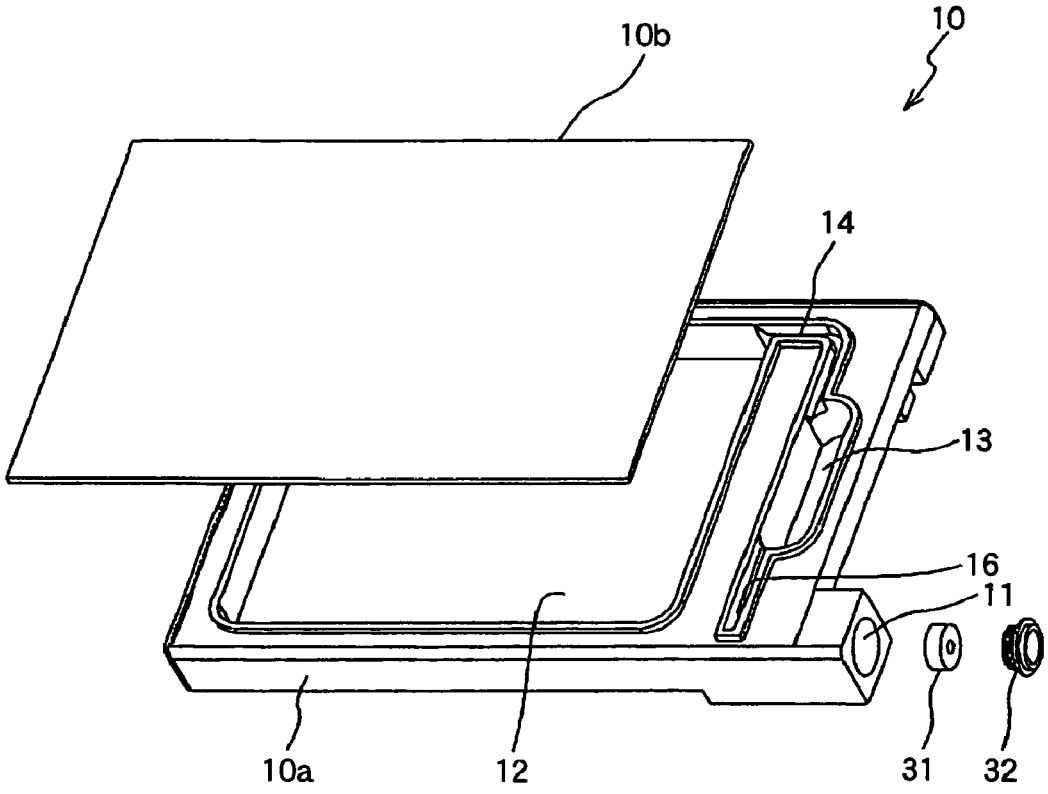
FIG. 2 is a perspective view illustrating the structure of one of two closed-bottom boxes configuring the liquid container seen from the front surface side.
Figure 3:
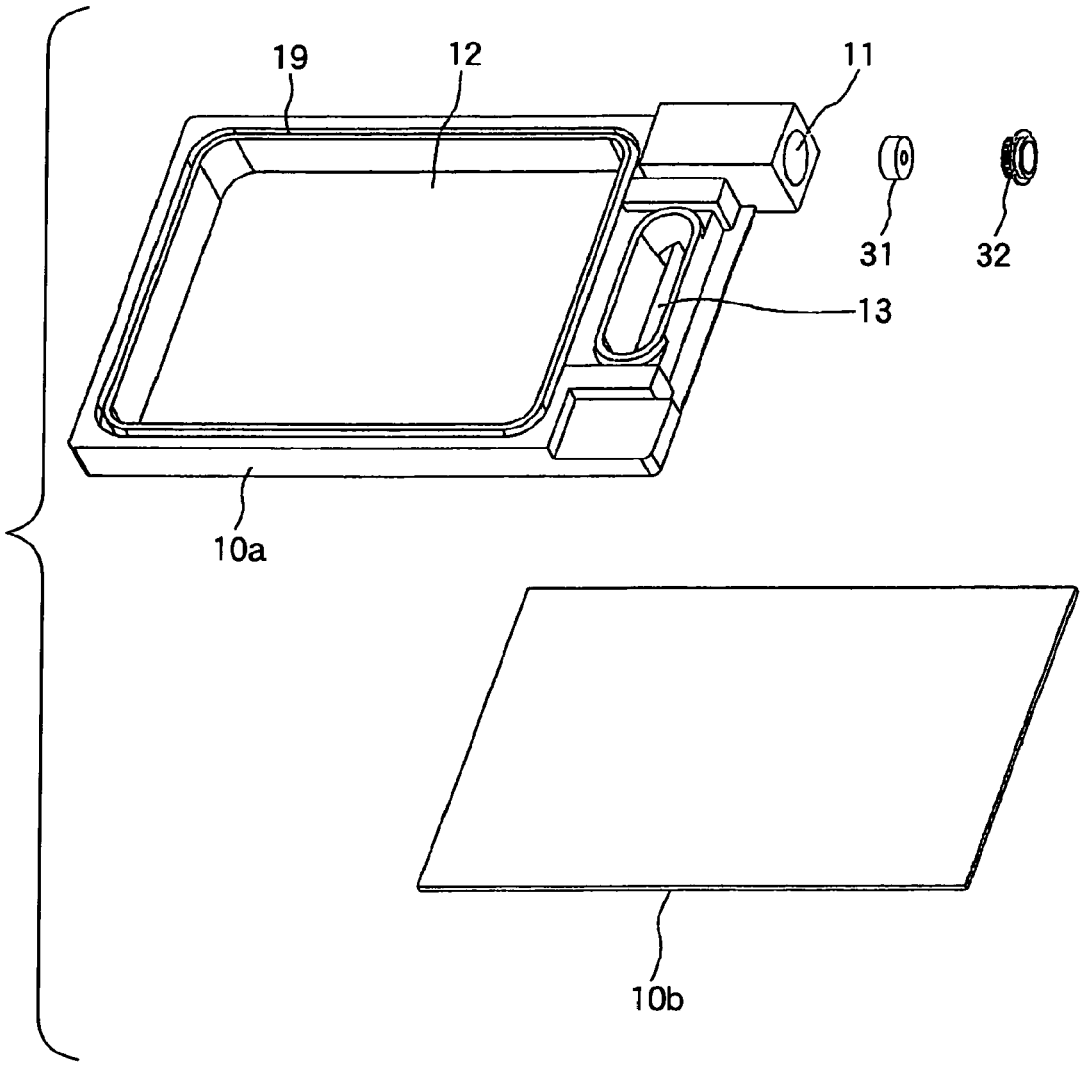
FIG. 3 is a perspective view illustrating the structure of one of the two closed-bottom boxes configuring the liquid container seen from the mating surface side.

FIGS. 2 and 3 illustrate an example of the closed-bottom box 10, which is formed as a two piece structure of a frame 10*a* and a lid 10*b*. The closed-bottom box 10 has a recessed part 12 to be an ink containing chamber 12' serving as the liquid containing chamber (first reservoir chamber), a recessed part 13 to be a buffer chamber 13' (second reservoir chamber), a groove 14 forming a first ink channel 14' fox connecting the ink containing chamber 12' to the buffer chamber 13', and a groove 16 forming a second ink channel 16' for connecting the buffer chamber 13' to a valve housing chamber 15.

The recessed parts 12 and 13 are formed such that through holes formed in the frame 10*a* are sealed with the lid 10*b* from the front surface side of the cartridge. At the same time, the grooves 14 and 16 are sealed with the lid 10*b* to form the first ink channel 14' and the second ink channel 16'.

Figure 6:
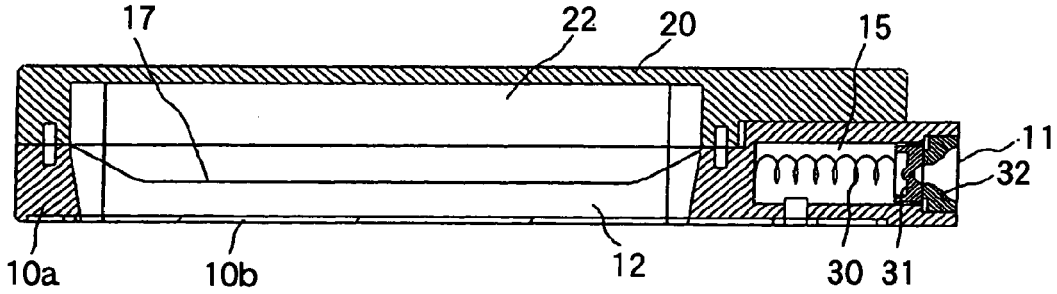
FIGS. 6A and 6B are cross-sectional views illustrating the cross-sectional structure in lines A-A and B-B shown in FIG. 1A.
Figure 6:
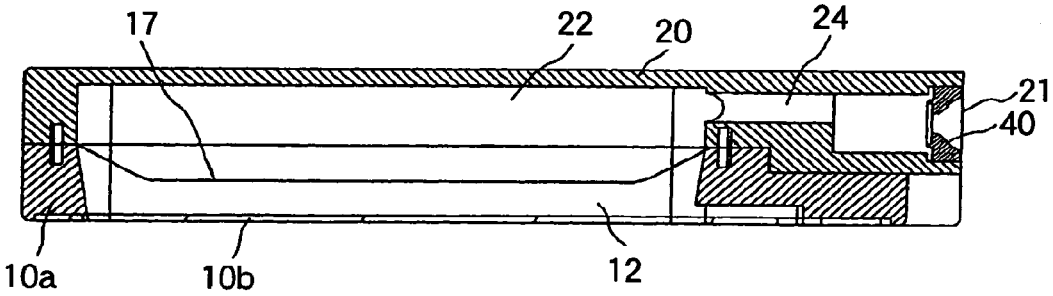
Figure 7:
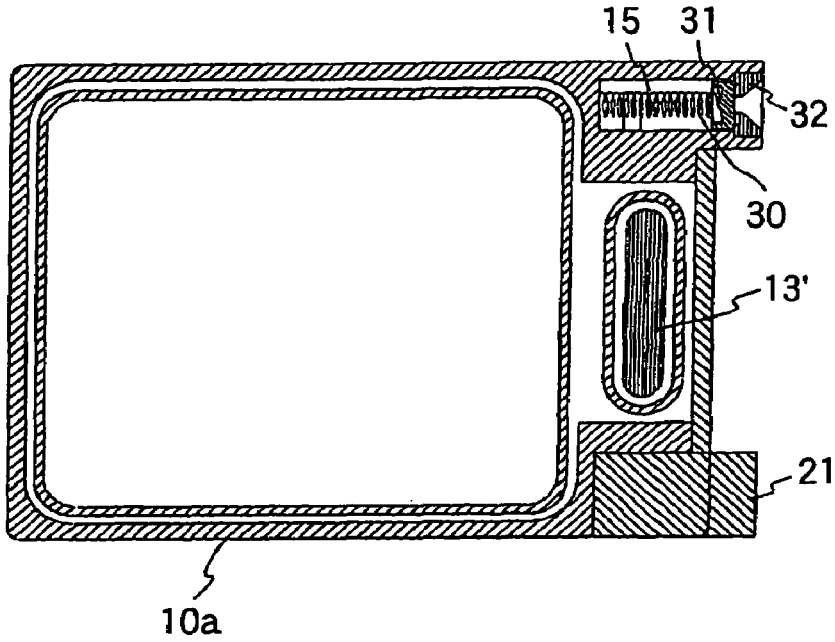
FIG. 7 is a cross-sectional view illustrating the cross-sectional structure in line C-C shown in FIG. 1B.

In addition, as shown in FIG. 6A, a valve 31 energized by an energizing unit such as a coil spring 30 is housed in the valve housing chamber 15 of the ink delivery port 11. The ink supplying needle communicating with the recording head is inserted into the ink delivery port 11 to retract the valve 31 for opening the channel. Furthermore, 32 denotes a ring-shaped packing for elastically engaging the outer periphery of the ink supplying needle.

The opening side of the recessed part 12 is sealed with a film 17 deformable by air to define a space, i.e. the ink containing chamber 12' for containing ink therein. The opening side of the recessed part 13 is similarly sealed with a film to define a space, i.e. the buffer chamber 13', the volume of which can be varied by ink pressure. Moreover, the film 17 is attached to an annular projection 19 of the closed-bottom box 10, which projection is disposed in the outer periphery than the deformable area of the film 17. Besides, the films 17 and 18 to be attached to the closed-bottom box 10 may be a single film as long as the required contraction for the films 17 and 18 can be secured.

Figure 4:
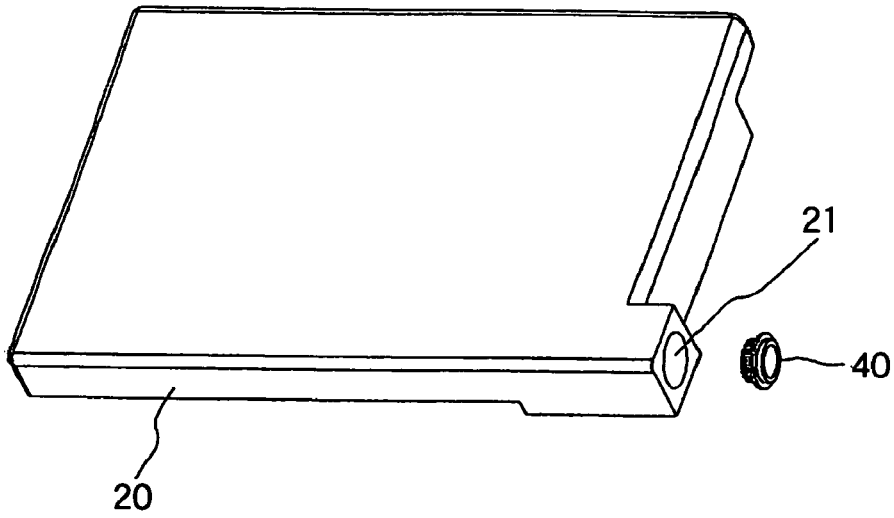
FIG. 4 is a perspective view illustrating the structure of the other of the two closed-bottom boxes configuring the liquid container seen from the front surface side.
Figure 5:
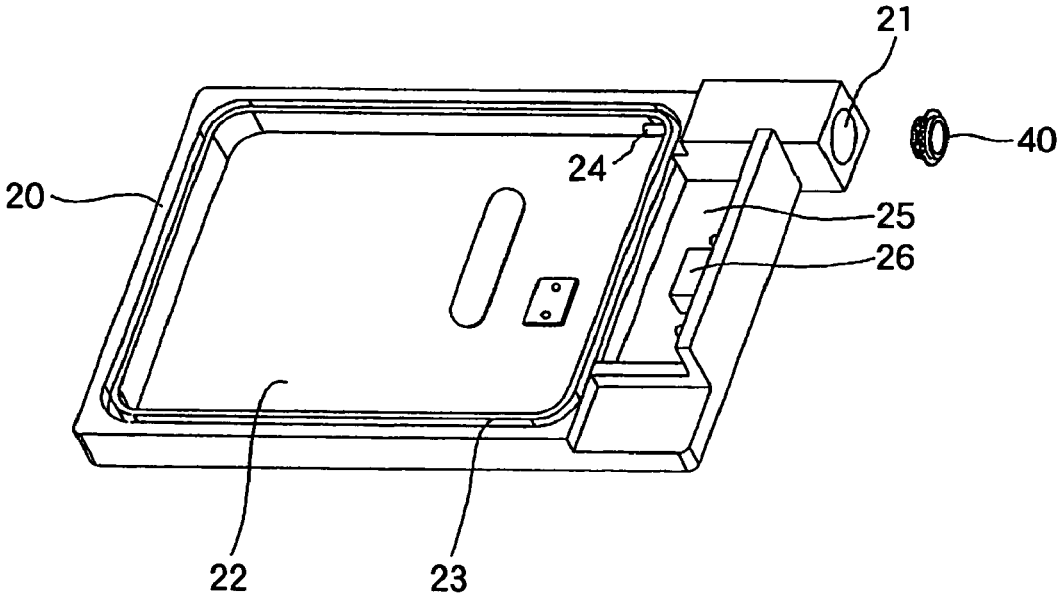
FIG. 5 is a perspective view illustrating the structure of the other of two closed-bottom boxes configuring the liquid container seen from the mating surface side.

As shown in FIGS. 4, 5 and 6B, a recessed part 22 of the case 20 communicates with the air introduction port 21 via a channel 24. In addition, in the area facing to the buffer chamber, a recessed part 25 is formed to dispose a detecting mechanism 26 for detecting the volume variation in the buffer chamber. Two terminals are formed in the detecting mechanism 26, in which the terminals are configured to short-circuit at the communicating part of a plate 28 and a contact is turned on or off to output a detection signal in cooperation with the plate 28 at the point in time when the buffer chamber 13' is expanded to the set volume.

Furthermore, as means for detecting the volume variation in the buffer chamber 13', various means can be adopted as long as it can detect whether the top part of the buffer chamber 13' reaches a predetermined position. Accordingly, for example, a microswitch, a magnet switch and a proximity photoswitch can be adopted as detecting means.

Figure 8:
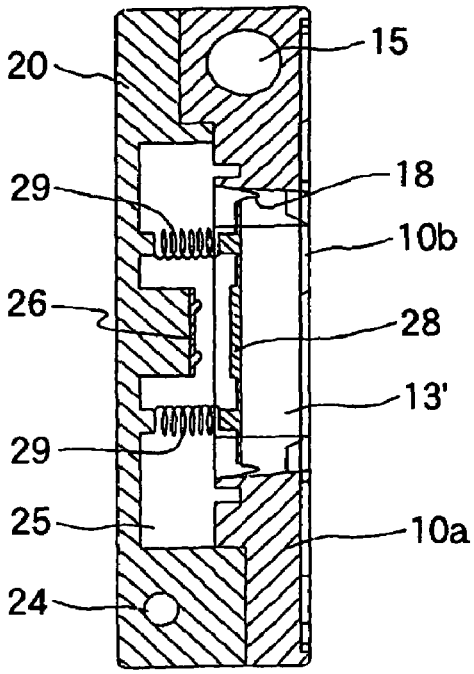
FIG. 8 is a cross-sectional view illustrating the cross-sectional structure in line D-D shown in FIG. 1A.

FIG. 8 illustrates an example of the buffer chamber 13', in which the opening side of the recessed part configuring the buffer chamber 13' is sealed with the film 18 and the outer surface of the film 18 is constantly energized by springs 29 through the plate 28 in the direction of reducing the volume. The energizing force is selected to have a slightly smaller value than a pressure applied by the pressurized fluid. More specifically, the energizing force is set such a valve that the buffer chamber 13' expands to the limit as long as ink can be fed from the ink containing chamber 12' to the buffer chamber 13', and contracts when the ink in the ink containing chamber 12' is consumed.

The buffer chamber 13' is designed to have a volume to allow printing for a period of time required to prepare a next ink cartridge after the detecting mechanism 26 detects ink near end, more specifically, after the ink in the ink containing chamber 12' has been consumed. The volume of the buffer chamber 13' is, for example, the amount allowing a few sheets to be printed, that is, a volume in which ink of about 1 to 2 cc can be contained.

Figure 9:
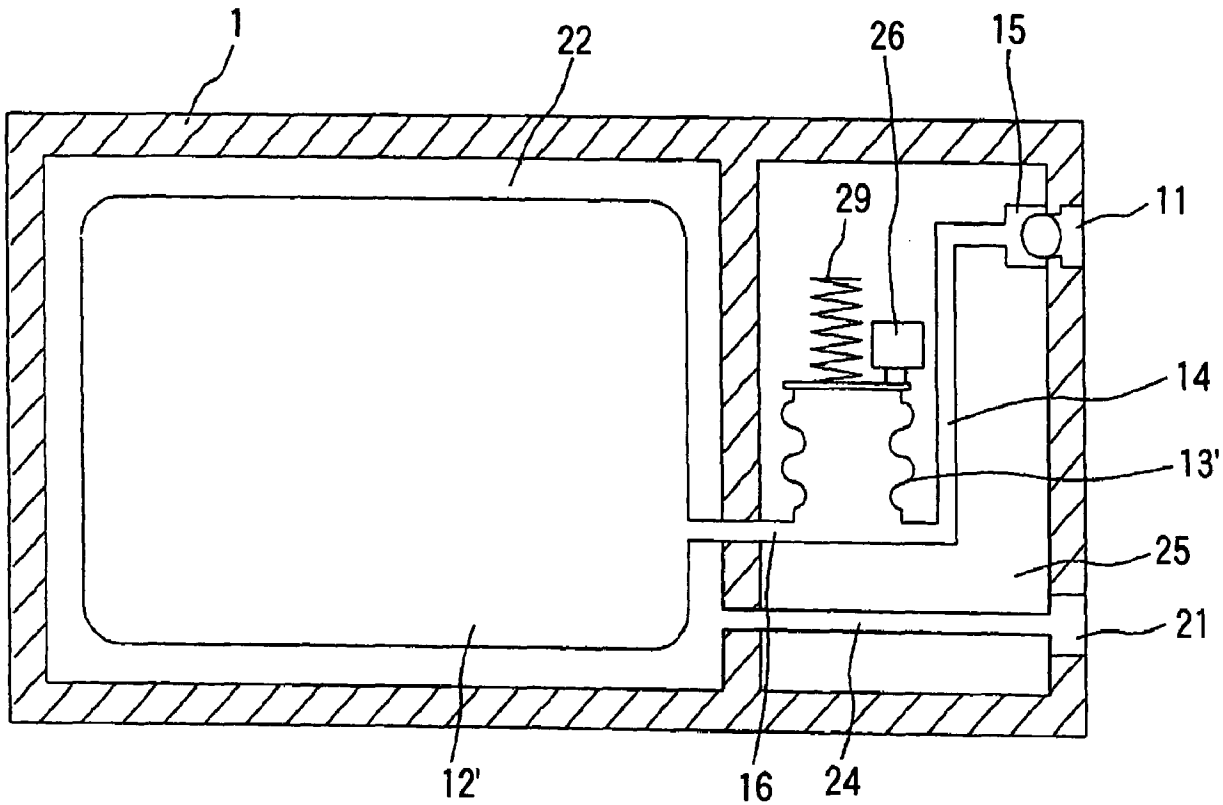
FIG. 9 is a diagram schematically illustrating the channel configuration of the liquid container.
Figure 10:
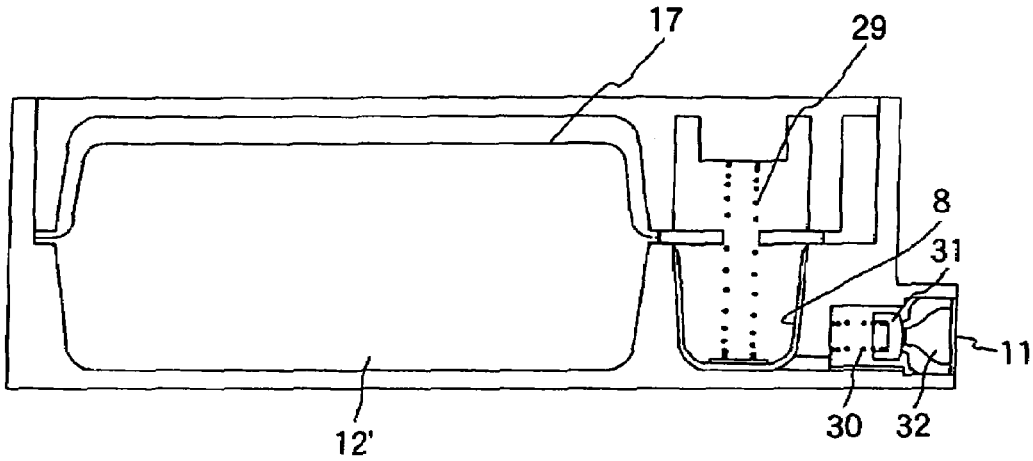
FIGS. 10A and 10B are diagrams schematically illustrating the stats before the liquid container is mounted in a recording device to be one kind of liquid consuming device (10A) and after it is mounted and pressure is applied to ink (10B).
Figure 10:
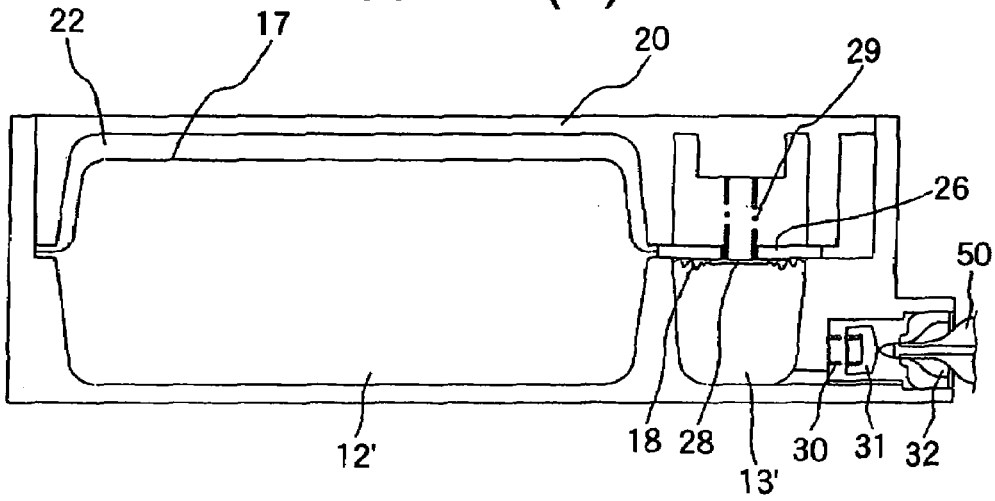
Figure 11:
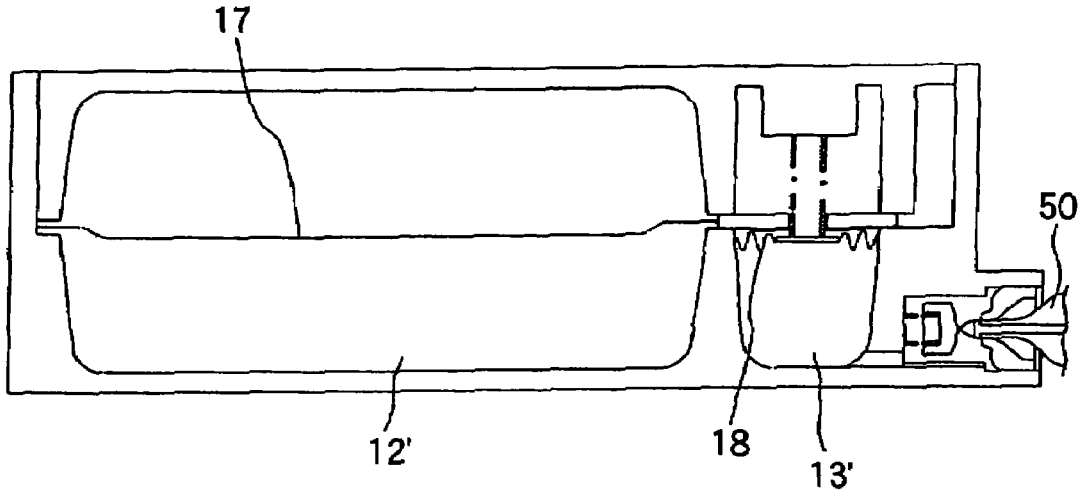
FIGS. 11A and 11B are diagrams schematically illustrating the states that ink in the ink containing chamber is consumed to some extent (11A) and that pressure application is stopped (11B).
Figure 11:
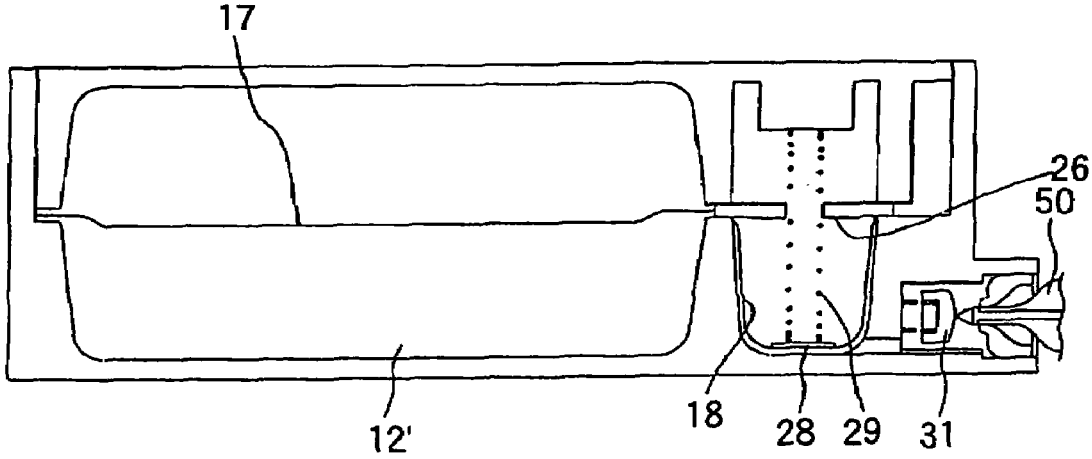
Figure 12:
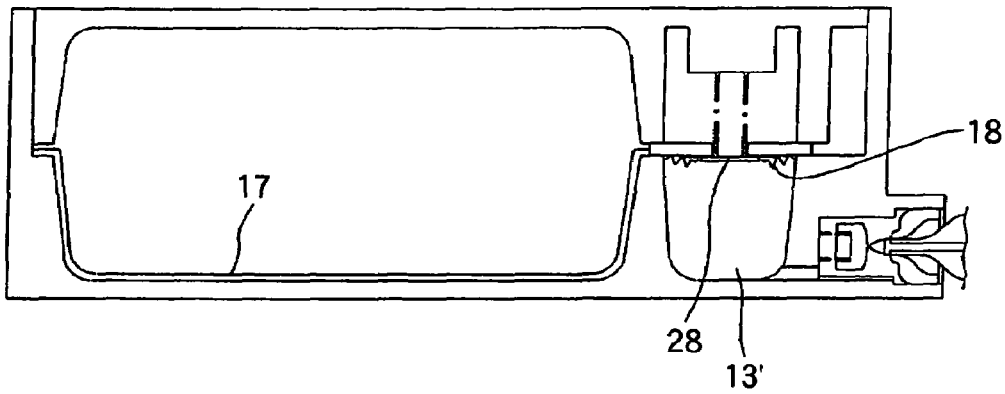
FIGS. 12A and 12B are diagrams schematically illustrating the states that ink in the ink containing chamber is consumed (12A) and that ink in the buffer chamber is reduced (12B).
Figure 12:
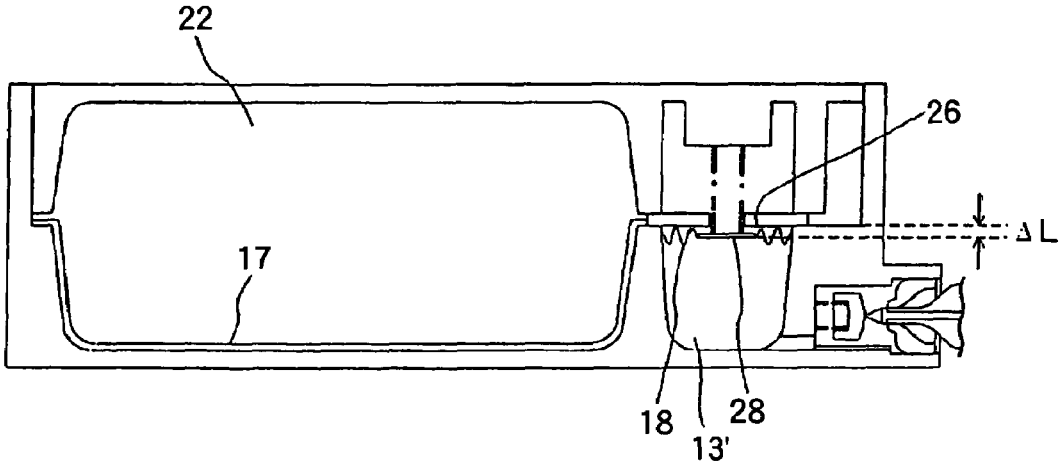

Next, the operation of the ink cartridge thus configured will be described below based on FIG. 9 in which the illustration of the channel configuration is simplified and FIGS. 10A to 12B illustrating the volume variations in the ink containing chamber 12' and the buffer chamber 13' in the various states.

In the embodiment, as shown in FIG. 10A, the ink delivery port 11 is sealed with the valve 31 to prevent ink from leaking outside in the unused state.

In the meantime, the ink cartridge is mounted on the recording apparatus serving as the liquid consuming apparatus, an ink supplying needle 50 engages the ink delivery port 11 as shown in FIG. 10B, and the ink supplying needle 50 retracts the valve 31 against the spring 30 to open the channel. Moreover, the air supplying needle communicating with a pressurized fluid supplying source of the recording device, not shown, engages the air introduction port 21.

At the point in time when the ink cartridge 1 is mounted at the set position, air is fed from the pressurized fluid supplying source, so that air is introduced in between the film 17 and the recessed part 22 of the closed-bottom box 20 to apply pressure to the film 17 of the ink containing chamber 12'. Consequently, ink in the ink containing chamber 12' passes through the channel 14 to flow into the buffer chamber 13. Therefore, the film 18 configuring the buffer chamber 13' is expanded against the spring 29 to increase the volume.

Accordingly, the plate 28 is moved upwardly in the drawing to contact with the detecting mechanism 26, which confirms that ink at least enough to fill the volume of the buffer chamber 13' is contained in the cartridge and that the ink cartridge is mounted correctly.

When ink is consumed in the recording operation in this state, the ink in the ink containing chamber 12' is fed to the recording head through the buffer chamber 13'. The ink in the ink containing chamber 12' is reduced by that amount, but the volume of the buffer chamber 13' keeps the set volume (FIG. 11A).

When the power source of the recording device is turned off to stop the air supply in the state that ink remains in the ink containing chamber 12', a pressure applied by the spring 29 of the buffer chamber 13' exceeds the pressure of the ink in the ink containing chamber 12'. Consequently, the ink in the buffer chamber 13' flows in a reverse direction into the ink containing chamber 12' to reduce the volume of the buffer chamber 13' (FIG. 11B).

This reverse-flow allows the ink in the buffer chamber 13' to be mixed with the ink in the ink containing chamber 12' to prevent an increase in viscosity. The ink in the buffer chamber 13' is relatively increased in viscosity because it is in the proximity of the ink delivery port, and the ink in the ink containing chamber 12' has low viscosity.

In addition, in case of ink easy to generate precipitation as pigment ink, it is possible to generate a reverse-flow from the buffer chamber 13' into the ink containing chamber 12' having a low ink flow rate to agitate the precipitated pigments. More specifically, the buffer chamber 13' functions as a pump chamber by activating or stopping the recording device, and thus it also functions as an agitating unit to agitate the ink in the ink containing chamber 12'. Furthermore, the recording device is originally designed not to leak ink from the recording head due to a pressure applied by the pressurized fluid. Therefore, ink will not leak from the recording head by the extent of pressure applied by the spring 29 of the buffer chamber 13'.

In the meantime, when the ink in the ink containing chamber 12' is all consumed in the recording operation and ink remains only in the buffer chamber 13' (FIG. 12A), signals are still outputted from the detecting mechanism 26 in this state. However, ink is further consumed in the recording device, and then ink is fed only from the buffer chamber 13'. Thus, the volume of the buffer chamber 13' is reduced, the plate 28 yields to the spring 29 and retracts by $\Delta L$ to separate from the detecting mechanism (it is moved downwardly in FIG. 12B), and the output of the detection signals is stopped.

Figure 13:
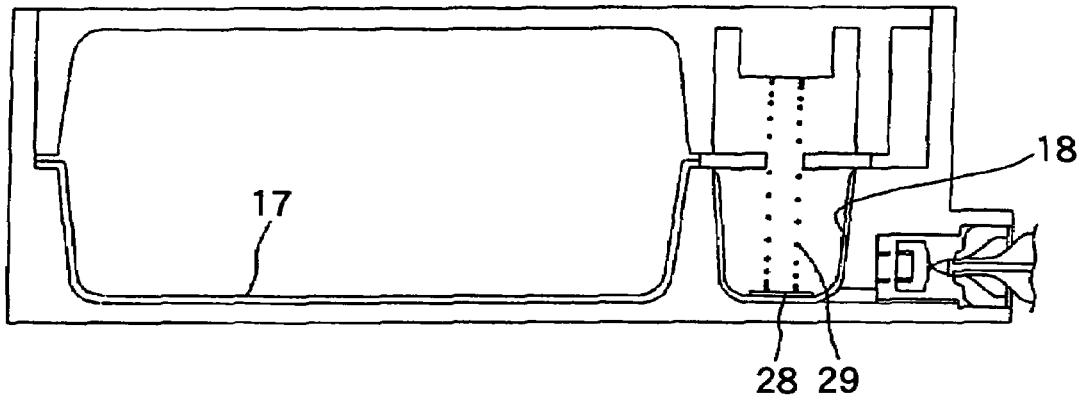
FIG. 13 is a diagram schematically illustrating the state that ink in the liquid container is all consumed.

Consequently, it can be confirmed that ink is reduced to near end. After this, the spring 29 squeezes the ink in the buffer chamber 13' to feed it to the recording head until the last (FIG. 13). In the embodiment, the volume of the buffer chamber 13' is set to the amount to the extent that a few sheets of recording media can be printed. Therefore, printing can be still continued even in this state and the next new ink cartridge can be prepared during this time.

Moreover, when a defect is generated in mounting the ink cartridge on the recording device, the pressure in the ink containing chamber 12' is dropped. Thus, the plate 28 yields to the spring, and retracts and separates from the detecting mechanism 26 to stop the output of the detection signals. Therefore, abnormality can be known.

In addition, in the embodiment, the buffer chamber 13' is constantly energized by the spring in the contracting direction. However, the same advantage is exerted in which the buffer chamber 13' is formed to be a bellows structure and the bellows part is constantly set in the contracting direction.

In the embodiment, the ink containing chamber 12' and the buffer chamber 13' are configured in which the recessed parts 12 and 13 are formed in the hard case and the openings of these recessed parts are sealed with the deformable films 17 and 18. However, the annular projection 23 disposed around the pressurizing area of the closed-bottom box 20 is sealed to the projection 19 sealed with the film 17 with an adhesive also functioning as a sealing agent, for example, which allows the pressurizing area to be formed into an airtight structure.

Figure 14:
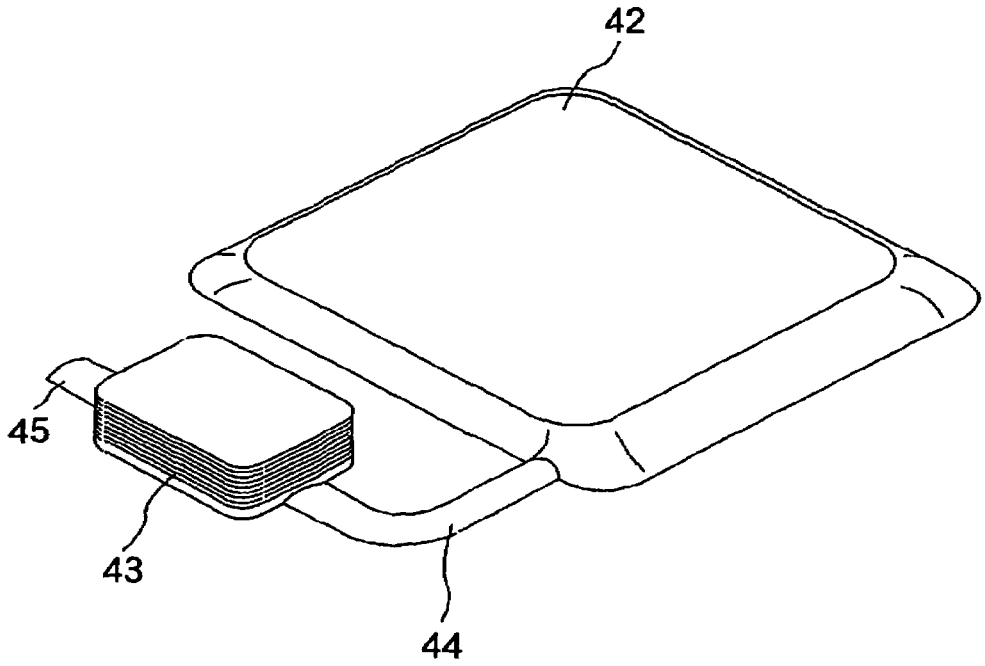
FIG. 14 is a diagram illustrating another example of the ink containing chamber, the buffer chamber and the channel of the liquid container according to the invention.

Furthermore, as shown in FIG. 14, the ink containing chamber 12' and the buffer chamber 13' are formed into a bag 42 and a bellows 43, and are connected by channel forming units 44 and 45 such as tubes, and alternatively, they are formed in one piece. Then, the ink containing chamber 12' and the buffer chamber 13' thus connected or thus formed in one piece are housed in a hard case defining the pressurizing area of a pressurized fluid. This modification can also produce the same advantage.

Figure 15:
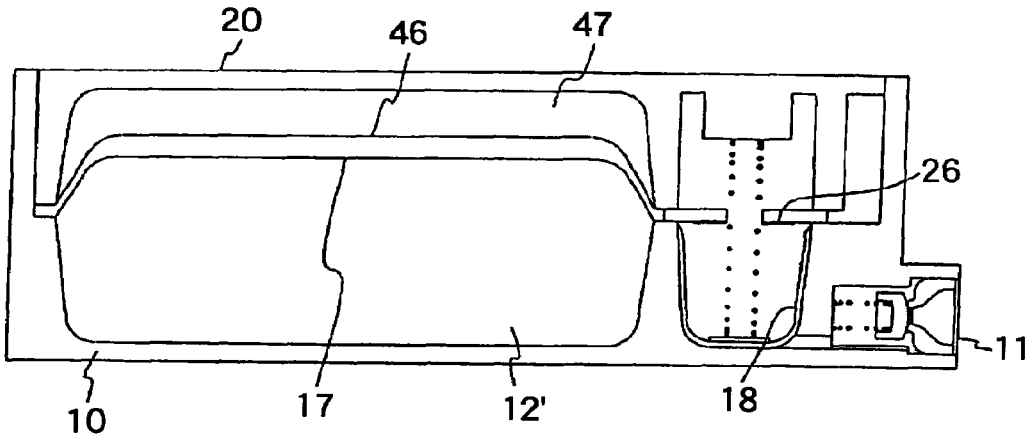
FIG. 15 is a diagram illustrating still another example of the liquid container for the liquid consuming apparatus according to the invention.

Moreover, as shown FIG. 15, a film 46, which is separate from the film 17 in the ink containing chamber of the closed-bottom box 10, may be provided to the closed-bottom box 20 to define a pressurizing chamber 47. The film 46 is preferably formed of an elastic member expandable and contractible so as to press the film 17, and alternatively, the film 46 may be attached to the box 20 with a slack to make the pressurizing chamber 47 expandable and contractible. This modification can also exert the same advantage. Besides, in FIG. 15, the film 46 is depicted to be distanced from the film 17 for clarification.

In this manner, the pressurizing area (pressurizing chamber 47) is defined independently of the ink containing chamber 12' fluidically. This arrangement eliminates an airtight seal in the joining part of the closed-bottom box 10 to the closed-bottom box 20. The cartridge can be completed by simply assembling the closed-bottom box 10 and the closed-bottom box 20, which can simplify the assembly process as compared with the case of vacuum-tight joint.

Figure 16:
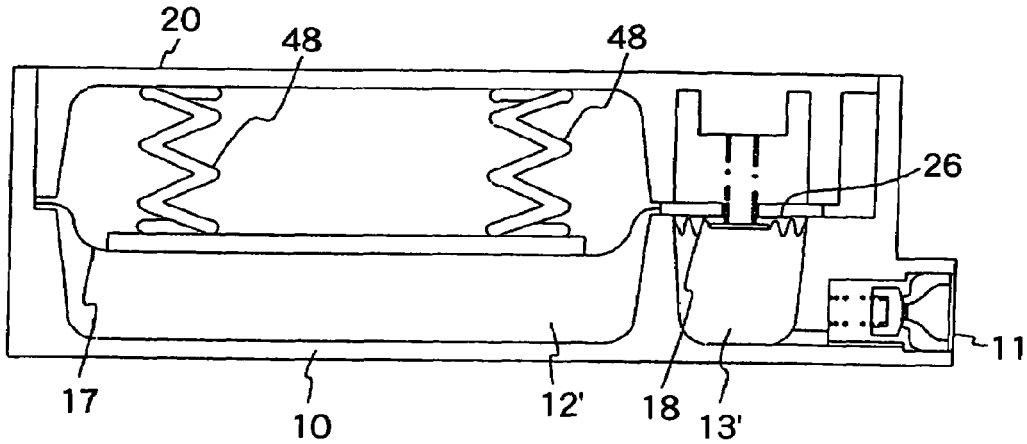
FIG. 16 is a diagram illustrating yet another example of the liquid container for the liquid consuming apparatus according to the invention.

The embodiment discussed above employs the mechanism using the pressurized fluid as means for applying pressure to the ink containing chamber 12'. However, as shown in FIG. 16, a pressurizing unit, such as springs 48, may be housed in the hard case in the area facing to the front surface of the film 17 forming the ink containing chamber 12'. This modification can also exert the same advantage.

The energizing force of the pressurizing unit 48 is set to the extent of expanding the buffer chamber 13' to the maximum in the state that ink remains in the ink containing chamber 12'. The volume of the buffer chamber 13' is contracted at the point in time when the ink in the ink containing chamber 12' is consumed, which allows the detecting mechanism 26 to detect ink near end as similar to the above and allows printing with the ink remaining in the buffer chamber 13'.

In addition, in the modification, the spring is used as the pressurizing units. However, as similar to the embodiment shown in FIG. 15, an area for holding pressure is defined by the film 46 in the area facing to the ink containing chamber and the defined area is sealed after pressurized air is injected into the defined area. Alternatively, the defined area is allowed to communicate with the atmosphere through a check valve in the hard case and to have a pump function by utilizing the elasticity of the hard case.

Figure 17:
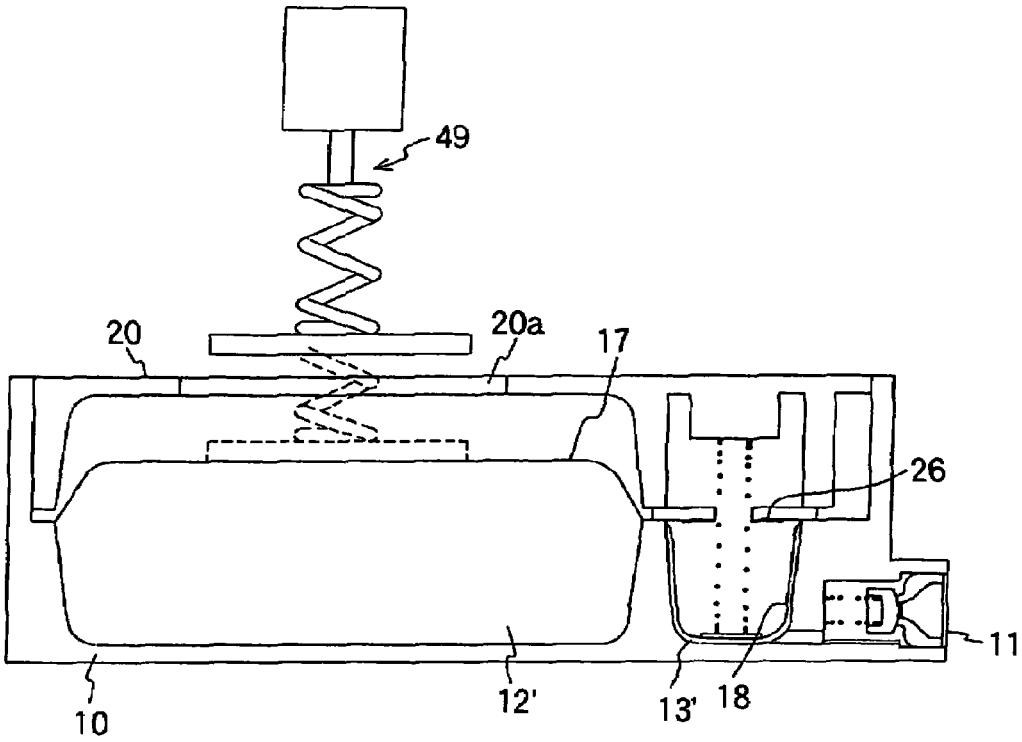
FIG. 17 is a diagram illustrating still yet another example of the liquid container for the liquid consuming apparatus according to the invention.

Furthermore, in the embodiment and modifications thereof, the pressurizing unit is built in the hard case. However, the same advantage is exerted in which the pressurizing unit, for example, a drive source 49 that can control the pressing force, such as a solenoid or a fluid actuator, is disposed in the liquid ejection apparatus main body side and a window 20*a* is formed in the area facing to the film 17 forming the ink containing chamber of the hard case so that the film 17 can be pressed via the window 20*a* by displacement of the drive source 49 as shown in FIG. 17.

According to this modification, the pressing force of the drive source 49 is released at the point in time when the operation of the liquid ejection apparatus main body is stopped. The ink in the buffer chamber 13' can be returned to the ink containing chamber 12', and the agitating effect can be obtained.

Moreover, also in the embodiment, the buffer chamber 13' can be expanded to the maximum in the state that ink remains in the ink containing chamber 12' as similar to the above. The ink in the buffer chamber 13' begins to be consumed and the volume is contracted at the point in time when the ink in the ink containing chamber 12' is all consumed, and therefore the detecting mechanism 26 can detect ink near end. After that, printing can be done with the ink remaining in the buffer chamber 13'.

Without mentioning it, also in the modifications shown in FIGS. 14 to 17, the channel for connecting the ink containing chamber 12' to the buffer chamber 13' and the channel for connecting the buffer chamber 13' to the liquid delivery port 11 can be formed by disposing a groove or a through hole in the hard case configuring the liquid container.

According to such the configuration, when pressure is applied to the ink containing chamber 12' or pressure is eliminated, the liquid flows through the channels formed of the groove or through hole at high speed between the ink containing chamber 12' and the buffer chamber 13. Therefore, the agitating effect is generated.

As discussed above, a detection signal of the amount of remaining liquid can be obtained at the point in time when the liquid in the liquid containing chamber (first reservoir chamber) 12' is all consumed and below the maximum volume of the buffer chamber (second reservoir chamber) 131. Therefore, the detection signal of signaling that the liquid container needs to be changed can be obtained more surely than the amount of ink in the liquid containing chamber is monitored. In addition, even when the signal is detected during a predetermined liquid ejection operation, the liquid remaining in the buffer chamber 13' allows liquid ejection continuously for a predetermined period of time.

Particularly, in the case that ink is used for the liquid, a fixed set of sheets can be printed continuously without interrupting printing when the signal is detected during printing.

Furthermore, when the operation of the liquid consuming device causes pressure to be applied to the liquid containing chamber 12', or the operation of the liquid consuming device is stopped to eliminate pressure in an ink containing chamber 12', the volume of the buffer chamber 13' is greatly varied to function as a pump chamber. Therefore, it has the effect to agitate the liquid, and solids can be prevented from precipitating in the case of a liquid having an increase in viscosity and having solids such as pigments.

The liquid container can be configured by a simple process in which the hard case in a predetermined shape is formed by injection molding and the film is attached thereto.

Only the area where the liquid exists is configured to be an independent product and it is simply mounted on the hard case to form the liquid container. Therefore, the number of recyclable components is increased.

The channels connecting the separate areas can be formed in injection molding of the hard case, and the channels are formed of a tube or a groove. Therefore, a reverse-flow into the ink containing chamber 12' or the ink flow rate in flowing into the buffer chamber 13' is increased, and the greater agitating effect can be obtained.

Second Embodiment

Hereinafter, as a second embodiment of a liquid container of the invention, an ink cartridge for an ink-jet recording apparatus will be described with reference to the drawings.

Figure 18:
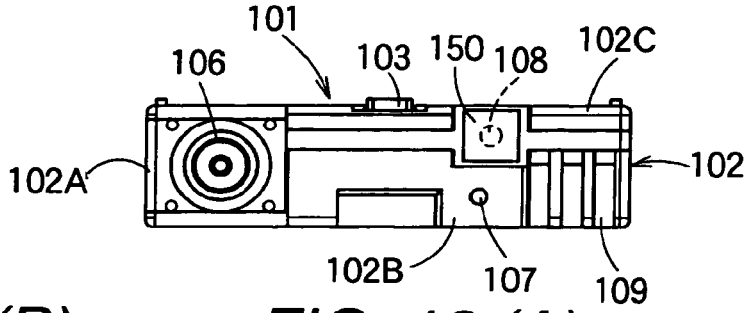
Figure 18:
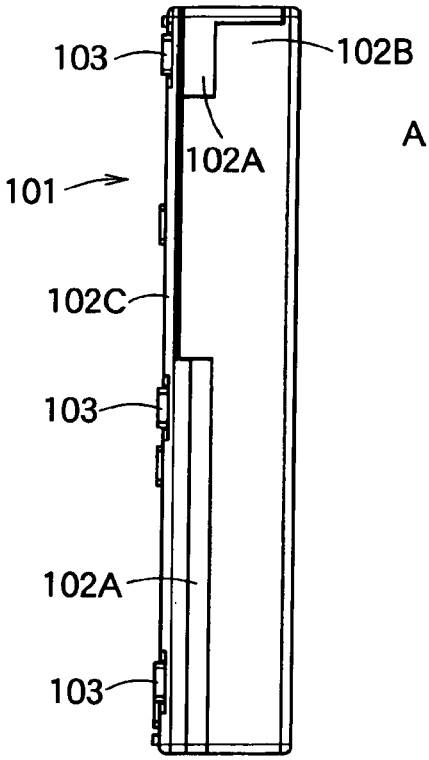
Figure 18:
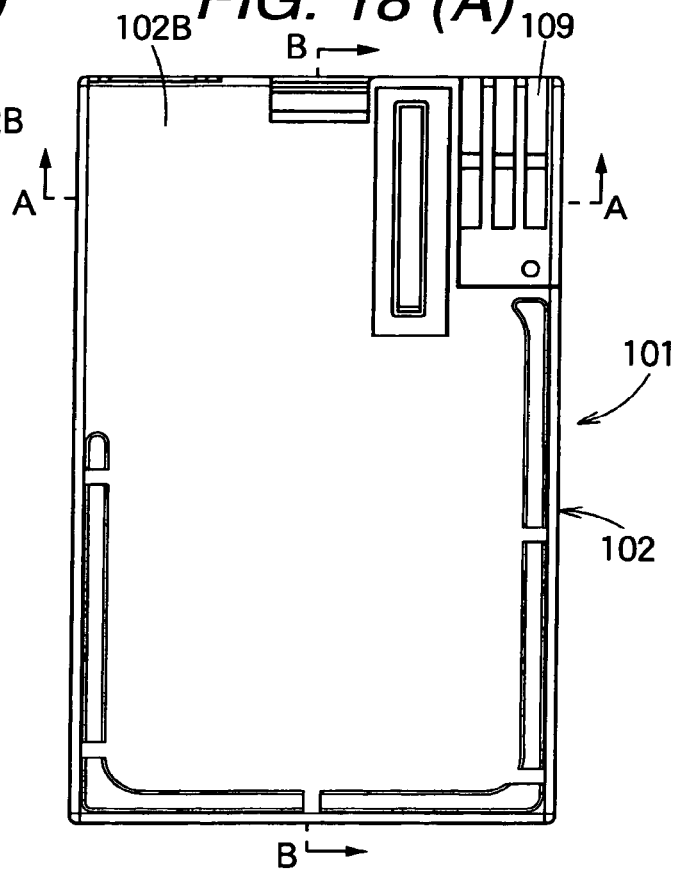
Figure 18:
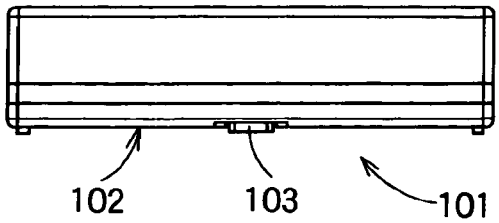
Figure 19:
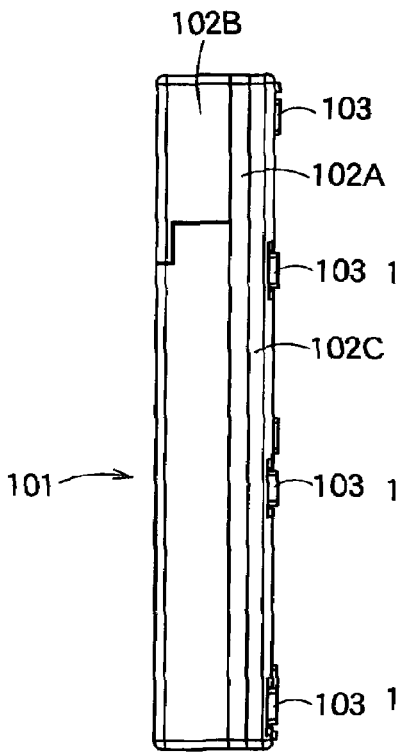
FIG. 19A is a bottom view of the ink cartridge shown in FIG. 18.
FIG. 19B is a side view.
Figure 19:
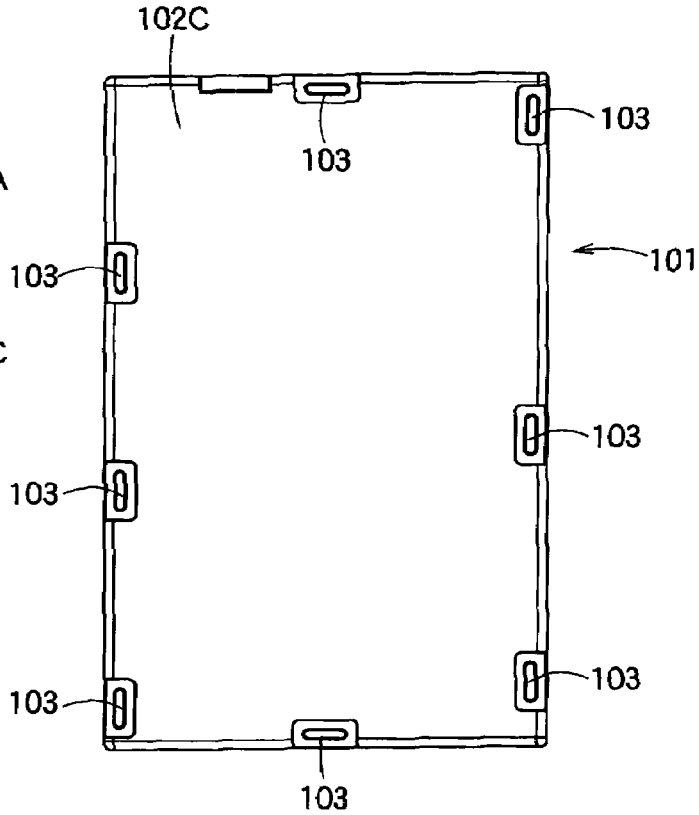
Figure 20:
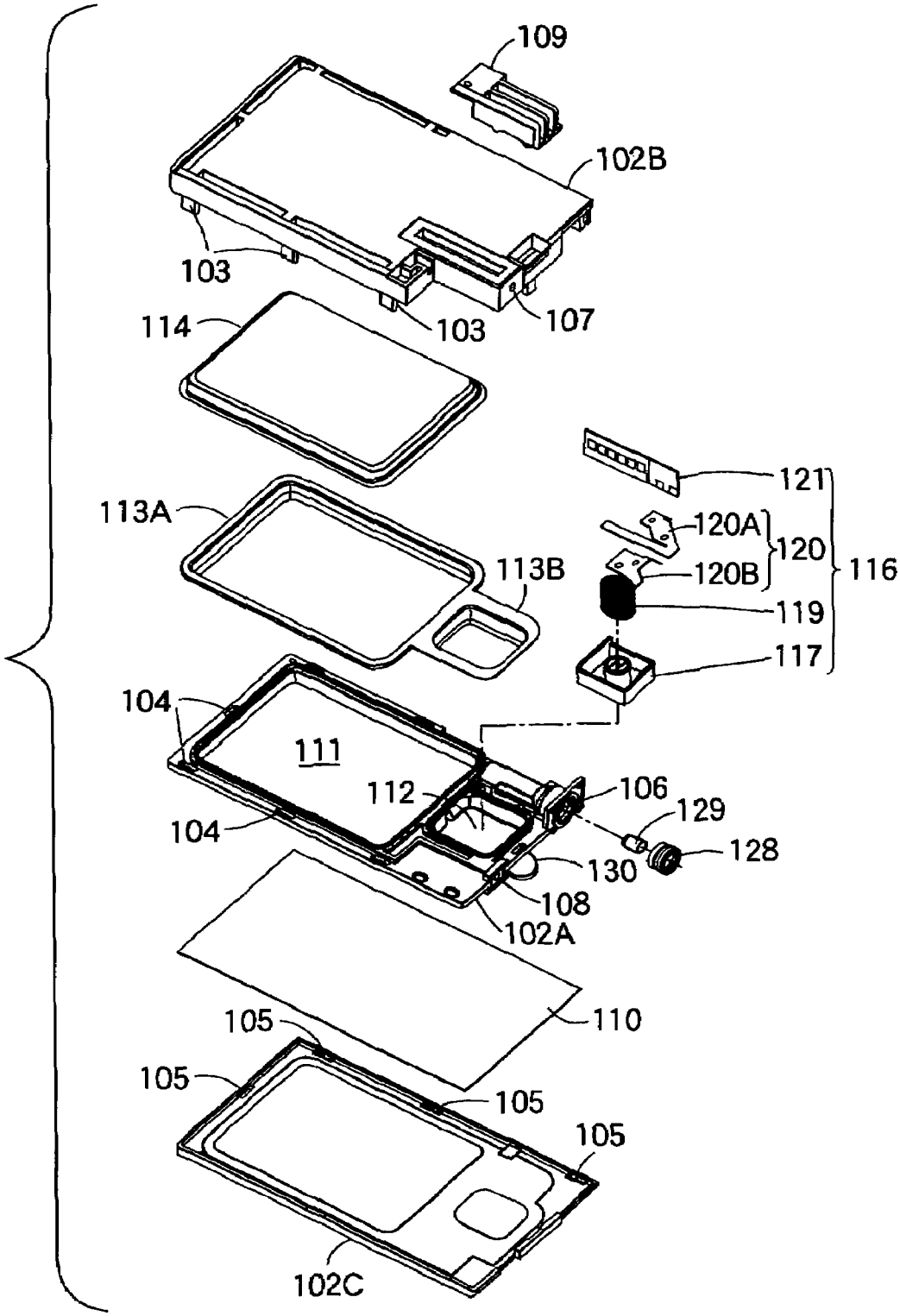
FIG. 20 is an exploded perspective view of the ink cartridge shown in FIG. 18.
Figure 21:
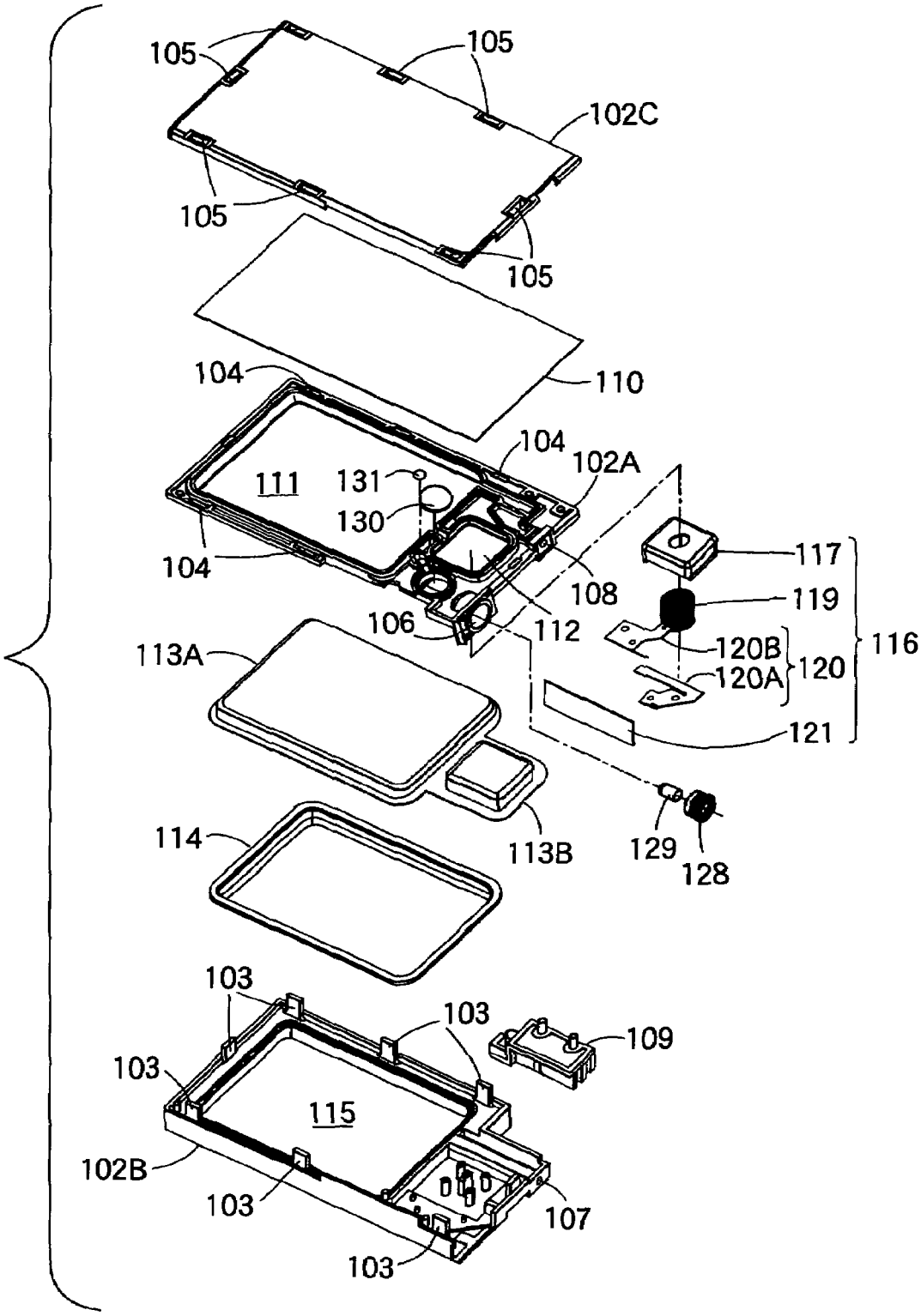
Figure 22:
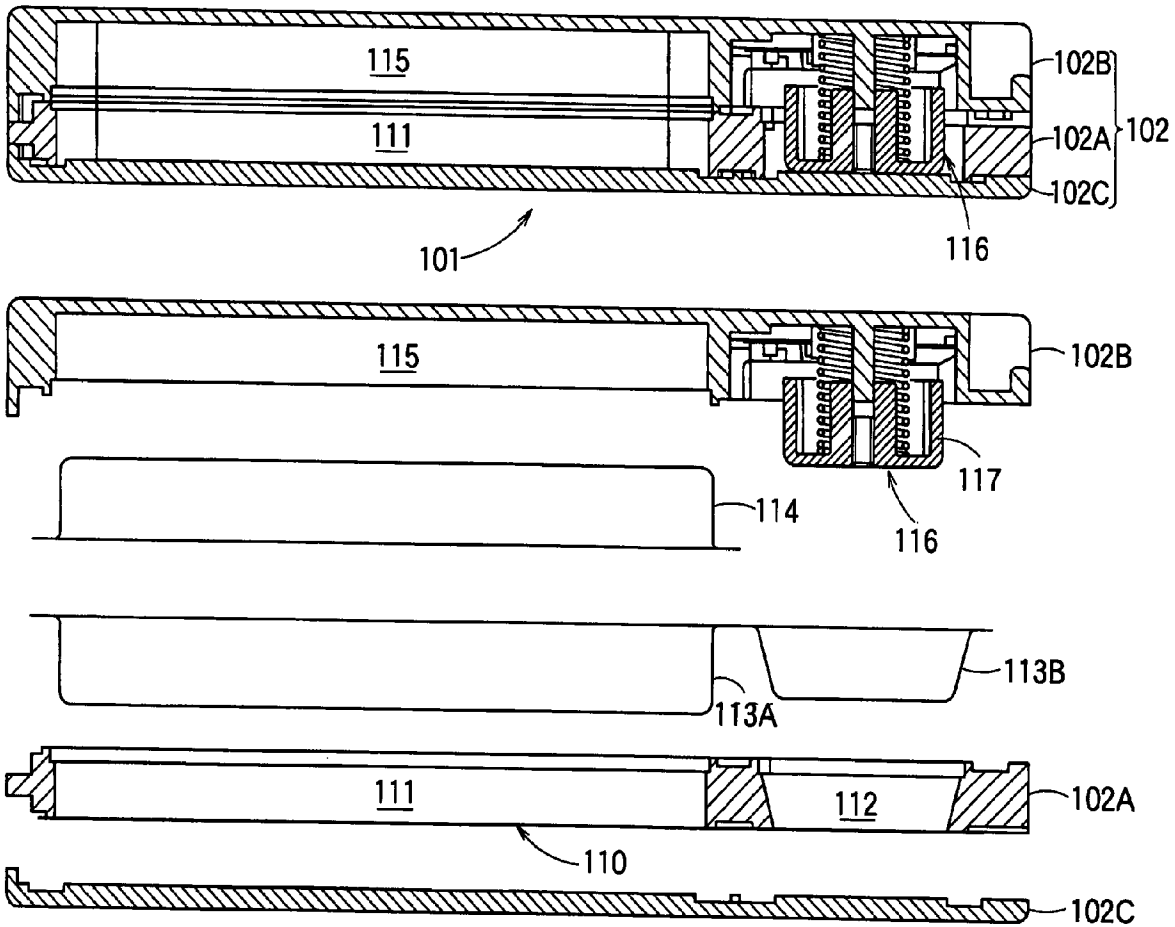
FIG. 22A is a sectional view of the ink cartridge shown in FIG. 18.
FIG. 22B is an exploded view of FIG. 22A.

FIGS. 18 and 19 are views showing the outer appearance of an ink cartridge 101 according to this embodiment, FIGS. 20 and 21 are exploded perspective views of the ink cartridge 101, and FIG. 22 is sectional view of the ink cartridge 101 and its exploded view.

The ink cartridge 101 includes a container body 102, and this container body 102 is constituted by a first case member 102A, a second case member 102B and a third case member 102C. As is understood from FIGS. 20 and 21, plural heat caulking ribs 103 are formed at a peripheral part of the second case member 102B, and these heat caulking ribs 103 are inserted in plural through holes 104 and 105 formed in the first case member 102A and the third case member 102C, and are subjected to heat caulking. By this, the first case member 102A is held between the second case member 102B and the third case member 102C, and these three case members 102A, 102B and 102C are united.

Incidentally, a sealing structure is not provided between the case members 102A, 102B and 102C.

As stated above, the three case members 102A, 102B and 102C are fixed by heat caulking, so that the heat-caulked parts can certainly receive force generated in the direction of separating the case members when compressed air is introduced into the inside of the ink cartridge 101.

As shown in FIG. 18C, the container body 102 is provided with an ink delivery port 106 for delivering ink in the inside of the container body 102 to the outside. As is understood from FIGS. 20 and 21, the ink delivery port 106 is formed in the first case member 102A.

Besides, a compressed air introduction port 107 for introducing the compressed air into the inside of the container body 102 is formed in the same surface as the surface in which the ink delivery port 106 is formed. This compressed air introduction port 107 is formed in the second case member 102B.

Further, an ink injection port 108 for filling ink at the time of manufacture of the ink cartridge 101 is formed in the same surface as the surface in which the ink delivery port 106 is formed. This ink injection port 108 is formed in the first case member 102A. The ink injection port 108 is closed by welding a seal member 150.

Besides, an erroneous mounting prevention block 109 is provided on one corner part of the container body 102 including the same surface as the surface in which the ink delivery port 106, the compressed air introduction port 107, and the ink injection port 108 are formed. This erroneous mounting prevention block 109 is given such a shape that an ink cartridge other than the ink cartridge 101 with a correct kind of ink can not be mounted so that the ink cartridge 101 with a predetermined kind of ink is correctly mounted at a predetermined position when the ink cartridge 101 is mounted in the ink-jet recording apparatus.

As shown in FIGS. 20 and 21, a bottom film 110 is provided between the first case member 102A and the third case member 102C. This bottom film 110 liquid-tightly seals bottom side openings of an ink chamber through hole 111 and a sensor chamber through hole 112 formed in the first case member 102A.

Besides, a flexible ink chamber film 113, a flexible sensor chamber film 113B and a flexible pressurizing chamber film 114 are provided between the first case member 102A and the second case member 102B. The ink chamber film 113A and the sensor chamber film 113B are integrally formed of one film. The ink chamber film 113A and the sensor chamber film 113B liquid-tightly seal upper side openings of the ink chamber through hole 111 and the sensor chamber through hole 112 formed in the first case member 102A. Besides, the pressurizing chamber film 114 airtightly seals an opening of a pressurizing chamber recess 115 formed in the second case member 102B.

Here, the sensor chamber through hole 112 is formed to have a substantially square section. By this, reaction force at the time of deformation of the sensor chamber film 113B becomes small, and it becomes possible to deform the sensor chamber film 113B by a low pressure.

Incidentally, other preferable sectional shapes of the sensor chamber through hole 112 include a circle and polygons other than a square.

A seal rubber 128 is mounted to the ink delivery port 106 formed in the first case member 102A, and a valve body 129 is inserted in the inside of the ink delivery port 106.

A filter 130 and a check valve 131 are provided at midways of a flow path for communicating the sensor chamber recess 112 and the ink delivery port 106.

Figure 26:
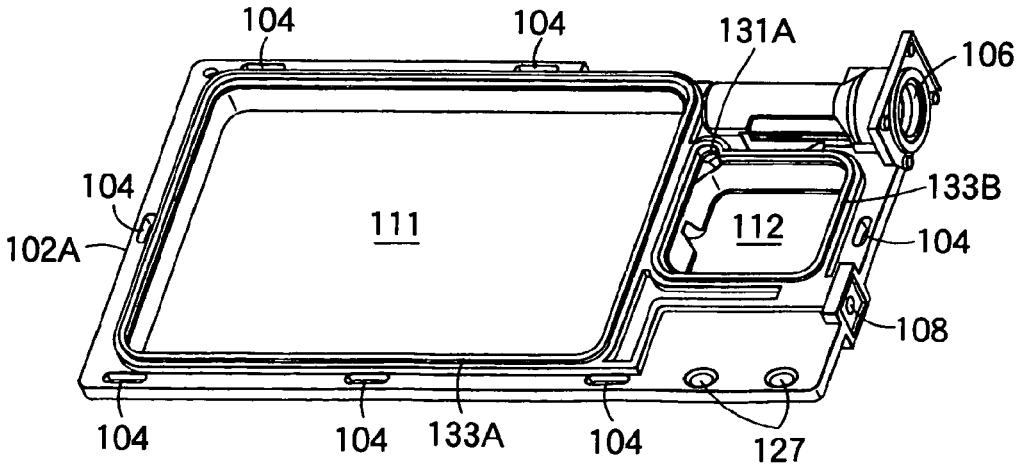
FIG. 26 is a perspective view showing a tank unit of the ink cartridge shown in FIG. 18.
Figure 27:
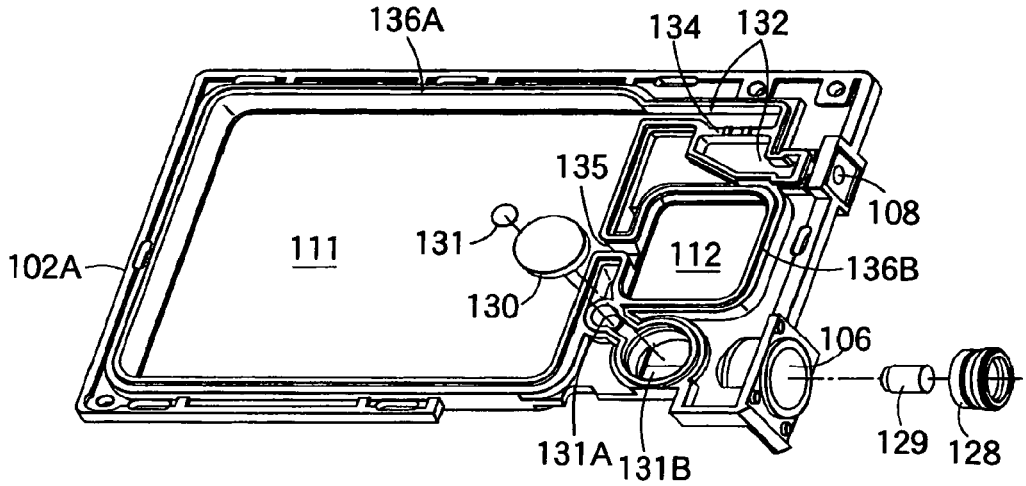

FIGS. 26 and 27 are perspective views showing the first case member 102A under magnification, and as shown in FIG. 26, fixing holes 127 for fixing the erroneous mounting prevention block 109 are bored in the first case member 102A.

Besides, the ink injection port 108 formed in the first case member 102A communicates with the ink chamber through hole 111 through an ink injection flow path 132. Besides, the ink chamber through hole 111 and the sensor chamber recess 112 are communicated with each other through a narrow communicating path 135. Further, the sensor chamber recess 112 communicates with the ink delivery port 106 through a check valve mounting part 131A in which the check valve 131 is disposed and a filter mounting part 131B in which the filter 130 is fitted.

Figure 24:
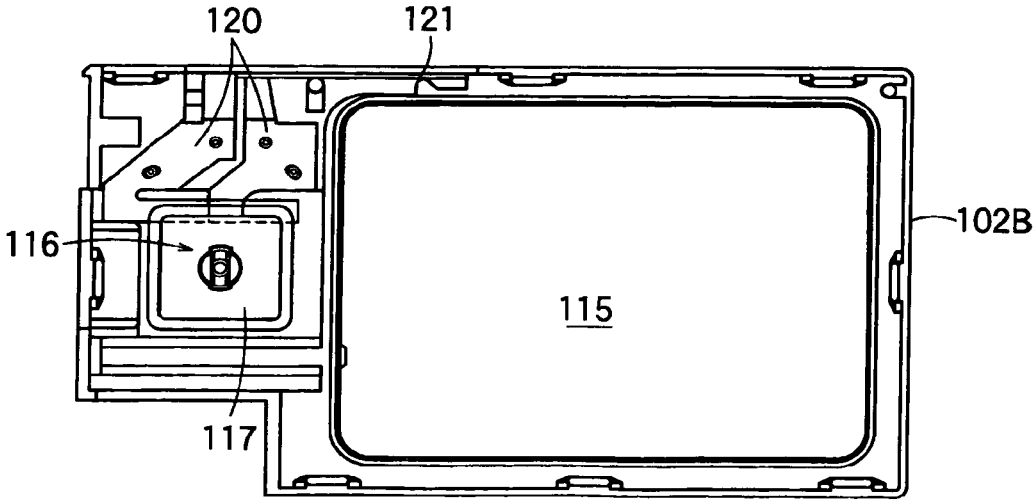
FIG. 24 is a plan view showing the pressurizing unit of the ink cartridge shown in FIG. 18.
Figure 25:
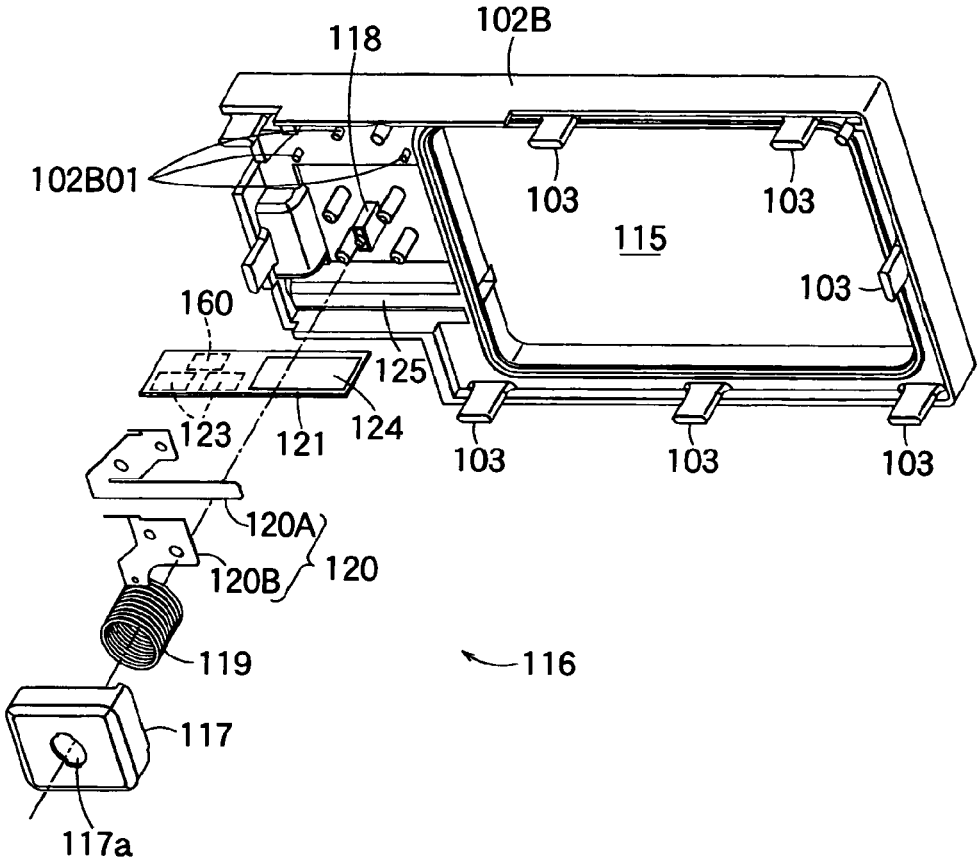
FIG. 25 is an exploded perspective view showing the pressurizing unit of the ink cartridge shown in FIG. 18.

Next, a detection unit 116 disposed in the inside of the ink cartridge 101 will be described with reference to FIGS. 23 to 25.

In the detection unit 116, its output signal is changed in accordance with a change in pressure of ink in the container body 102 changed by whether the pressure of the compressed air is actually applied. Besides, this detection unit 116 digitally detects whether the amount of ink stored in the inside of the ink cartridge 101 is a predetermined value or more.

This detection unit 116 includes a spring seat member 117 having an outer diameter shape capable of being movably inserted in the inside of the sensor chamber through hole 112 formed in the first case member 102A, and this spring seat member 117 is movably mounted to a guide projection formed in the second case member 102B.

As a mounting method, the guide projection 118 formed in the second case member 102B is inserted in a through hole 117*a* of this spring seat member 117, the tip of the guide projection 118 is subjected to heat caulking, and the spring seat member 117 may be made not to come off from the guide projection 118. By this, the spring seat member 117 is movably mounted to the guide projection 118. As stated above, since the spring seat member 117 is mounted to the guide projection 118 by heat caulking, its assembly is easy, and it is unnecessary to provide a molding die with a complicated structure which becomes necessary in the case where, for example, a pawl for hooking is formed. Incidentally, in this case, in order to ensure the movement distance of the spring seat member 117, it is necessary to form the guide projection 118 to be relatively long.

Figure 32:
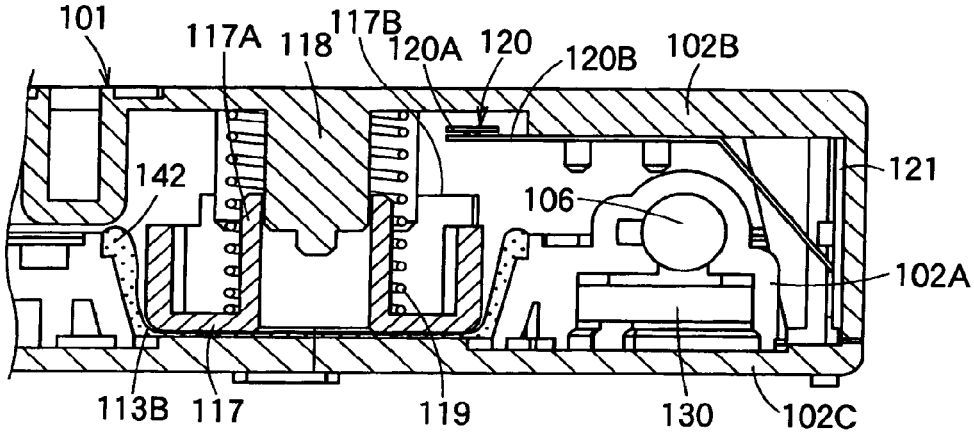
FIGS. 32A, 32B and 32C are views respectively showing the portion of the detection unit of FIGS. 31A, 31B and 31C under magnification.
Figure 32:
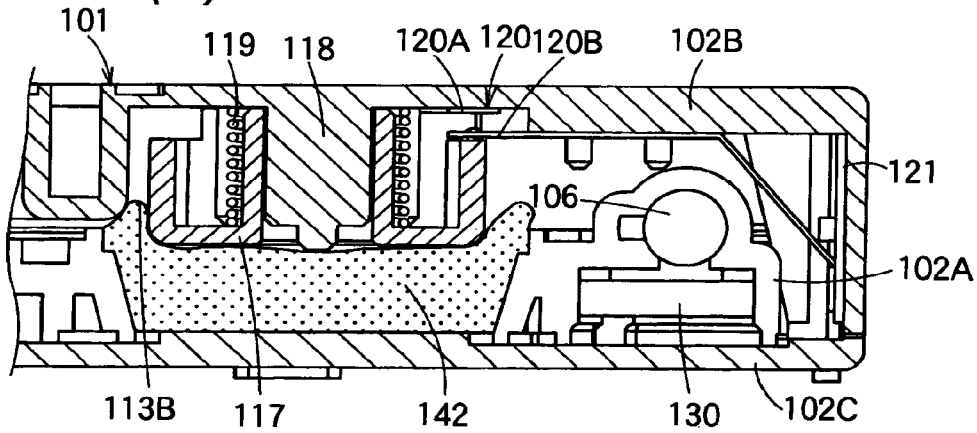
Figure 32:
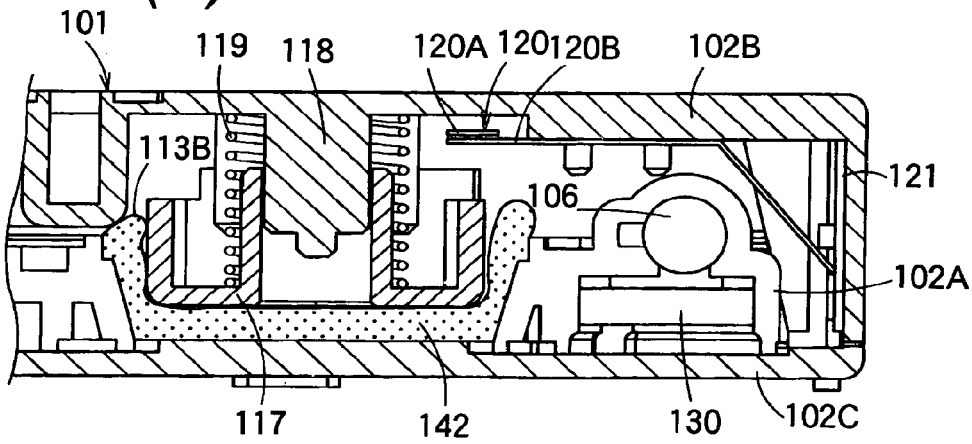

Besides, as another mounting method, for example, as shown in FIG. 32, a guide projection 118 is formed to be relatively short, an inside tube part 117A of the spring seat member 117 is formed to be relatively long, and this inside tube part 117A may be slidably mounted to the guide projection 118. In this case, the tip of the guide projection 18 is not subjected to heat caulking.

A compression spring 119 is provided between the spring seat member 117 and the second case member 102B, and the spring seat member 117 is urged toward the direction of going away from the second case member 102B by the spring force of this compression spring 119.

The spring seat member 117 and the compression spring 119 constitute part of the detection unit 116, and at the same time, constitute a pressurizing unit for pressurizing the ink in the inside of an after-mentioned sensor chamber 142 (FIG. 32). As stated above, the spring seat member 117 is urged by the compression spring 119, so that the pressurizing unit can be constructed by the simple mechanism.

Besides, the detection unit 116 includes a contact type switch 120 which is opened/closed by pressure actually applied to the ink in the container body 102 from the compressed air. This contact type switch 120 includes a movable side terminal 120A displaced by the pressure actually applied to the ink in the container body 102 from the compressed air, and a fixed side terminal 120B disposed to be opposite to the movable side terminal 120A. The movable side terminal 120A and the fixed side terminal 120B are respectively made of conductive elastic members. In this embodiment, the movable side terminal 120A is pressed by a peripheral part 117B of the seat member 117 so that it is moved (FIG. 32).

An IC board (IC module) 121 adjacent to the contract type switch 120 and having a control IC 160 is disposed on an inner wall surface of the second case member 102S, and this IC board 121 is fixed by a fixing rib 122 and by heat caulking. The IC board 121 includes contact terminals 123 with which the movable side terminal 120A and the fixed side terminal 120B come in contact. The movable side terminal 120A and the fixed side terminal 120B are fixed to convex parts 102B01 provided in the second case member 102B by, for example, heat caulking so that the movable side terminal 120A made of a plate spring member and the fixed side terminal 120B are brought into pressure contact with the respective contact terminals 123 by the spring force.

Besides, the IC substrate 121 includes an antenna member 124, and by using this antenna member 124, communication is made in a non-contact manner (wireless) by an electric wave between the ink-jet recording apparatus and the IC board 121, and information and electric power are transmitted Incidentally, the compressed air introduction port 107 formed in the second case member 102B communicates with the pressurizing chamber recess 115 through an air flow path 125.

Figure 23:
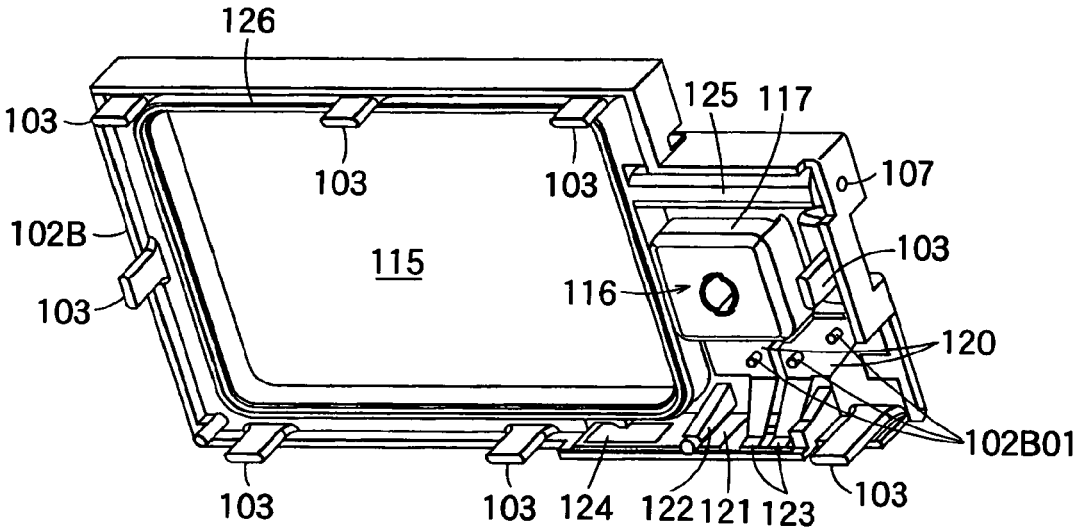
FIG. 23 is a perspective view showing a pressurizing unit of the ink cartridge shown in FIG. 18.

Besides, in FIG. 23, reference numeral 126 denotes a film welding part, and the pressurizing chamber film 114 is air-tightly connected to this film welding part 126.

The pressurizing unit is constituted by the second case member 102B, the detection unit 116, the pressurizing chamber film 114 and the like.

FIGS. 26 and 27 are the perspective views showing the first case member 102A under magnification, and as shown in FIG. 26, the fixing holes 127 for fixing the erroneous mounting prevention block 109 are bored in the first case member 102A. As shown in FIG. 27, the seal rubber 128 is mounted to the ink delivery port 106, and the valve body 129 is inserted in the inside of the ink delivery port 106.

Besides, the filter 130 and the check valve 131 are provided at the midway of the passage for connecting the ink delivery port 106 and the sensor chamber through hole 112. Besides, the ink injection port 108 formed in the first case member 102A communicates with the ink chamber through hole 111 through the ink injection passage 132. Besides, the ink chamber through hole 111 and the sensor chamber through hole 112 are communicated with each other through the narrow communicating path 135.

Incidentally, in FIG. 26, reference numerals 133A and 133B denote film welding parts, and the ink chamber film 113A and the sensor chamber film 113B are liquid-tightly connected to the film welding part 133A and the film welding part 133B, respectively.

Besides, in FIG. 27, reference numerals 136A and 136B denote film welding parts, and the bottom film 110 is liquid-tightly connected to the film welding parts 136A and 136B.

Besides, in FIG. 27, reference numeral 134 denotes a seal part, and in this seal part 134, after ink is filled into the container body 102, the ink injection path 132 is sealed. For example, the seal part 134 is used as described below. The check valve 131 and the filter member 130 are mounted to the first case member 102A, and the bottom film 110 is welded to the welding part (the film welding parts 136A and 136B, the welding part of the periphery of the check valve mounting part 131A and the filter mounting part 131B, the welding part of the periphery of the ink injection flow path 132) of the first case member 102A. At the time of this welding, the bottom film 110 and the seal part 134 are not welded. Further, the ink chamber film 113A and the sensor chamber film 113B are welded to the film welding parts 133A and 133B. After the assembly of these, a predetermined amount of ink is injected through the ink injection port 108 into an inside space formed of the first case member 102A, the bottom film 110, the ink chamber film 113A and the sensor chamber film 113B. After this injection, the ink injection flow path 132 is sealed by welding the bottom film 110 and the seal part 134. At the time of the injection, since the ink delivery port 106 is used as the opening for discharging the air in the inside space or as the opening for decreasing the pressure in the inside space, in the case where the valve body 129 is inserted into the inside of the ink delivery port 106 and the seal rubber 128 is mounted to the ink delivery port 106 before the injection of the ink, at the time of the ink injection, the valve body 129 is moved, and the inside space is made to communicate with the outer air or a pressure reducing apparatus.

A tank unit is constructed by the first case member 102A, the ink chamber film 113A, the sensor chamber film 113B, and the like.

As stated above, the first case member 102A side is constructed as the tank unit, and the second case member 102B side is constructed as the pressurizing unit, so that the number of parts is decreased and cost reduction is realized, and further, it becomes possible to recycle the pressurizing unit.

In the ink cartridge 101 according to this embodiment, as shown in FIG. 26, the fixing holes 127 for fixing the erroneous mounting prevention block 109 are bored in the first case member 102A constituting the tank unit. As stated above, the erroneous mounting prevention block 109 is provided at the tank unit side, so that it is possible to certainly prevent a mistake in combination of the kind of ink stored in the tank unit and the kind of the erroneous mounting prevention block 109.

Figure 28:
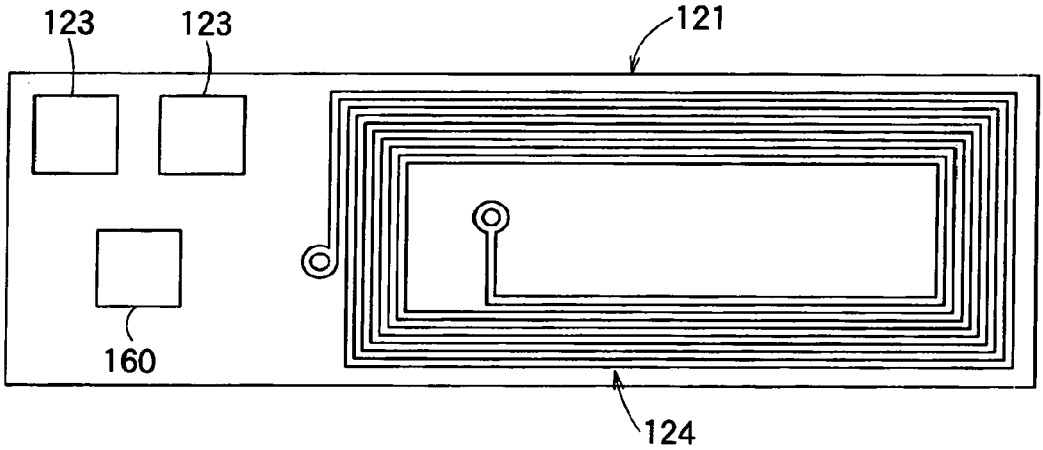
FIG. 28 is a plan view showing an IC board of the ink cartridge shown in FIG. 18 under magnification.

FIG. 28 is a plan view showing the IC board (IC module) 121 incorporated in the ink cartridge 101 under magnification, and as shown in FIG. 28, the pair of contact terminals 123 are formed on the IC board 121. The pair of contact terminals 123 are disposed side by side along the long side direction of the IC board 121. Incidentally, the IC board 121 is disposed in the inside of the container body 102 while its long side direction is coincident with the long side direction of the container body 102 of the ink cartridge 101.

Besides, the antenna member 124 is formed of the coil-shaped pattern on both sides of the IC board 121, and the pair of contact terminals 123 are disposed outside the antenna member 124 formed of the coil-shaped pattern.

Further, the control IC 160 is provided on the IC board 121, and this control IC 160, together with the pair of contact terminals 123, is disposed outside the antenna member 124 formed of the coil-shaped pattern.

Figure 29:
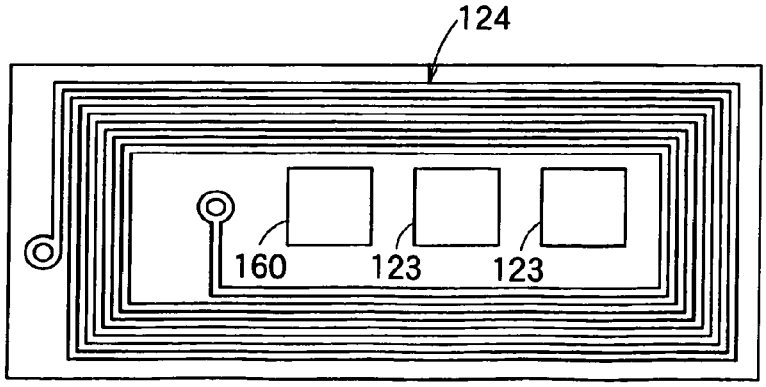
FIG. 29 is a plan view showing a modified example of the IC board of the ink cartridge shown in FIG. 1 under magnification.

FIG. 29 shows a modified example of the IC board 121, and in this modified example, a pair of contact terminals 123 and a control IC 160 are disposed inside an antenna member 124 formed of a coil-shaped pattern.

Figure 30:
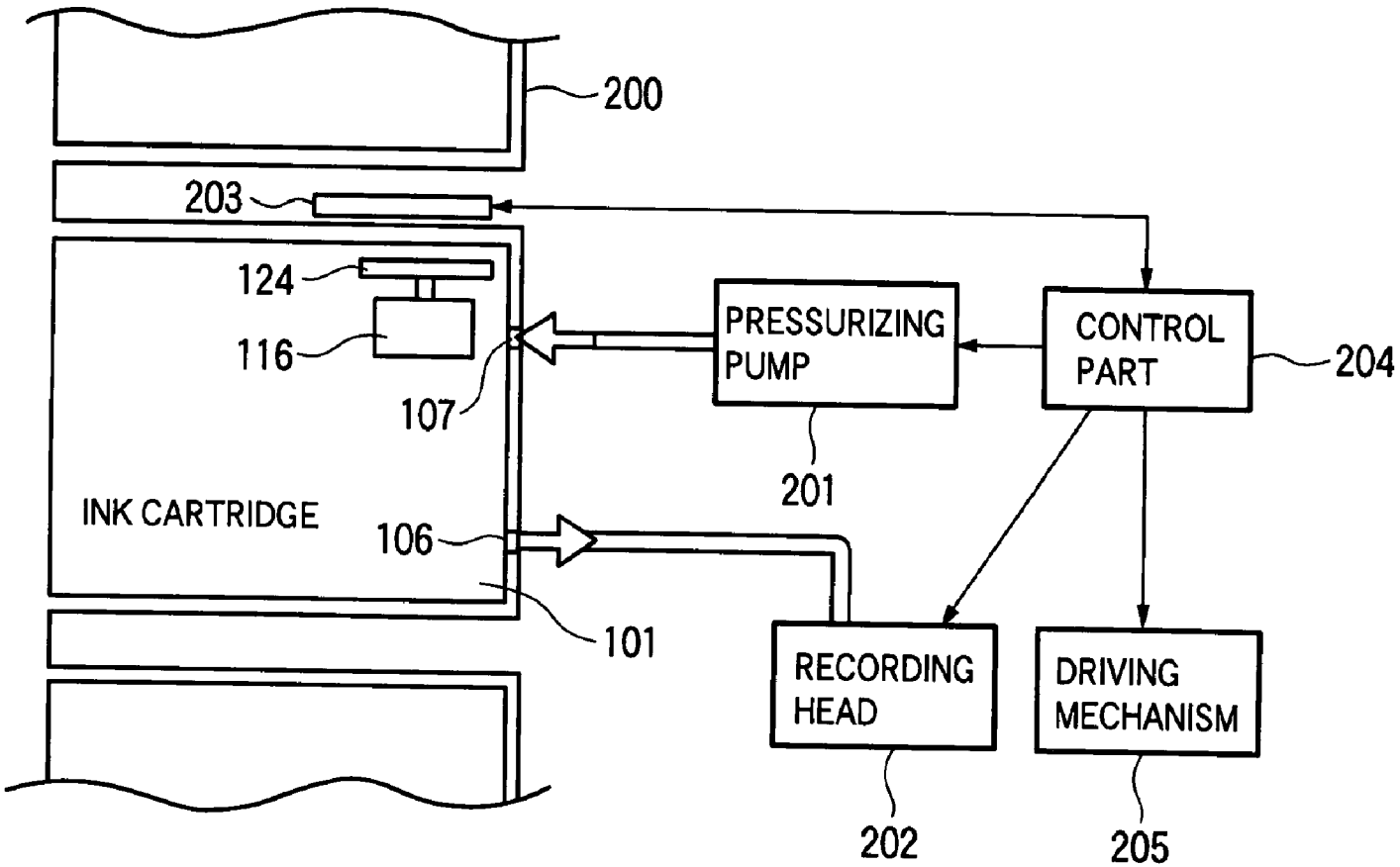
FIG. 30 is a block diagram showing a state in which the ink cartridge shown in FIG. 18 is mounted in an ink-jet recording apparatus.

FIG. 30 is a block diagram showing a state in which the ink cartridge 101 is mounted in an ink-jet recording apparatus 200. As shown in FIG. 30, compressed air from a pressurizing pump 201 of the ink-jet recording apparatus 200 is introduced into the inside of the ink cartridge 101 through the compressed air introduction port 107. By this, ink is delivered from the ink delivery port 106 of the ink cartridge 101, and the ink is supplied to a recording head 202 of the ink-jet recording apparatus 200. The compressed air is supplied from the ink-jet recording apparatus 200, so that the ink cartridge 101 can be miniaturized, and manufacturing cost can be reduced.

An antenna 203 is adjacent to the antenna 124 provided in the inside of the ink cartridge 101 and is provided in the ink-jet recording apparatus 200 side. An output signal of the detection unit 116 provided in the inside of the ink cartridge 101 is transmitted from the antenna 124 in the ink cartridge 101 to the antenna 203 in the ink-jet recording apparatus 200 side in a non-contact manner. The detection signal of the detection unit 116 received by the antenna 203 is sent to a control part 204 of the ink-jet recording apparatus 200. The control part 204 controls the pressurizing pump 201, the recording head 202, and a driving mechanism 205 such as a carriage.

Besides, the IC board 121 provided in the inside of the ink cartridge 101 has a function of storing information relating to the ink in the ink cartridge 101, and the information relating to the ink stored in the IC board 121, together with the detection signal of the detection unit 116, is transmitted to the antenna 203 in the ink-jet recording apparatus 200 side from the antenna 124 in the ink cartridge 101 side. The information stored in the IC board 121 is the information relating to, for example, a remaining amount of ink in the ink cartridge 101, the kind of ink, the model number of ink and the like.

Incidentally, in this embodiment, although the output signal of the detection unit 116 is transmitted to the ink-jet recording apparatus 200 in the non-contact manner using the antennas 124 and 203, the signal may be transmitted in a contact manner in which an electric contact provided in the ink cartridge 101 is made to come in contact with an electric contact provided in the ink-jet recording apparatus 200 side.

Next, the detection operation of the detection unit 116 including the contact type switch 120 will be described with reference to FIGS. 31 to 34.

Figure 31:
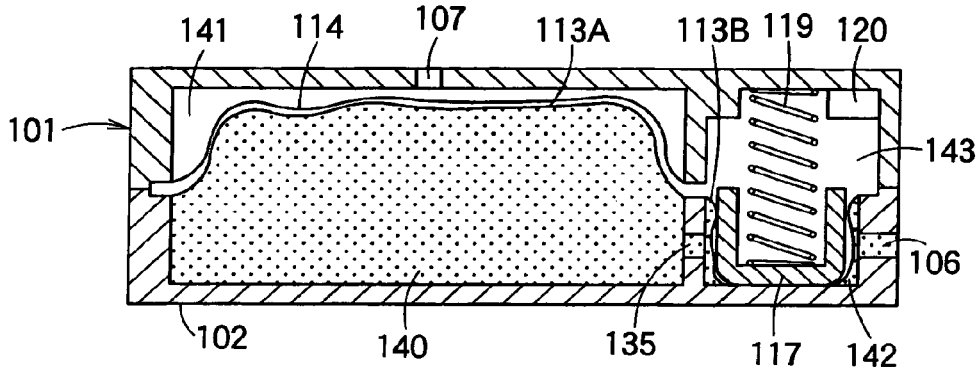
Figure 31:
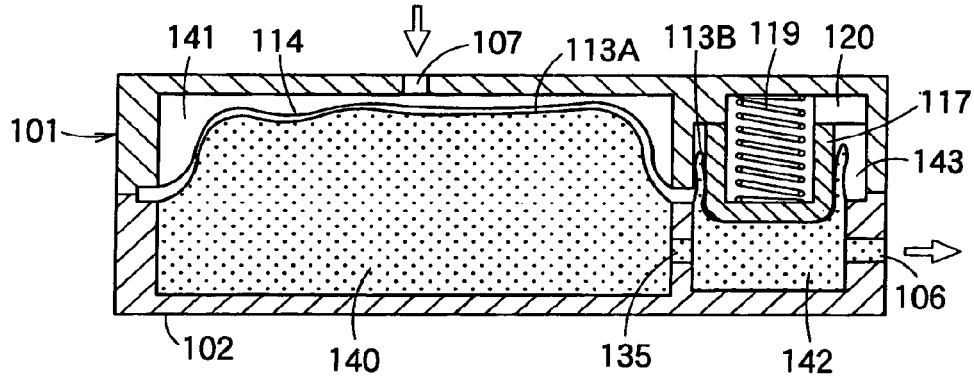
Figure 31:
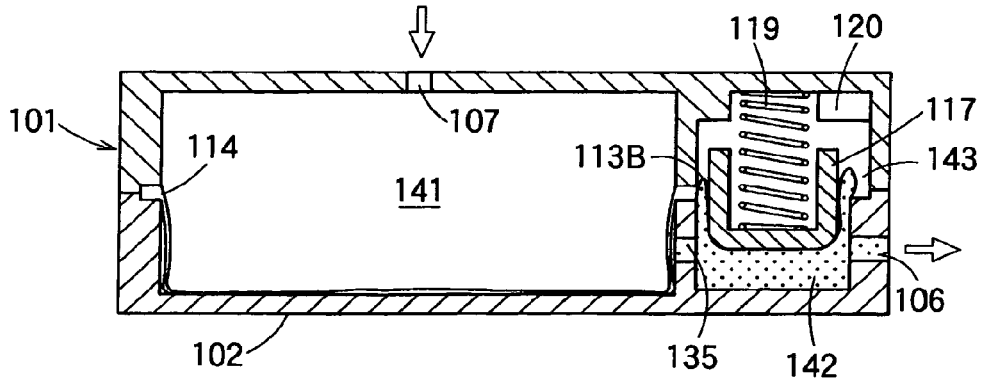

FIGS. 31A, 31B and 31C are sectional views schematically showing the ink cartridge 101 in order to describe the detection operation of the detection unit 116. As is apparent from FIG. 31, an ink reservoir chamber (first liquid reservoir chamber) 140 for storing ink, an ink pressurizing chamber 141 formed above the ink reservoir chamber 140, and a sensor chamber (second liquid reservoir chamber) 142 provided at a midway of a flow path for connecting the ink reservoir chamber 140 and the ink delivery port 106 are formed in the inside of the container body 102 of the ink cartridge 101.

Incidentally, in FIG. 31, although the compressed air introduction port 107 is formed in the upper surface of the ink cartridge 101, it is preferable that the compressed air introduction port 107 is formed in the same surface as the surface in which the ink delivery port 106 is formed.

A part of a wall forming the ink reservoir chamber 140 is made of the ink chamber film 113A, a part of a wall forming the sensor chamber 142 is made of the flexible sensor chamber film 113B, and a part of a wall forming the ink pressurizing chamber 141 is made of the flexible pressurizing chamber film 114.

Since the ink pressurizing chamber 141 is airtightly sealed by the pressurizing chamber film 114, the pressure of the compressed air introduced into the inside of the ink cartridge 101 is not transmitted to a space 143 where the spring seat member 117, the compression spring 119 and the like are disposed.

FIGS. 31A and 32A show a state where the ink reservoir chamber 140 is sufficiently filled with ink, and the compressed air is not introduced in the ink pressurizing chamber 141. In this state, since the pressure of the compressed air is not applied to the ink in the ink reservoir chamber 140, the inside of the ink reservoir chamber 140 has the atmospheric pressure. Accordingly, the spring seat member 117 is pressed to the inner wall bottom of the container body 102 by the spring force of the compression spring 119, and in this state, as is apparent from FIG. 32A, the movable side terminal 120A of the contact type switch 120 and the fixed side terminal 120B are in contact with each other. That is, in this state, the contact type switch 120 is in the on state (conduction state).

FIGS. 31B and 32B show a state in which the ink reservoir chamber 140 of the ink cartridge 101 is sufficiently filled with ink, and the compressed air is introduced from the compressed air introduction port 107 into the inside of the ink pressurizing chamber 141 by the pressurizing pump 201.

In this embodiment, when a pressure actually applied to the ink in the ink reservoir chamber 140 by the compressed air is P1, and a pressure actually applied to the ink in the sensor chamber 142 by the spring force of the compression spring 119 is P2, the pressure of the compressed air and the spring force of the compression spring 119 are set so that P1>P2 is established.

More specifically, since the spring force of the compression spring 119 is changed according to its compression amount, the pressure P2 applied to the ink in the sensor chamber 142 by the spring force of the compression spring 119 is changed within a range of P2-MAX to P2-MIN in accordance with the amount of the ink stored in the inside of the sensor chamber 142. Then, in this embodiment, the pressure of the compressed air and the spring force of the compression spring 119 are set so that P1>P2-MAX>P2-MIN is established.

As stated above, the maximum pressure P2-MAX of the compression spring 119 is made smaller than the pressure P1 of the compression air, so that the detection unit 116 can be operated without fail.

Besides, in this embodiment, when a pressure loss by reaction force at the time of deformation of the ink chamber film 113A and the pressurizing chamber film 114 is P4, and a pressure of the compressed air introduced from the compressed air introduction port 107 to the ink pressurizing chamber 141 is P1', the pressure of the compressed air and the spring force of the compression spring 119 are set so that P1'−P4=P1>P2 is established.

By this, even in the case where the reaction force is generated at the time of deformation of the ink chamber film 113A and the pressurizing chamber film 114, the detection unit 116 can be operated without fail.

As shown in FIGS. 31B and 32B, the pressurizing chamber film 114 is pressed to the ink reservoir chamber 140 side by the pressure of the compressed air introduced into the ink pressurizing chamber 141 and is deformed, and the deformed pressurizing chamber film 114 comes in contact with the ink chamber film 113A, and the ink chamber film 113A is pressed to the ink reservoir chamber 140 side and is deformed. By this, the ink in the ink reservoir chamber 140 is pressurized, and the pressurized ink flows into the sensor chamber 142 through the communicating path 135.

Then, the sensor chamber film 113B is deformed upward by the pressure of the ink having flowed in the sensor chamber 142, and the spring seat member 117 is pressed upward against the spring force of the compression spring 119. Then, as is understood from FIG. 32B, the movable side terminal 120A of the contact type switch 120 is pressed by the pressed-up spring seat member 117 and is pressed upward. By this, the movable side terminal 120A and the fixed side terminal 120B are separated from each other to produce a non-contact state, and the contact type switch 120 is put in the off state (non-conduction state).

That is, in the case where the ink in the ink reservoir chamber 140 is pressurized by the compressed air, and the pressure of the ink in the inside of the ink reservoir chamber 140 and the sensor chamber 142 has a predetermined value or more, the contact type switch 120 is put in the off state.

That is, in the detection unit 116 of the ink cartridge 101 of this embodiment, the ink in the ink reservoir chamber 140 is pressurized by the compressed air, and the pressure of the pressurized ink in the ink reservoir chamber 140 is transmitted to the ink in the sensor chamber 142. At this time, in the case where the pressure P of the ink in the inside of the sensor chamber 142 is higher than the predetermined value, that is, the pressure P2 applied to the ink in the sensor chamber 142 by the spring force of the compression spring 119, the spring seat member 117 is pressed upward up to the upper limit position, and the contact type switch 120 is put in the off state.

Incidentally this embodiment is constructed such that when the spring seat member 117 displaced against the spring force of the compression spring 119 by the increase of volume of the sensor chamber 142 reaches the vicinity of the limit point (upper limit position) in the displaceable range, it comes in contact with the movable side terminal 120A and the movable side terminal 120A is displaced.

Besides, this embodiment is constructed such that when a pressure loss by the reaction force at the time of deformation of the sensor chamber film 113B is P5, and a pressure applied to the sensor chamber film 113B from the spring seat member 117 is P2', P1>P2'+P5, and P2'−P5=P2>P are established. By this, even in the case where the reaction force is generated at the time of deformation of the sensor chamber film 113B, the detection unit 116 can be operated without fail.

Besides, as described above, in this embodiment, the sensor chamber through hole 112 is constructed to have the substantially square section, so that the reaction force at the time of deformation is lessened, and the pressure loss P5 due to the deformation is lessened.

Besides, this embodiment is constructed such that when the pressure loss in the ink flow path from the ink cartridge 101 to the ink-jet recording apparatus 200 is P3, P1>P2>P3 is established. More specifically, the minimum pressure P2-MIN of the compression spring 119 becomes larger than the pressure loss P3 of the ink flow path. By this, almost all ink existing in the sensor chamber 142 can be certainly delivered from the ink delivery port 106 by the spring force of the compression spring 119.

Incidentally, since the pressure necessary for pressurizing the sensor chamber 142 may be smaller than the pressure necessary for pressurizing the ink reservoir chamber 140, this pressurizing force is generated by the compression spring 119 as in this embodiment, so that the ink cartridge 101 can be miniaturized and manufacturing cost can be reduced.

Further, this embodiment is constructed such that when the water head difference of the ink cartridge 101 relative to the recording head 202 of the ink-jet recording apparatus 200 is P7, P1>P2>P3−P7 is established. By this, even in the case where the recording head 202 is located at a position higher than the ink cartridge 101, ink can be certainly supplied from the ink cartridge 101 to the recording head 202.

In the ink-jet recording apparatus 200, when ink is consumed, the amount of ink in the ink reservoir chamber 140 is decreased, and the volume of the ink reservoir chamber 140 is gradually decreased. At this time, when the remaining amount of ink in the ink reservoir chamber 140 is a predetermined value or more, the pressure of the compressed air applied to the ink in the ink reservoir chamber 140 is transmitted through the ink to the ink in the sensor chamber 142. Accordingly, in this state, the state in which the spring seat member 117 is pressed upward up to the upper limit position against the spring force of the compression spring 119 is kept, and the off state of the contact type switch 120 is kept.

The ink in the ink reservoir chamber 140 is further consumed, and as shown in FIG. 31C, when there occurs a state in which the ink hardly exists in the ink reservoir chamber 140, the pressure of the compressed air is not transmitted to the ink in the sensor chamber 142. Then, the spring seat member 117 descends in accordance with the consumption of the ink in the sensor chamber 142, and as shown in FIG. 32C, the pressing-up state of the movable side terminal 120A by the spring seat member 117 is released, there occurs a state where the movable side terminal 120A is in contact with the fixed side terminal 120B, and the contact type switch 120 is switched from the off state to the on state.

That is, the pressure of the compressed air is not transmitted to the ink in the container body 102, and in the case where the pressure of the ink in the container body 102 is less than the predetermined value, the contact type switch 120 is put in the on state.

Besides, in other words, the contact type switch 120 operates and is put in the on state when the ink in the inside of the ink pressurizing chamber 141 is all consumed and the ink stored in the inside of the ink cartridge 101 becomes only the ink in the inside of the sensor chamber 142. That is, the detection unit 116 including the contact type switch 120 can digitally detect whether or not the amount of ink stored in the inside of the ink cartridge 101 is the predetermined value or more corresponding to the maximum value of the amount of ink which can be stored in the inside of the sensor chamber 142.

Here, it is preferable that the predetermined value corresponding to the maximum value of the amount of ink which can be stored in the inside of the sensor chamber 142 is set to an amount of ink which can print one or more sheets of recording paper to be processed by the ink-jet recording apparatus 200. By setting the predetermined value as stated above, even after an ink near end (N/E) is detected by the detection unit 116, it is not necessary to stop printing, and it is possible to prevent the recording paper from being wasted.

As described above, since the movable side terminal 120A is pressed and displaced by the displacing spring seat member 117, the switching operation of the contact type switch 120 can be certainly performed by the simple structure.

Incidentally, in this embodiment, the movable side terminal 120A is pressed upward by the raised spring seat member 117 and the contact type switch 120 is switched from the on state (conduction state) to the off state (non-conduction state). However, a modified example may be such that the arrangement of the movable side terminal 120A and the fixed side terminal 120B is turned upside down, and in the non-pressure state, the movable side terminal 120A and the fixed side terminal 120B are put in the non-contact state, and at the time of pressurization, the movable side terminal 120A is pressed upward by the raised spring seat member 117 and comes in contact with the fixed side terminal 120B.

Figure 33:
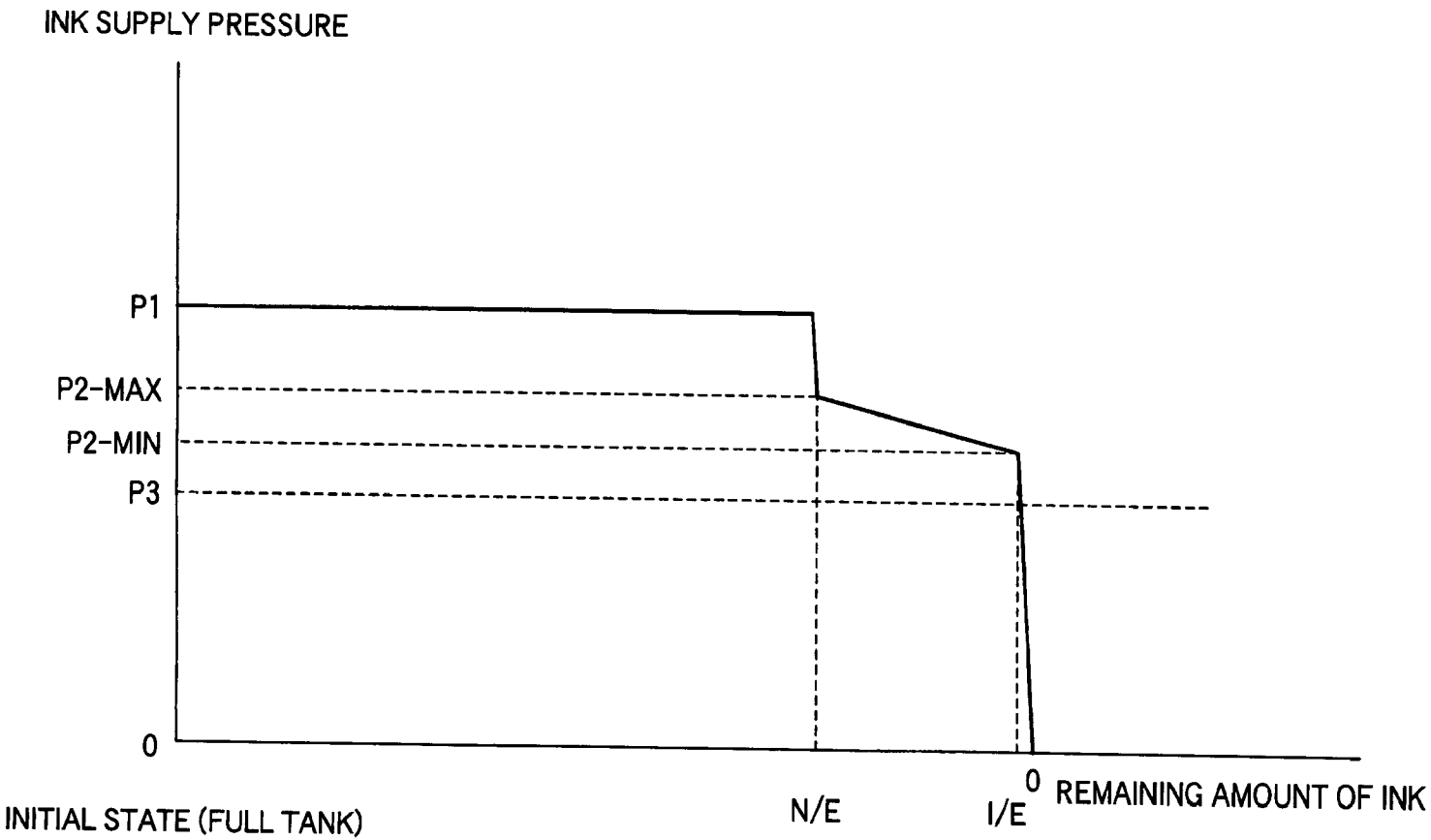
FIG. 33 is a view showing an ink supply pressure which changes in accordance with the consumption of ink in the ink cartridge shown in FIG. 18.
Figure 35:
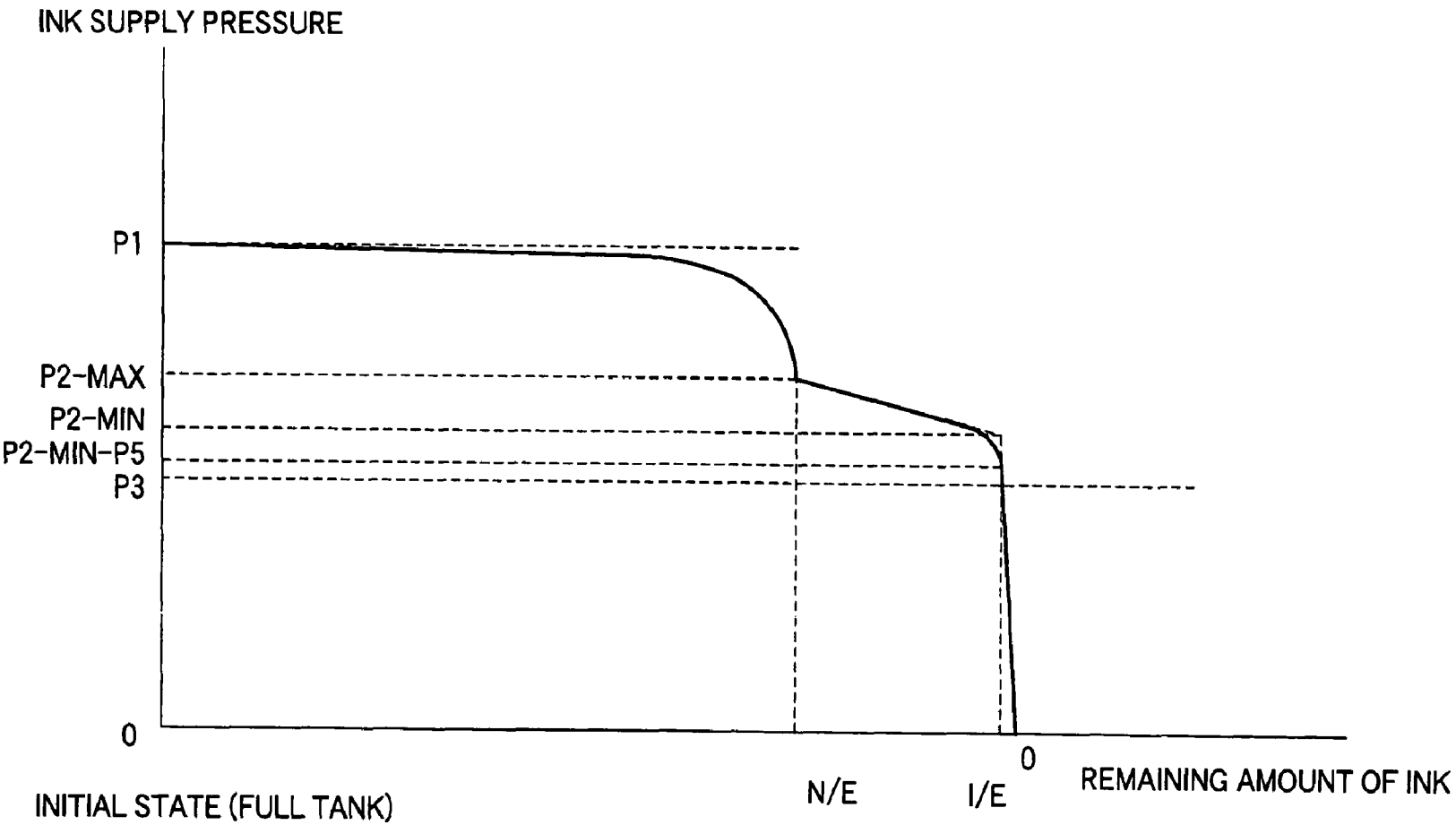
FIG. 35 is a view showing an ink supply pressure which changes in accordance with the consumption of ink in the ink cartridge shown in FIG. 18, and shows a case where reaction force at the time of deformation of an ink chamber film and a pressurizing chamber film is considered.

FIGS. 33 and 35 show ink supply pressures which change in accordance with the consumption of ink in the ink cartridge 101, and the horizontal axis indicates the remaining amount of ink in the ink cartridge 101. Here, the "ink supply pressure" is the pressure of the ink delivered from the ink delivery port 106 of the ink cartridge 101.

Incidentally, FIG. 33 is a graph in the case where the reaction force at the time of deformation of the ink chamber film 113A and the sensor chamber film 113B is not considered, and FIG. 35 is a graph in the case where the reaction force at the time of deformation of the ink chamber film 113A and the sensor chamber film 113B is considered.

As is understood from FIG. 33, in the state (initial state) where the ink cartridge 101 is full of ink, the pressure P1 of the compressed air becomes the ink supply pressure as it is. Then, as long as the remaining amount of ink in the ink cartridge 101 is a predetermined value or more, the ink supply pressure is kept at the pressure P1 of the compressed air.

Then, when there occurs a state in which the remaining amount of ink in the ink cartridge 101 becomes lower than the predetermined value (in this embodiment, the state in which the ink in the ink reservoir chamber 140 is almost exhausted), the pressure of the compressed air is not transmitted to the ink in the ink cartridge 101. In this state, the ink supply pressure is determined by the spring force of the compression spring 119.

That is, at the point of time when the remaining amount of ink in the ink cartridge 101 is lowered to the predetermined value, that is, at the point of time of the ink near end (N/E), the maximum spring pressure P2-AMX of the compression spring 119 in the maximally compressed state becomes the ink supply pressure.

Then, as the consumption of the ink in the sensor chamber 142 progresses, the compression amount of the compression spring 119 becomes small, and the spring pressure is decreased to the spring pressure (minimum spring pressure) P2-MIN at the point of time when the spring seat member 117 reaches the inner bottom of the container body 102. At this point of time, ink does not remain even in the sensor chamber 142, and the ink cartridge 101 is put in the state of ink end (I/E).

Besides, as is understood from FIG. 35, in the initial state, the pressure P1 of the compressed air becomes the ink supply pressure almost as it is. When the consumption of the ink progresses and the ink in the ink reservoir chamber 140 is decreased, the reaction force of the ink chamber film 113A and the pressurizing chamber film 114 gradually become large, and the ink supply pressure is gradually decreased.

Then, when there occurs a state where the remaining amount of ink in the ink reservoir chamber 140 becomes lower than the predetermined value, the pressure of the compressed air is not transmitted to the ink in the ink cartridge 101. In this state, the ink supply pressure is determined by the compression spring 119 and the reaction force of the sensor chamber film 113B.

Incidentally, the pressure P3 in FIG. 33 (and FIG. 35) indicates the pressure loss of the ink flow path from the ink cartridge 101 to the recording head 202. The minimum spring pressure P2-MIN of the compression spring 119 is set to become larger than the pressure loss P3 in the ink flow path, so that the ink in the sensor chamber 142 can be used up.

Besides, FIG. 34 is a table showing the transition of an output signal of the detection unit 116 according to the existence of ink and the operation/stop of the pressurizing pump. Incidentally, "there is ink" in FIG. 34 indicates the case where the remaining amount of ink in the ink cartridge 101 is a predetermined value or more, and "there is no ink" indicates the case where the remaining amount of ink in the ink cartridge 101 is less than the predetermined value.

As is understood from FIG. 34, in the case where the pressurizing pump 201 operates in the state where there is ink, the detection unit 116 is put in the OFF state (non-conduction state). On the other hand, even in the case where the pressurizing pump 201 operates, when there occurs the state where there is no ink, the detection unit 116 is put in the ON state (conduction state). Besides, in the case where the pressurizing pump 201 is stopped, the detection unit 116 is put in the ON state irrespective of the existence of the ink in the ink reservoir chamber 140.

Then, in the ink cartridge 101 according to this embodiment, by using the foregoing operation characteristics of the detection unit 116, as described below, it is possible to detect poor mounting (insufficient insertion, etc.) of the ink cartridge 101 to the ink-jet recording apparatus 200, or to detect trouble of the detection unit 116.

That is, in the case where the remaining amount of ink in the ink cartridge 1 is the predetermined value or more (for example, a new ink cartridge 101 is mounted), when the detection unit 116 is not turned OFF although the pressurizing pump 201 is operated, it is conceivable that there occurs the poor mounting of the ink cartridge 101 or the trouble of the detection unit 116. In this case, for example, a message to urge the user to confirm the mounting state of the ink cartridge 101 is displayed.

Incidentally, information as to whether the remaining amount of ink in the ink cartridge 101 is the predetermined value or more at the point of time when it is mounted in the ink-jet recording apparatus 200 is previously stored in the IC board 121 incorporated in the ink cartridge 101.

Besides, in the case where the detection unit 116 is in the OFF state although the pressurizing pump 201 is in the stop state, it is judged that the detection unit 116 is out of order.

Next, a method of assembling the ink cartridge 101 will be described.

When the ink cartridge 101 is assembled, the tank unit including the first case member 102A, the ink chamber film 113A, the sensor chamber film 113B, the third case member 102C and the like, and the pressurizing unit including the second case member 102B, the detection unit 116, the pressurizing chamber film 114 and the like are first respectively formed as separate bodies. Thereafter, the tank unit and the pressurizing unit are stacked and are fixed to each other by heat caulking.

Here, the ink reservoir chamber 140 and the sensor chamber 142 are formed in the tank unit in a sealed state, while the ink pressurizing chamber 141 is formed in the pressurizing unit in a sealed state. Accordingly, when the tank unit and the pressurizing unit are stacked and are fixed to each other, it is not necessary to ensure sealing between both the units.

Figure 47:
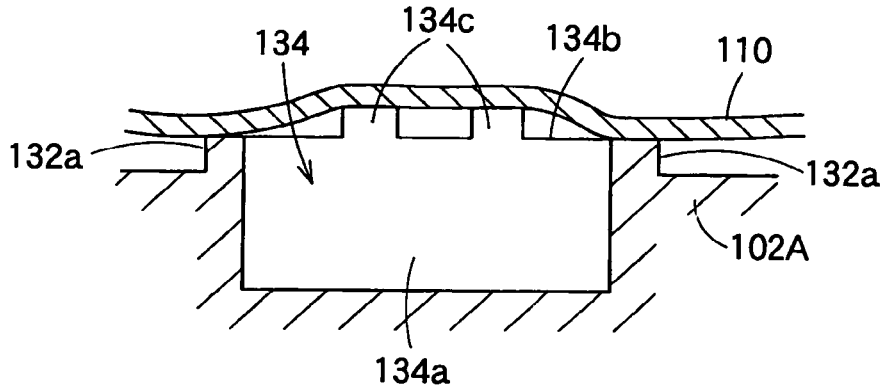
FIG. 47A shows a state in which a clearance is formed between a top surface of a partition wall and a bottom film when ink is filled into the ink cartridge.
FIG. 47B shows a state in which the top surface of the partition wall and the bottom film are attached to each other to close a flow passage after the filling of ink is complete.
Figure 47:
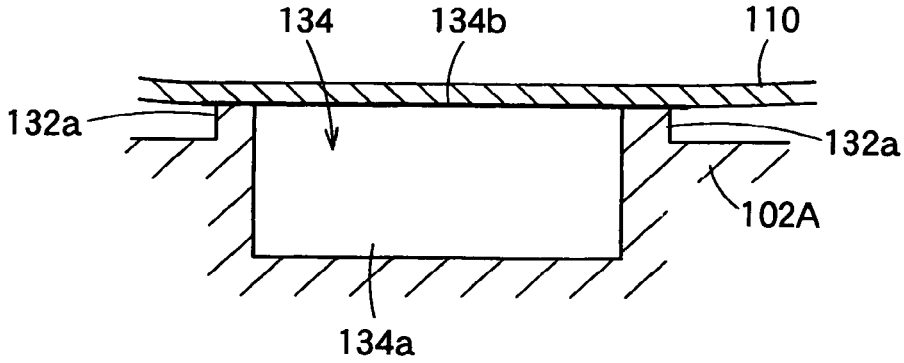

Next, a manufacturing method of the above-mentioned ink cartridge, in particular, a method of injecting ink into the inside of the ink reservoir chamber 140 will be discussed with reference to FIG. 47.

First of all, in a case member providing step, the first case member 102A prior to being joined to the second case member 102B and the third case member 102C is provided. This first case member 102A is in such a state that the ink chamber film 113A and the sensor chamber film 113B are attached to the film welding parts 133A and 133B on one surface of the first case member 102A, and the bottom film 110 is welded to the film welding part 136A and 136B on the other surface thereof.

As shown in FIG. 47A, the seal part 134 provided in a midway of the ink injection passage 132 (see FIG. 27) of the first case member 102A includes a partition wall 134*a* for closing the ink injection passage 132, and clearance formation projecting parts 134*c* formed on a top surface 134*b* of this partition wall 134*a*.

The first case member 102A provided in the case member providing step has a clearance between the top surface 134*b* of the partition wall 134*a* and the bottom film 110 due to the clearance formation projecting parts 134*c* formed on the top surface 134*b* of the partition wall 134. That is, the bottom film 110 in this point of time is not welded to the top surface 134*b* of the partition wall 134*a*, and is welded only to the top portions of the clearance formation projecting parts 134*c*. In addition, the bottom film 110 is welded to the top surface of the projecting part 132*a* forming a part of wall surface defining the ink injection passage 132.

Next, in a fluid discharge step, the ink injection port 108 is temporally closed, and a vacuum unit is connected to the ink delivery port 106, whereby air in the inside of the ink reservoir chamber 140 and the ink injection passage 132 is discharged and decompressed.

Next, in an ink injection step, ink is injected from the ink injection port 108 to the ink injection passage 132, so that ink injected into the ink injection passage 132 passes through the clearance between the top surface 134*b* of the partition wall 134*a* and the bottom film 110 and flows into the inside of the ink reservoir chamber 140.

After the injection of ink into the inside of the ink reservoir chamber 140 is complete, the method advances to a flow passage closing step in which the bottom film 110 is welded to the top surface 134*b* of the partition wall 134*a* to close the ink flow passage. In this flow passage closing step, as shown in FIG. 47B, the bottom film 110 is welded to the top surface 134*b* of the partition wall 110 by heat and pressure application means while melting the clearance formation projecting parts 134*c* formed on the top surface 134*b* of the partition wall 134*a*.

Next, in a vacuum discharge step, ink existing in the ink injection passage 132 between the ink injection port 108 and the partition wall 134*a* is vacuum-discharged through the ink injection port 108.

Thereafter, in an injection port closing step, the seal member 150 is welded to the ink injection port 108 to close the ink injection port 108.

As mentioned above, ink between the ink injection port 108 and the partition wall 134*a* is vacuum-discharged, and the thus discharged ink is re-utilized, to thereby eliminate wasteful disposal of ink.

Further, no ink remains between the ink injection port 108 and the partition wall 134*a*. Therefore, it is possible to prevent ink leakage from the ink injection port 108. Further, such a feeling as if ink still remains in the ink cartridge 101 will not be caused after ink in the ink cartridge 101 is completely used.

Furthermore, since the seal member 150 is welded to close the ink injection port 108, it is more surely prevent the ink leakage from the ink injection port 108.

As mentioned above, after the ink is injected into the ink reservoir chamber 140 of the first case member 102A, the first case member 102A, the second case member 102B and the third case member 102C are united together.

As described above, in the ink cartridge 101 and the method of manufacturing the same according to this embodiment, the partition wall 134*a* is provided in the ink injection passage 132 communicating the ink injection port 108 with the ink reservoir chamber 140. When the ink is filled into the ink reservoir chamber 140, the ink flows through the clearance between the bottom film 110 and the top surface 134*b* of the partition wall 134*a*. After the filling of ink is complete, the bottom film 110 is bonded to the top surface 134*b* of the partition wall 134*a*. Therefore, even in a case where the ink reservoir 140 is defined by a rigid member such as the first case member 102A and a flexible member such as the ink chamber film 113A, injection of ink into the ink reservoir chamber 140 can be readily conducted, and the ink flow passage used during the ink injection can be reliably sealed after the ink injection is complete.

By forming the clearance forming projecting part 134*c* on the top surface 134*b* of the partition wall 134*a*, the clearance can be surely secured between the top surface 134*b* of the partition wall 134*a* and the bottom film 110 during the ink injection. Further, when the ink reservoir chamber 140 and the ink injection passage 132 are decompressed prior to the ink injection, a part of the ink injection passage 132 between the partition wall 134*a* and the ink injection port 108 can be surely decompressed.

Further, the first case member 102A is formed of a material suitable for welding film material thereto from the viewpoint of welding the ink chamber film 113A and the sensor chamber film 113B thereto. For this reason, even in a case where the partition wall 134*a* is formed as an integral part of the first case member 102A, the welding of the bottom film 110 to the top surface 134*b* of the partition wall 134*a* can be performed without any problem.

Moreover, since the ink injection is performed using the ink injection port 108 and the ink delivery port 106 formed in the first case member 102A, it is unnecessary to inject ink downwardly in a gravity direction, which is required in a case of an ink cartridge constructed by an ink bag. Accordingly, the freedom as to the ink injection direction during ink filling is high. For this reason, the ink cartridge 101 can be arranged such that the motion of the heat and pressure application means for welding is directed downwardly (in the gravity direction) when the bottom film 110 is welded to the top surface 134*b* of the partition wall 134*a* after the ink injection is complete. This arrangement makes the welding operation easier in comparison to a case in which the heat and pressure application means is moved horizontally as required in a flexible bag type ink cartridge.

As described above, in the ink cartridge 1 according to this embodiment, as shown in FIG. 28 or 29, since the pair of contact terminals 123 formed on the IC board 121 are disposed side by side along the long side direction of the IC board 121, the movable side terminal 120A and the fixed side terminal 120B of the contact type switch 120 can be easily and certainly brought into contact with the pair of terminals 23 while being elastically deformed, and the structure of the movable side terminal 120A and the fixed side terminal 120B can be made simple, and further, in the middle of manufacture of the ink cartridge 101, it is possible to easily visually confirm that the movable side terminal 120A and the fixed side terminal 120B are certainly in contact with the pair of contact terminals 123.

Besides, in the ink cartridge 101 according to this embodiment, as shown in FIG. 28, the pair of contact terminals 123 are disposed outside the antenna member 124 formed of the coil-shaped pattern, so that it is possible to ensure the distance between the antenna member 124 and the movable side terminal 120A and the fixed side terminal 120B of the contact type switch 120, and accordingly, it is possible to avoid that an electric wave transmitted from the antenna member 124 interferes with the movable side terminal 120A and the fixed side terminal 120B.

Besides, in the ink cartridge 101 according to this embodiment, since the movable side terminal 120A and the fixed side terminal 120B made of the conductive elastic member are brought into pressure contact with the pair of contact terminals 123 while they are elastically deformed, the movable side terminal 120A and the fixed side terminal 120B can be certainly brought into contact with the pair of contact terminals 123, and further, it is not necessary to perform soldering or the like to connect the terminals, so that manufacturing cost is reduced and recycling of the detection unit 116 becomes easy.

Besides, as shown in FIG. 29, when the pair of contact terminals 123 and the control IC 160 are disposed inside the antenna member 124 formed of the coil-shaped pattern, the area of the board body constituting the IC board can be made small, and manufacturing cost can be reduced.

As described above, in the ink cartridge 101 according to this embodiment, since the tank unit and the pressurizing unit individually include the sealed chambers, it is not necessary to ensure sealing between both the units, and the assembly or decomposition of the ink cartridge is easy.

Besides, in the ink cartridge 101 according to this embodiment, the compressed air is not brought into direct contact with the ink chamber film 113A, but the pressurizing chamber film 114 deformed by the contact with the compressed air is brought into contact with the ink chamber film 113A. Thus, the amount of air permeating through the ink chamber film 113A and dissolving in the ink can be suppressed to a large degree, and the lowering of print quality due to the dissolving of the air into the ink can be prevented.

As described above, in the ink cartridge 101 according to this embodiment, the communication through an electric wave is performed between the ink-jet recording apparatus 200 and the IC board 121 by using the antenna member 124, and the information relating to the remaining amount of ink obtained by the detection unit 116 and the electric power to the detection unit 116 are transmitted, so that an electric contact between the ink-jet recording apparatus 200 and the ink cartridge 101 becomes unnecessary, and it is possible to avoid trouble of poor contact which becomes a problem when the electric contact is provided.

Incidentally, although it is difficult to supply large electric power by the communication through the electric wave, in the ink cartridge 101 according to this embodiment, the detection unit 116 for digitally detecting whether or not the remaining amount of ink is the predetermined value or more is provided, so that it is possible to detect the remaining amount of ink by use of small electric power.

Besides, in the ink cartridge 101 according to this embodiment, since the detection unit 116 is operated by the pressure actually applied to the ink in the ink reservoir chamber 140 from the compressed air, it is possible to certainly judge the existence of the delivery of the ink from the ink cartridge 101.

Besides, in this embodiment, since the sensor chamber through hole 112 is formed to have the substantially square section, the reaction force at the time of deformation of the sensor chamber film 113B becomes small, and it becomes possible to deform the sensor chamber film 113B by small pressure. Thus, it is possible to certainly detect the pressure change of the ink in the sensor chamber 142.

Besides, in the ink cartridge 101 according to this embodiment, it is possible to detect the point of time when ink in the ink reservoir chamber 140 is almost exhausted and the sensor chamber 142 is filled with ink, that is, the point of time when the ink near end (N/E) occurs. Thus, it is possible to avoid such a situation that the ink end (I/E) occurs in the middle of printing and the recording paper is wasted.

Besides, in the ink cartridge 101 according to this embodiment, the amount of ink which can be supplied from the point of time of the ink near end (N/E) to the ink end (I/E) is determined by the amount of ink in the sensor chamber 142 at the point of time of the ink near end (N/E). Then, since the amount of ink in the sensor chamber 142 at the point of time of the ink near end (N/E) is determined at the design stage, this ink amount is stored in the IC board 121 of the ink cartridge 101, and the remaining amount of ink is rewritten into the predetermined amount of ink at the point of time when the detection unit 116 detects the ink near end (N/E), so that it becomes possible to accurately judge the point of time of the ink end (I/E). Thus, it is possible to avoid such a situation that a judgment of ink end (I/E) is made although ink sufficiently remains in the ink cartridge 101 and the ink is wasted, or an erroneous judgment that ink sufficiently remains is made although the ink end (I/E) almost actually arises, and the ink end (I/E) arises in the middle of printing and the recording paper is wasted.

Besides, since the amount of ink consumed from the point of time of an ink full-tank state to the point of time of the ink near end (N/E) is determined at the design stage, this ink amount is stored in the IC board 121 of the ink cartridge 101, so that at the point of time of the ink near end (N/E), information relating to the unit weight of an ink droplet can be corrected on the basis of the number of times of discharge of ink droplets. By this, the accuracy of calculation of the ink consumption amount after the ink near end (N/E) can be raised, and the point of time of the ink end (I/E) can be more accurately judged.

Besides, in this embodiment, since a signal to detect whether or not the ink in the ink cartridge 101 is pressurized by the compressed air, and a signal to detect the point of time when the remaining amount of ink in the ink cartridge 101 becomes the near end (N/E) are the same signal outputted from the detection unit 116, the mechanism for detection can be simplified.

Further, in this embodiment, the minimum spring pressure P2-MIN of the compression spring 119 is set to be larger than the pressure loss P3 in the ink flow path, so that the ink in the sensor chamber 142 can be used up.

FIGS. 36A, 36B and 36C show a modified example of the foregoing embodiment, and the respective states of FIGS. 36A, 36B and 36C correspond to the respective states of FIGS. 31A, 31B and 31C.

Figure 36:
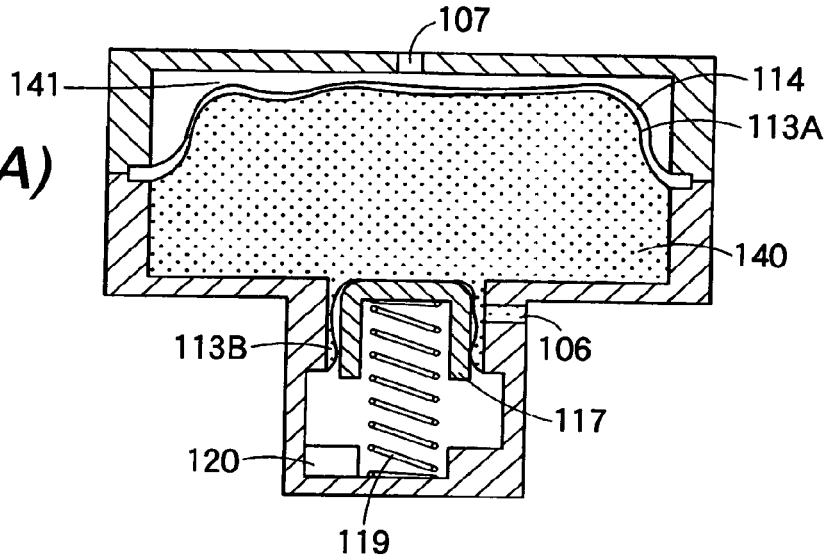
Figure 36:
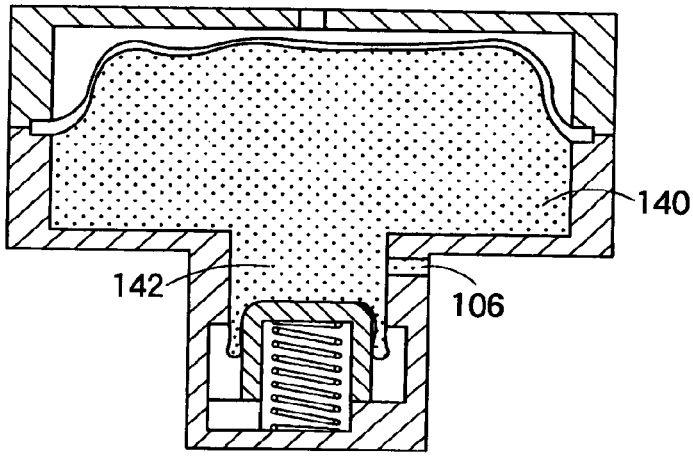
Figure 36:
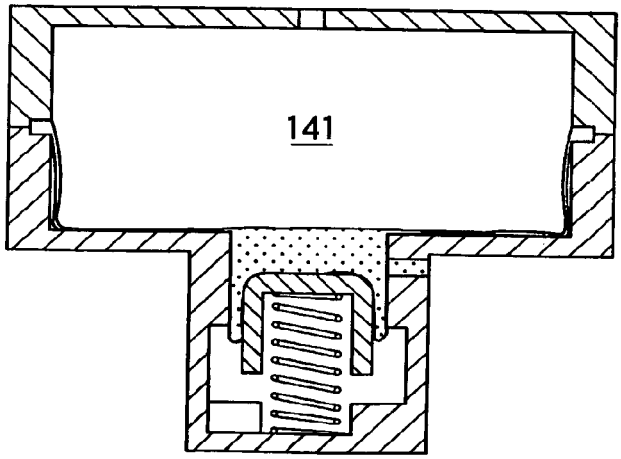

As shown in FIG. 36, in the ink cartridge according to this modified example, an ink reservoir chamber 140 and a sensor chamber 142 are integrally formed without a narrow flow path intervening between both the chambers. Besides, an ink chamber film 113A and a sensor chamber film 113B are constructed as separate bodies, and both the films 113A and 113B are disposed so that a press direction to the ink chamber film 113A and a press direction to the sensor chamber film 113B are opposite to each other.

Also in this modified example, effects similar to the foregoing embodiment can be obtained.

Figure 37:
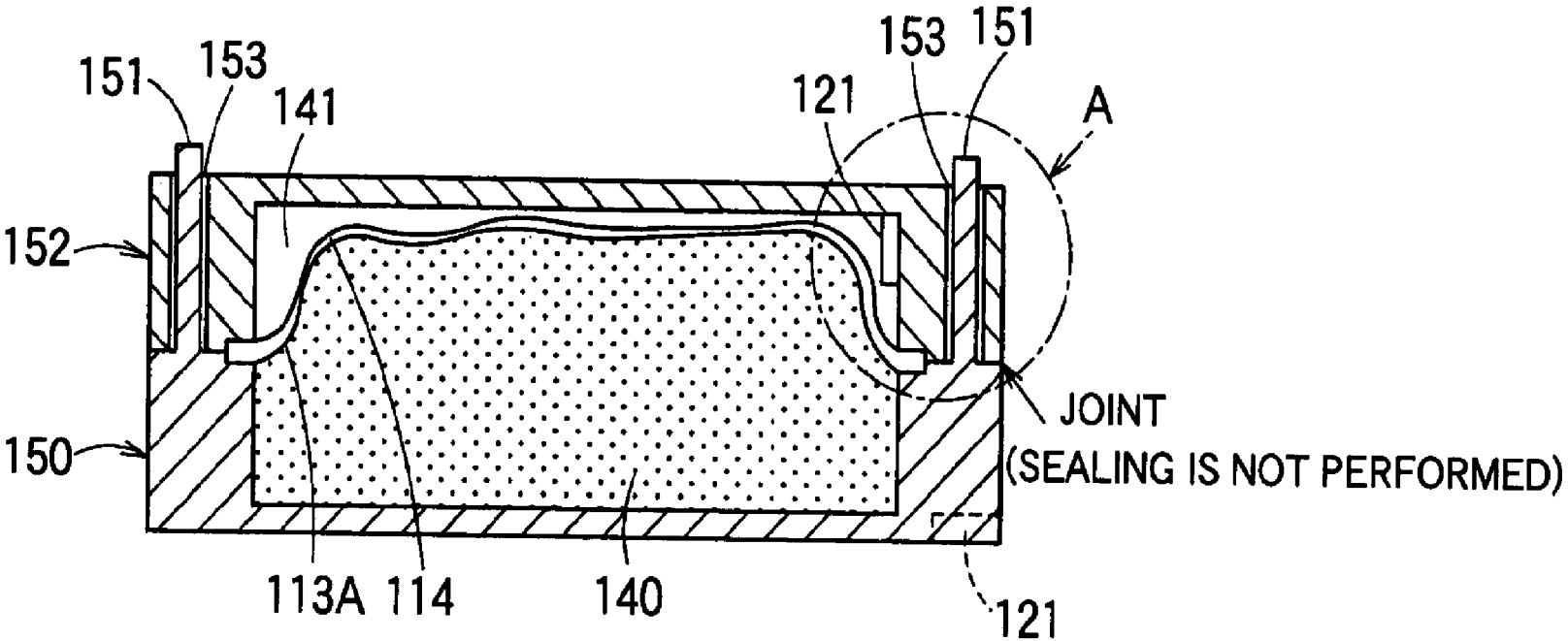
FIG. 37 is a sectional view showing a state before a tank unit and a pressurizing unit are connected by heat caulking in a manufacture process of the ink cartridge shown in FIG. 18.
Figure 38:
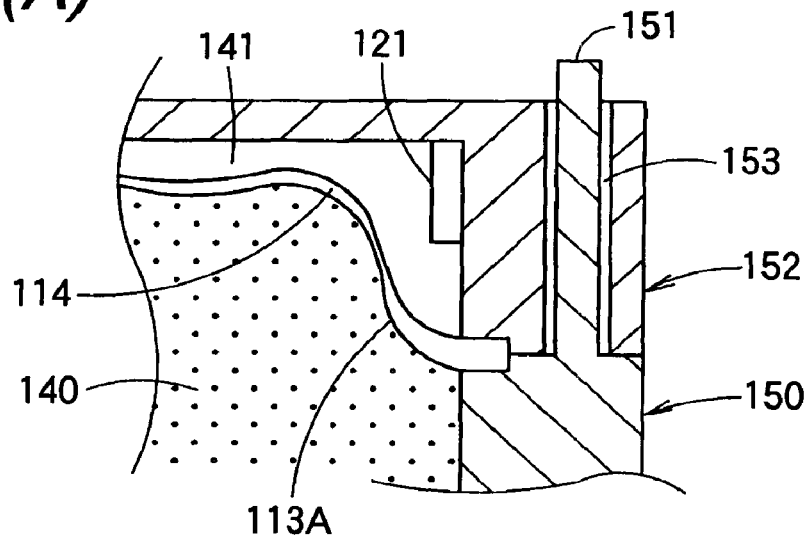
FIG. 38A is a view showing a part A of FIG. 37 under magnification.
FIG. 38B is a view showing a state in which a heat-caulked rib is heat-caulked.
Figure 38:
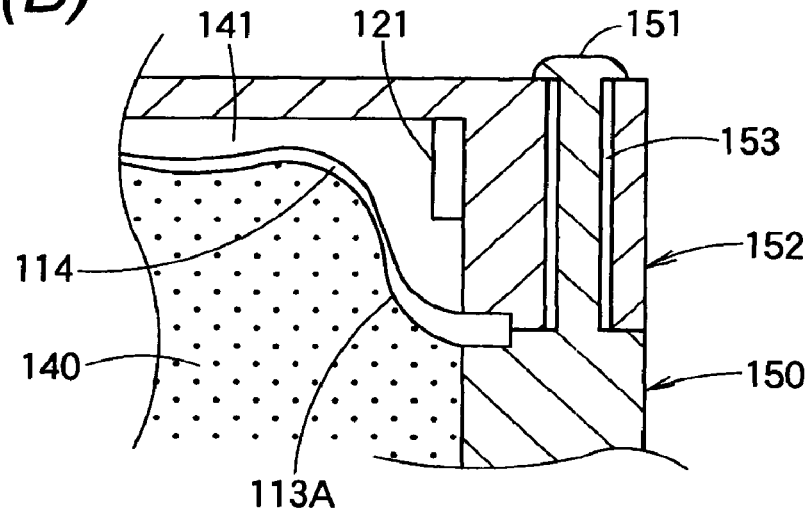
Figure 39:
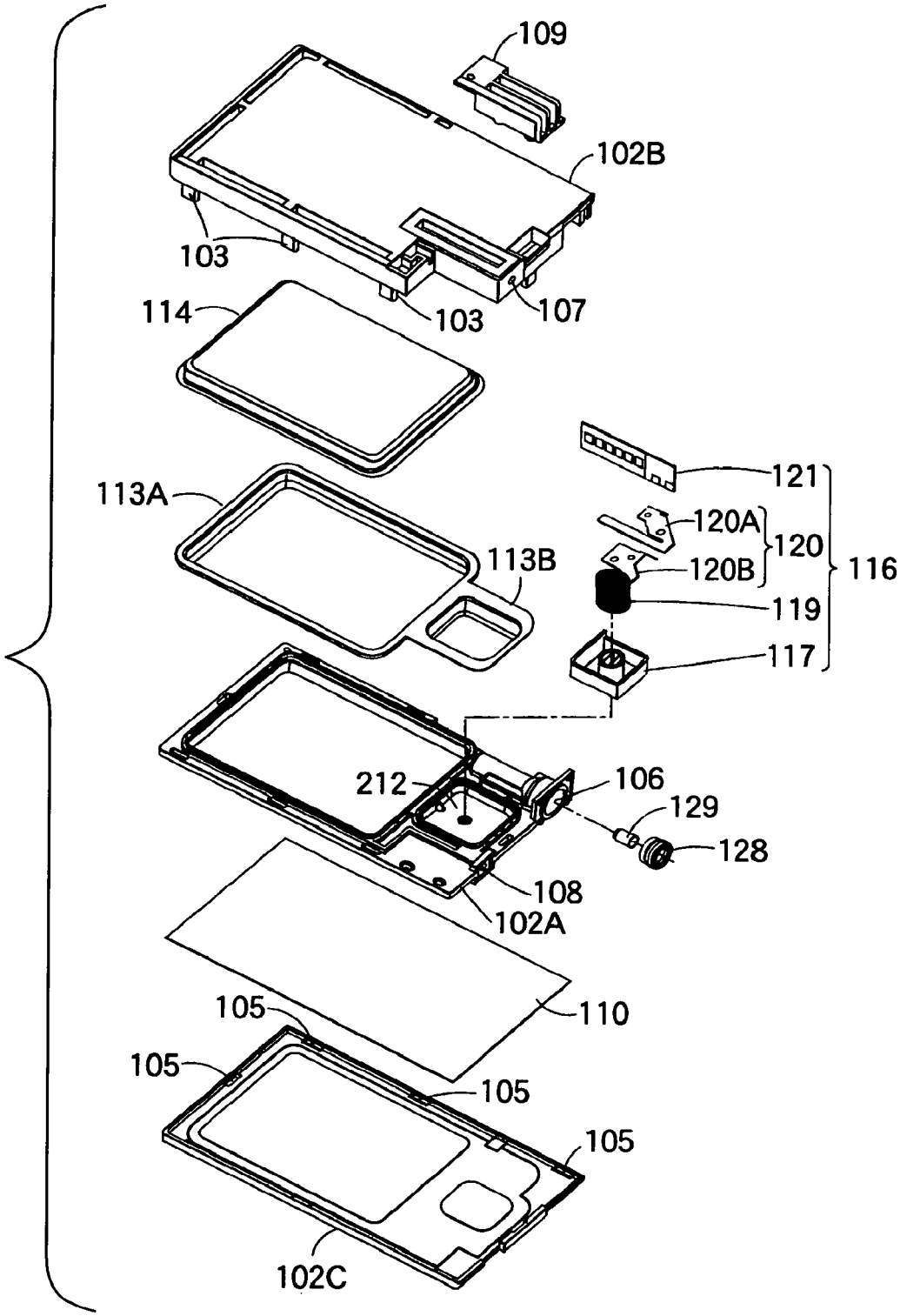
FIG. 39 is an exploded perspective view of an ink cartridge according to a third embodiment.
Figure 40:
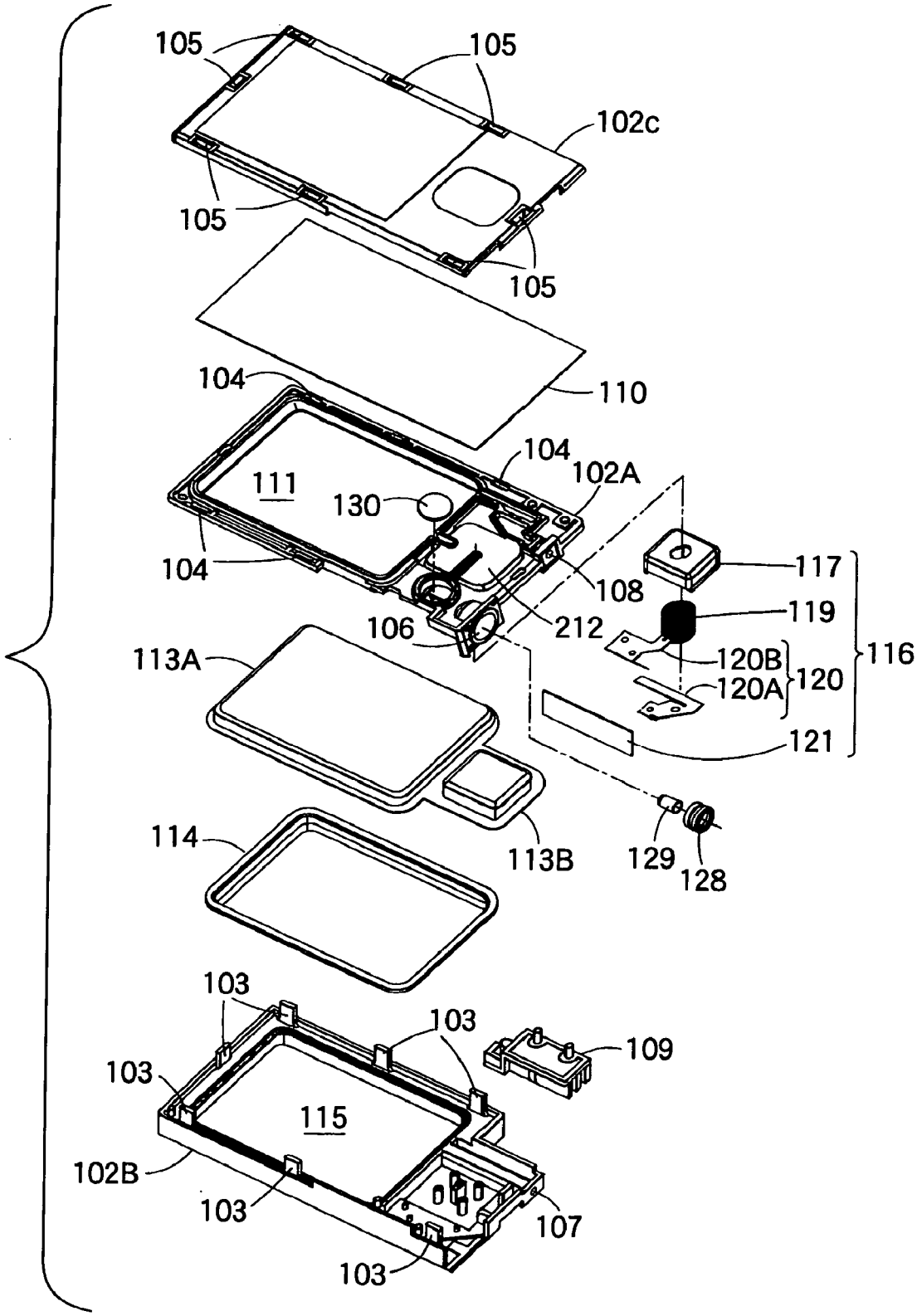
Figure 41:
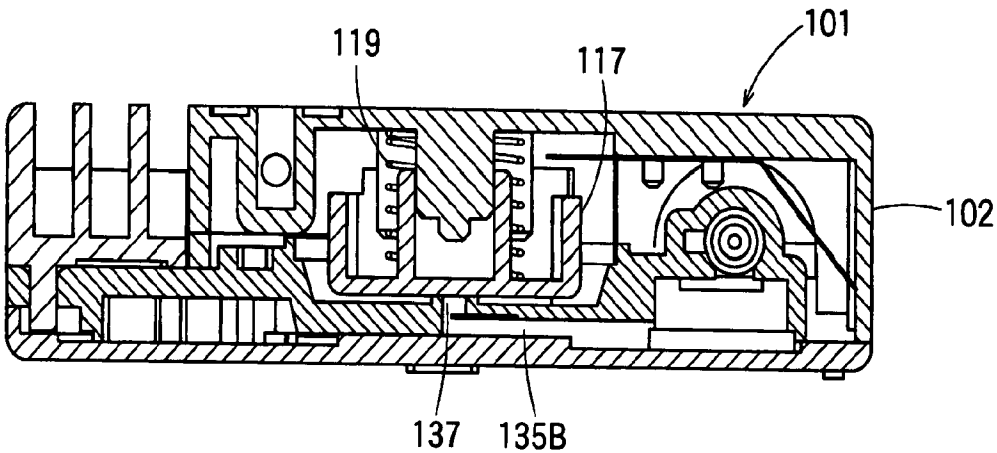
FIG. 41A is a sectional view of the third embodiment taken along line A-A shown in FIG. 18A.
FIG. 41B is a sectional view of the third embodiment taken along line B-B shown in FIG. 18A.
Figure 41:
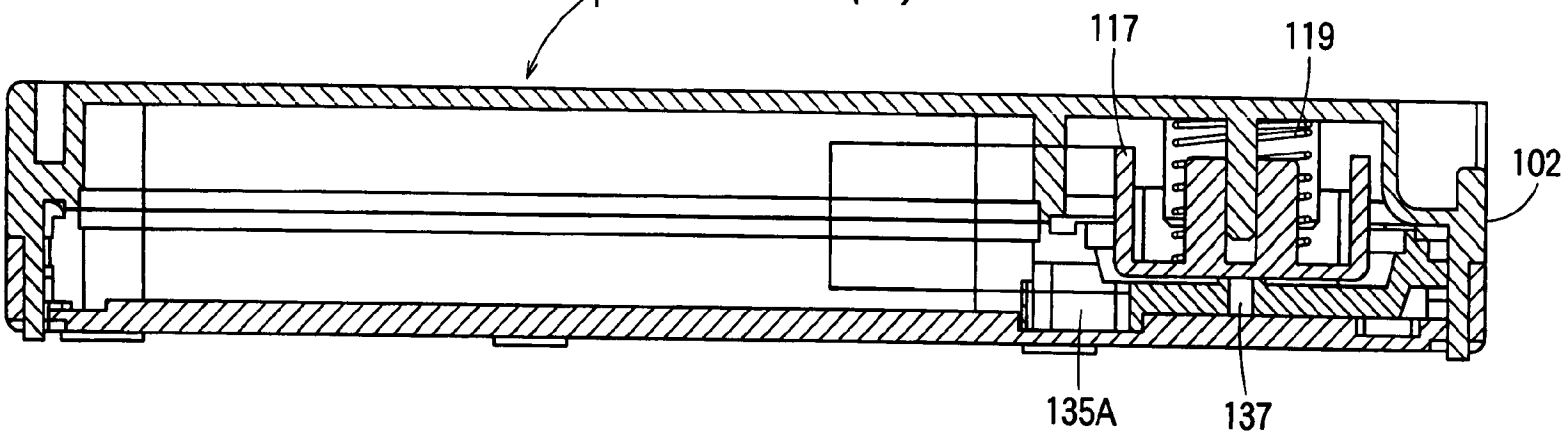
Figure 42:
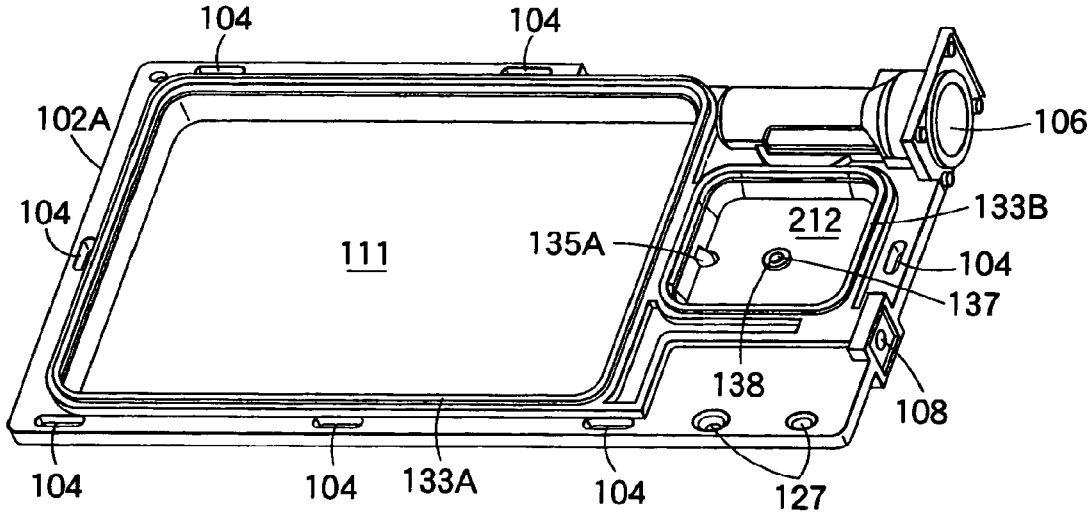
FIG. 42 is a perspective view showing a tank unit of the ink cartridge according to the third embodiment.
Figure 43:
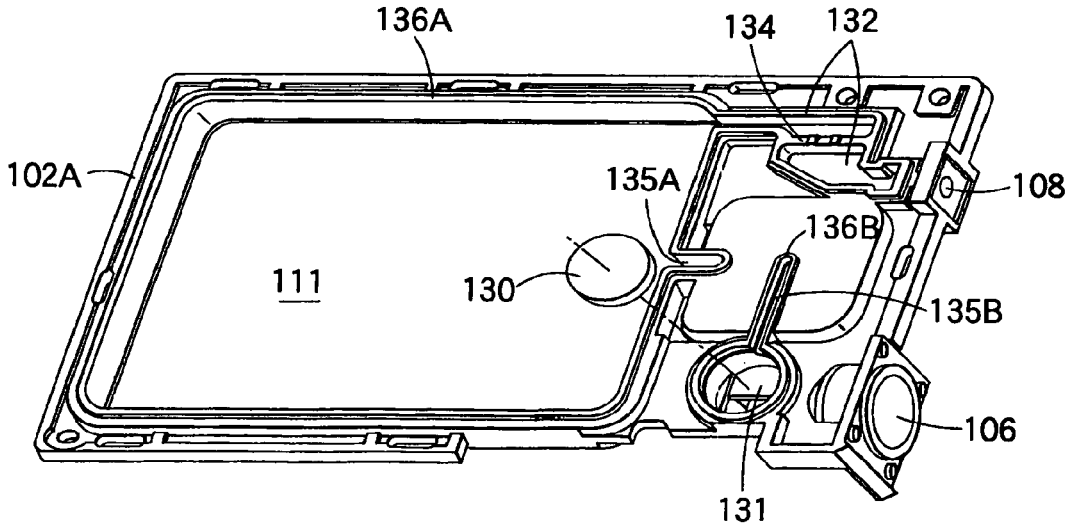

As a modified example of the above embodiment, as shown in FIG. 37, heat caulking ribs 151 may be formed at a tank unit 150 side, and through holes 153 for rib insertion may be formed at a pressurizing unit 152 side. At the assembly, as shown in FIG. 38A, after the heat caulking rib 151 is inserted in the through hole 153, as shown in FIG. 38B, the heat caulking rib 151 is heat-caulk. Incidentally, sealing between the tank unit 150 and the pressurizing unit 152 is unnecessary.

As stated above, the heat caulking ribs 151 are formed at the tank unit 150 side, so that when a used ink cartridge is decomposed and is recycled, the pressurizing unit 152 which is not subjected to deformation by heat caulking can be recycled as it is. By this, since the pressurizing unit 152 in which the detection unit 116 including the expensive IC board 121 is disposed can be recycled, a cost reducing effect by recycling can be raised.

Besides, as another modified example of the embodiment, as indicated by a dotted line in FIG. 37, an IC board 121 having a function of storing information relating to ink in the ink cartridge 101 may also be provided at the tank unit 150 side. By doing so, it is possible to certainly prevent such a situation that ink actually stored in the tank unit 150 is inconsistent with the data stored in the IC board 121.

As described above, in the liquid container of the invention, since the plural terminals formed in the IC module are disposed side by side along the long the side direction of the IC module, the detection unit can be easily and certainly brought into contact with the plural terminals of the IC module, and the structure of the terminals at the detection unit side can be made simple, and further, it is possible to easily visually confirm that the terminals of the detection unit side are certainly in contact with the terminals of the IC module side in the middle of manufacture of the liquid container.

As described above, according to the invention, in the liquid container constructed such that the pressurized fluid is sent into the inside of the liquid container so that the liquid in the container is delivered to the outside, it is possible to judge whether the liquid in the inside of the liquid container is actually pressurized by the pressurized fluid.

As described above, according to the invention, in the liquid container constructed such that the pressurized fluid is sent into the inside of the liquid container so that the liquid in the inside of the container is delivered to the outside, it is possible to judge whether the liquid in the inside of the liquid container is actually pressurized by the pressurized fluid, and the liquid in the second reservoir chamber can be used up.

As described above, according to the invention, in the liquid container constructed such that the pressurized fluid is sent into the inside of the liquid container so that the liquid in the container is delivered to the outside, the assembling and decomposing work can be made easy.

Besides, according to the invention, in the foregoing type of liquid container, it is possible to realize the structure which is easy to recycle.

Further, according to the invention, in the foregoing type of liquid container, it is possible to prevent the pressurized fluid introduced into the inside of the container from dissolving in the liquid.

As described above, in the liquid container according to the invention, the detection unit for digitally detecting whether or not the amount of ink stored in the inside of the liquid container is the predetermined value or more is provided, and the output signal of this detection unit is transmitted to the liquid consuming apparatus by the electric wave, so that the electric contact between the liquid consuming apparatus and the liquid container becomes unnecessary, and it is possible to avoid the trouble of poor contact which becomes the problem in the case where the electric contact is provided.

Third Embodiment

A third embodiment of the invention will be described with reference to FIGS. 39 to 46. In the third embodiment, the sensor chamber through hole 112 of the second embodiment is formed as a sensor chamber recess 212. Members of the third embodiment corresponding to members described in the second embodiment are denoted by the same reference numerals as those of the second embodiment, and their duplicate description will be omitted.

An ink injection port 108 formed in a first case member 102A communicates with an ink chamber through hole 111 through an ink injection flow path 132. Besides, the ink chamber through hole 111 and the sensor chamber recess 212 are communicated with each other through a narrow communicating path 135A. Further, a filter mounting part 131 in which a filter 130 is inserted and the sensor chamber recess 212 are communicated with each other through a narrow communicating path 135B.

Then, in an ink cartridge 101 according to this embodiment, as shown in FIG. 37, a small hole 137 is formed at the center part of a bottom of the sensor chamber recess 212, and this small hole 137 is positioned at one end side of the narrow communicating path 135B for connecting the sensor chamber recess 212 and the filter mounting part 131. A ring-shaped projection 138 projecting into the inside of the sensor chamber recess 212 is formed in the small hole 137. The ring-shaped projection 138 is formed of elastic material.

Figure 44:
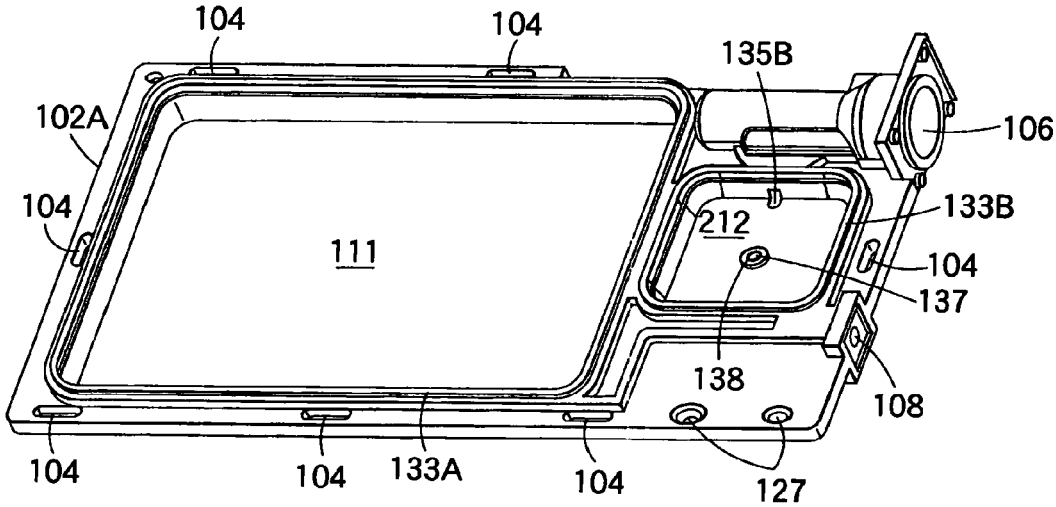
FIG. 44 is a perspective view showing a tank unit of a modified example of the ink cartridge according to the third embodiment.
Figure 45:
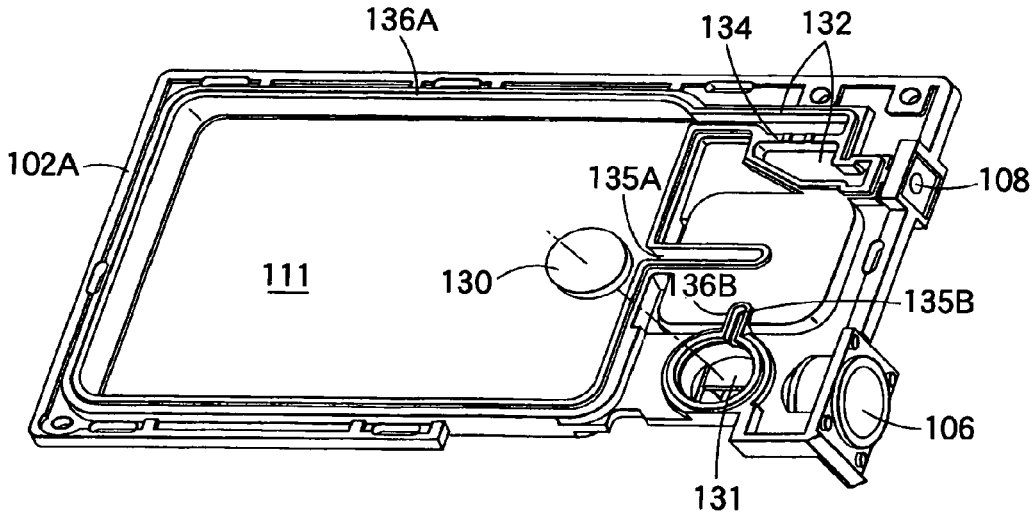
FIG. 45 is a perspective view in which the tank unit shown in FIG. 44 is turned upside down.
Figure 46:
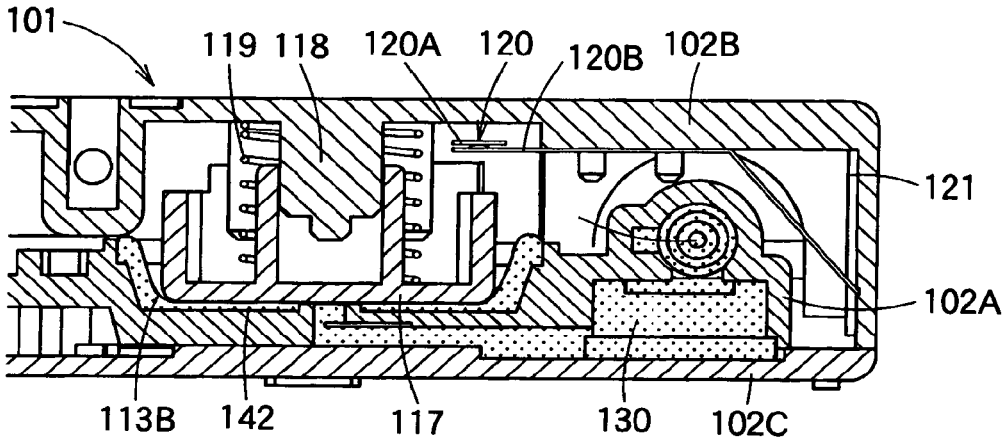
FIGS. 46A, 46B and 46C are views respectively showing a portion of a detection unit of the third embodiment.
Figure 46:
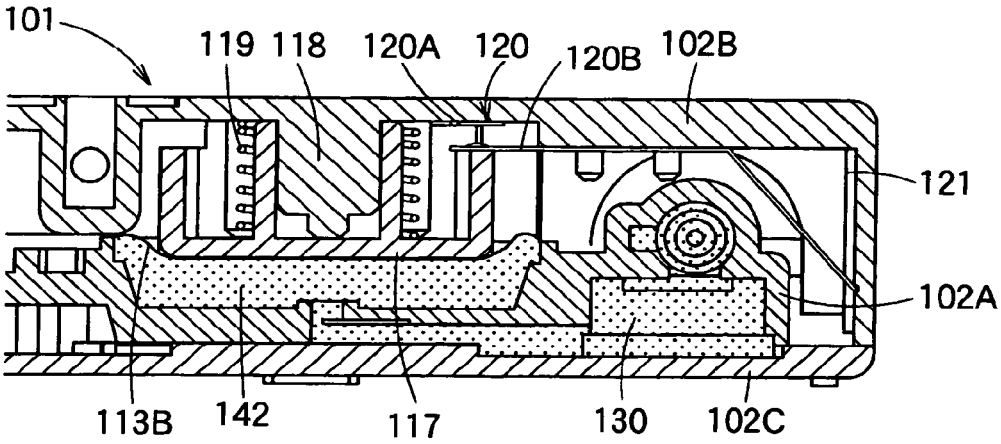
Figure 46:
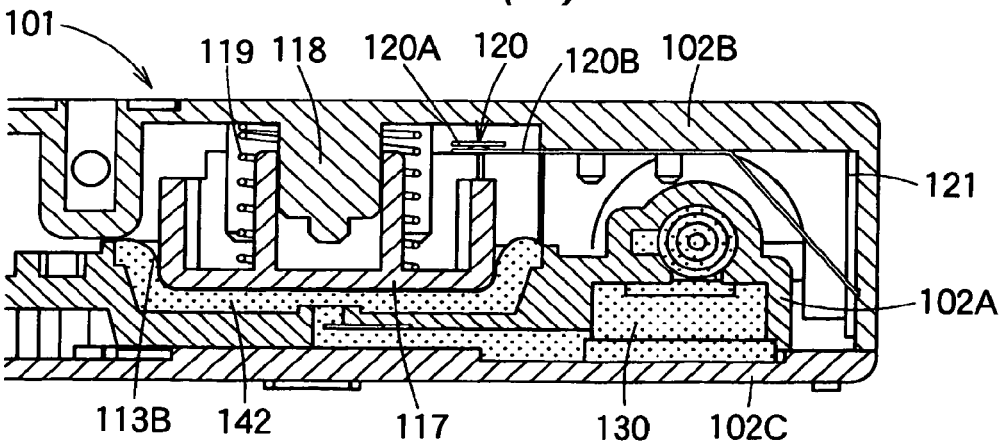

Incidentally, as a modified example, as shown in FIGS. 44 and 45, one end of a narrow communicating path 135A for connecting an ink chamber through hole 111 and a sensor chamber recess 212 may also be connected to a small hole 137. In this case, one end of a narrow communicating path 135B for connecting the sensor chamber recess 212 and a filter mounting part 131 is disposed to open into a bottom peripheral part of the sensor chamber recess 212.

Then, in the ink cartridge 101 according to this embodiment, as is understood from FIGS. 41A, 41B and 46A, in the state where ink in the ink reservoir chamber 140 is not pressurized by compressed air, the sensor chamber film 113B constituting the movable part displaced in accordance with the change of volume of the sensor chamber 142 is pressed to the tip of the ring-shaped projection 138, and by this, the small hole 137 is sealed to be openable.

As described above, according to the ink cartridge 101 of this embodiment, in the state where ink in the ink reservoir chamber 140 is not pressurized by the compressed air, since the small hole 137 is sealed by the sensor chamber film 113B, the inflow of air into the inside of the ink cartridge 101 and the leakage of ink from the ink cartridge 101 can be certainly prevented.

Besides, since the small hole 137 and the ring-shape projection part 138 can be disposed inside the sensor chamber 142, space efficiency is also excellent.

Besides, since the sensor chamber film 113B constituting the movable part for sealing the small hole 137 is the member originally necessary for constituting the sensor chamber 142, it is not necessary to additionally provide a new member for the small hole sealing, and there does not arise such a problem that the number of parts is increased and the layout becomes complicated.

Besides, the ring-shape projection 138 is formed of the elastic material, so that it is possible to prevent the sensor chamber film 113B from being damaged by repeated contact with the ring-shape projection 138, and the sealing of the small hole 137 by the sensor chamber film 113B can be made certain.

Besides, in this embodiment, since the sensor chamber recess 212 is formed to have a substantially square section, reaction force at the time of deformation of the sensor chamber film 113B becomes small, and it becomes possible to deform the sensor chamber film 113B by a small pressure. Thus, a pressure change of ink in the sensor chamber 142 can be certainly detected.

In the first to third embodiments discussed above, each of members, such as case members 10, 20, 102A, 102B, 102C, constituting the container body and members, such as film members 17, 18, 46, 113A, 113B, 114, 110, attached thereto is preferably made of polystyrene or polypropylene for the purpose of enhancing heat-welding. Each of the film member may be a single-layered film member or a multi-layered film member. In case of the multi-layered film member, a layer of the film member, which forms a surface to be heat-welded to a case member, is made of the same material as that of the case member. The multi-layered film member is advantageous over the single-layered film member in the multi-layered film member can have both the layer for enhancing the heat-welding and a layer (such as an ethylene layer) for providing a gas-impermeable property.

What is claimed is:

1. A method of manufacturing a liquid container for storing liquid to be supplied to a liquid consuming apparatus, the method comprising:

a case member providing step of providing a case member formed with a liquid reservoir chamber into which the liquid is to be filled, wherein the case member includes a liquid injection port for injecting the liquid into an inside of the case member, a liquid injection passage communicating the liquid injection port with the liquid reservoir chamber, and a liquid delivery port communicating with the liquid reservoir chamber for delivering the liquid from the liquid container to the liquid consuming apparatus, wherein a partition wall for closing the liquid injection passage is provided in a liquid flow passage, wherein a part of a wall surface forming the liquid reservoir chamber and a part of a wall surface forming the liquid injection passage are constructed by a flexible film, and wherein the flexible film is provided over a top surface of the partition wall but is not attached to the top surface of the partition wall;

a liquid injection step of injecting the liquid from the liquid injection port into the liquid injection passage so that the liquid flows into an inside of the liquid reservoir chamber through a clearance formed between the top surface of the partition wall and the flexible film; and a passage closing step of closing a flow passage of the liquid by attaching the flexible film onto the top surface of the partition wall after the injection of the liquid into the inside of the liquid reservoir chamber is complete.

2. The method according to claim 1, wherein:

a projecting part for defining the clearance between the flexible film and the top surface of the partition wall is formed on the top surface of the partition wall of the case member provided in the case member providing step, and in the flow passage closing step, the projecting part is melted so that the flexible film is welded to the top surface of the partition wall.

3. The method according to claim 2, further comprising:

a fluid discharge step after the case member providing step is complete and before the liquid injection step starts, wherein in the fluid discharge step, the liquid injection port is closed, and fluid inside the liquid reservoir chamber and the liquid injection passage is discharged from the liquid delivery port.

4. The method according to claim 2, wherein the flexible film is attached to a top surface of the projecting part formed on the top surface of the partition wall of the case member provided in the case member providing step.

5. The method according to claim 1, further comprising:

after the flow passage closing step is complete, a vacuum-discharge step of vacuum-discharging, via the liquid injection port, the liquid existing between the liquid injection port and the partition wall.

6. The method according to claim 5, further comprising:

an injection port closing step of closing the liquid injection port after the vacuum-discharge step is complete.

7. A liquid container for storing liquid to be supplied to a liquid consuming apparatus, the liquid container comprising:

a case member formed with a liquid reservoir chamber into which the liquid is to be filled, the case member including:

a liquid injection port for injecting the liquid into an inside of the case member, a liquid injection passage communicating the liquid injection port with the liquid reservoir chamber, and a liquid delivery port communicating with the liquid reservoir chamber for delivering the liquid from the liquid container to the liquid consuming apparatus, wherein:

a partition wall for closing the liquid injection passage is provided in a liquid flow passage;

a part of a wall surface forming the liquid reservoir chamber and a part of a wall surface forming the liquid injection passage are constructed by a flexible film;

the flexible film is provided over a top surface of the partition wall;

in a state in which the flexible film is not attached to the top surface of the partition wall, the liquid is injected from the liquid injection port into the liquid injection passage so that the liquid flows into an inside of the liquid reservoir chamber through a clearance formed between the top surface of the partition wall and the flexible film; and a flow passage of the liquid is closed by attaching the flexible film onto the top surface of the partition wall after the injection of the liquid into the inside of the liquid reservoir chamber is complete.

* * * * *